US011719497B2

(12) United States Patent
Czarnecki et al.

(10) Patent No.: US 11,719,497 B2
(45) Date of Patent: Aug. 8, 2023

(54) DETERMINATION OF ROUND COUNT BY HALL SWITCH ENCODING

(71) Applicant: Magpul Industries Corp., Austin, TX (US)

(72) Inventors: Erin Czarnecki, Broomfield, CO (US); Jeffrey Holt, Austin, TX (US); Michael Leighton, Broomfield, CO (US); Donald McKelvey, Erie, CO (US); Steven Dunbar, Lafayette, CO (US); Timothy Eric Roberts, Broomfield, CO (US); Nicholas Kielsmeier, Denver, CO (US); Eric Chow, Highlands Ranch, CO (US)

(73) Assignee: Magpul Industries Corp., Austin, TX (US)

( * ) Notice: Subject to any disclaimer, the term of this patent is extended or adjusted under 35 U.S.C. 154(b) by 214 days.

(21) Appl. No.: 17/238,411

(22) Filed: Apr. 23, 2021

(65) Prior Publication Data

US 2021/0254916 A1 Aug. 19, 2021

Related U.S. Application Data

(63) Continuation-in-part of application No. 16/635,692, filed as application No. PCT/US2019/057460 on Oct. 22, 2019, now Pat. No. 11,015,890.

(Continued)

(51) Int. Cl.
*F41A 19/01* (2006.01)
*F41A 9/62* (2006.01)

(52) U.S. Cl.
CPC ..... *F41A 19/01* (2013.01); *F41A 9/62* (2013.01)

(58) Field of Classification Search
CPC ..... F41A 9/62; F41A 19/01

(Continued)

(56) References Cited

U.S. PATENT DOCUMENTS 579,943 A 3/1897 Kempshall
2,303,479 A 12/1942 Lesnick (Continued)

FOREIGN PATENT DOCUMENTS

CN 101126615 A 2/2008
CN 108534595 A 9/2018

(Continued)

OTHER PUBLICATIONS

Young, Lee, "International Search Report and Written Opinion Regarding International Application No. PCT/US2019/57460", dated Jan. 17, 2020, p. 10, Published in: US.

(Continued)

*Primary Examiner* — Joshua E Freeman
*Assistant Examiner* — Benjamin S Gomberg
(74) *Attorney, Agent, or Firm* — Neugeboren O'Dowd PC

(57) ABSTRACT

This disclosure describes systems, methods, and apparatus for detecting and displaying a number of rounds in a firearm magazine comprising a maximum number of N rounds. The magazine may comprise a follower, magnets on the follower, and <N magnetic-field-sensing sensors arranged along a path of the magnets when the follower moves along a length of the magazine, the sensors generating round count data based on a position of the one or more magnets relative to the <N magnetic-field-sensing sensors, and a first substantially flat antenna arranged on an inside of the magazine and configured to wirelessly transmit a round count indication to a second substantially flat antenna on the firearm, the round count indication based on the round count data, the second substantially flat antenna affixed to an inside of a (Continued)

magazine well of the firearm and mostly overlapping with the first substantially flat antenna.

20 Claims, 36 Drawing Sheets

Related U.S. Application Data

(60) Provisional application No. 62/748,602, filed on Oct. 22, 2018.

(58) Field of Classification Search
USPC ..... 42/1.02
See application file for complete search history.

(56) References Cited

U.S. PATENT DOCUMENTS 4,001,961 A 1/1977 Johnson et al.
5,005,307 A 4/1991 Horne et al.
5,052,138 A * 10/1991 Crain ..... F41A 9/62 42/1.02
5,142,805 A 9/1992 Horne et al.
5,303,495 A * 4/1994 Harthcock ..... F41A 17/06 42/70.11
5,406,730 A 4/1995 Sayre
5,425,299 A 6/1995 Teetzel
5,519,953 A 5/1996 Villani
5,566,486 A 10/1996 Brinkley
5,592,769 A 1/1997 Villani
5,642,581 A * 7/1997 Herold ..... F41A 9/62 42/1.02
5,735,070 A 4/1998 Vasquez et al.
5,799,432 A 9/1998 Wright et al.
5,826,360 A * 10/1998 Herold ..... F41A 9/62 42/1.02
5,918,304 A 6/1999 Gartz
6,062,208 A 5/2000 Seefeldt et al.
6,094,850 A * 8/2000 Villani ..... F41A 9/62 42/49.01
6,321,478 B1 11/2001 Klebes
6,360,468 B1 3/2002 Constant et al.
6,397,508 B1 6/2002 Constant et al.
6,412,207 B1 7/2002 Crye et al.
6,421,944 B1 7/2002 Klebes et al.
6,430,860 B1 8/2002 Constant et al.
6,493,977 B1 12/2002 Liebenberg et al.
6,643,968 B2 11/2003 Glock
6,785,996 B2 9/2004 Danner et al.
6,802,147 B2 10/2004 Haefeli et al.
6,898,890 B2 5/2005 Gaber
RE38,794 E 9/2005 Danner
6,941,693 B2 9/2005 Rice et al.
7,143,644 B2 12/2006 Johnson et al.
7,158,167 B1 1/2007 Yerazunis et al.
7,234,260 B2 6/2007 Acarreta
7,356,956 B2 4/2008 Schinazi et al.
7,509,766 B2 3/2009 Vasquez
7,661,217 B2 2/2010 Pikielny
7,669,356 B2 3/2010 Joannes et al.
7,716,863 B1 5/2010 Johnson et al.
7,730,654 B2 6/2010 Kim
7,802,391 B2 9/2010 Quinn et al.
7,810,273 B2 10/2010 Koch et al.
7,926,219 B2 4/2011 Reimer
7,927,102 B2 4/2011 Jones et al.
8,009,060 B2 8/2011 Kramer et al.
8,019,278 B2 9/2011 Baraz et al.
8,046,946 B2 11/2011 Packer et al.
8,166,698 B2 5/2012 Raviv et al.
8,176,667 B2 5/2012 Kamal et al.
8,186,086 B2 5/2012 Gur-Ari et al.
8,191,297 B2 * 6/2012 Gwillim, Jr. ..... F41A 9/65 42/50
8,196,331 B2 6/2012 Chen et al.
8,215,044 B2 * 7/2012 Arbouw ..... F41A 9/62 42/1.03
8,223,019 B2 7/2012 August et al.
8,290,747 B2 10/2012 Hamel et al.
8,325,041 B2 12/2012 August et al.
8,339,257 B2 12/2012 Cazanas et al.
8,387,295 B2 3/2013 Glock
8,418,388 B2 * 4/2013 Ferrarini ..... F41A 19/01 42/1.03
8,459,552 B2 6/2013 Arbouw
8,464,451 B2 6/2013 McRae
8,464,452 B2 6/2013 Harper
8,485,085 B2 7/2013 Goree et al.
8,528,244 B2 9/2013 Scallie et al.
8,571,815 B2 10/2013 Bar-David et al.
8,601,733 B2 * 12/2013 Gabay ..... F41A 9/62 42/1.02
8,656,820 B1 2/2014 Kertis, Jr. et al.
8,660,491 B1 2/2014 Tran
8,720,092 B2 5/2014 Gussalli Beretta et al.
8,733,006 B2 5/2014 Williams et al.
8,733,007 B2 5/2014 Hatfield
8,738,330 B1 5/2014 DiMartino et al.
8,770,978 B2 7/2014 Botten
8,793,294 B2 7/2014 Steele, Jr.
8,826,575 B2 9/2014 Ufer et al.
8,827,706 B2 9/2014 Hogan, Jr.
8,850,730 B2 10/2014 Clark et al.
8,875,433 B2 11/2014 Beckman
8,936,193 B2 1/2015 McHale et al.
8,973,294 B2 3/2015 Delgado Acarreta
8,991,084 B2 3/2015 Williams
9,068,785 B2 6/2015 Ball
9,212,857 B2 12/2015 Loreman
9,273,918 B2 3/2016 Amit et al.
9,293,927 B2 3/2016 Soar
9,303,937 B2 * 4/2016 Acarreta ..... F41A 9/62
9,316,461 B1 4/2016 Gwillim, Jr.
9,331,495 B2 5/2016 Soar
9,335,109 B2 5/2016 Bensayan et al.
9,397,726 B2 7/2016 Dobyns
9,435,594 B2 9/2016 Davison et al.
9,435,598 B2 9/2016 Seckman
9,472,971 B2 10/2016 Soar
9,530,555 B2 12/2016 Teggatz et al.
9,557,130 B2 1/2017 Shneorson et al.
9,612,068 B2 * 4/2017 Burden ..... F41G 1/345
9,658,012 B2 5/2017 Stewart et al.
9,677,852 B2 6/2017 Tikochinski
9,759,505 B2 9/2017 Al Abdouli et al.
9,784,511 B2 * 10/2017 Faughn ..... F41A 9/62
9,784,513 B2 10/2017 Zimmer
9,797,667 B2 10/2017 Demierre et al.
9,811,079 B2 11/2017 Theiss
9,835,395 B2 12/2017 Ruby et al.
9,857,131 B1 1/2018 Rose
9,866,039 B2 1/2018 Adolf et al.
10,175,016 B2 1/2019 Keys
10,197,349 B2 2/2019 Delgado Acarreta et al.
10,317,160 B2 6/2019 Righi et al.
10,323,894 B2 * 6/2019 Imbriano ..... F41A 9/62
10,359,246 B2 * 7/2019 Faughn ..... F41A 9/62
10,459,678 B2 10/2019 Sarno
10,557,676 B2 * 2/2020 Masarik ..... G01D 5/12
10,584,929 B2 3/2020 Masarik et al.
10,619,958 B2 4/2020 Masarik et al.
10,845,142 B2 * 11/2020 Flood ..... F41A 9/62
11,015,890 B2 5/2021 Czarnecki et al.
11,519,692 B2 * 12/2022 Thomele ..... F41G 1/065
2003/0195046 A1 * 10/2003 Bartsch ..... F41A 33/02 463/36
2006/0042142 A1 3/2006 Sinha
2007/0000483 A1 1/2007 Tsurumoto
2008/0028660 A1 2/2008 Gussalli Beretta
2008/0127538 A1 6/2008 Barrett
2008/0131848 A1 6/2008 Wilson et al.
2008/0276517 A1 * 11/2008 Delgado Acarreta ..... F41A 9/62 42/1.02
2009/0084015 A1 4/2009 Compton et al.

(56) References Cited

U.S. PATENT DOCUMENTS

| | | | | |
|---|---|---|---|---|
| 2009/0255160 | A1 | 10/2009 | Summers | |
| 2010/0031808 | A1 | 2/2010 | Whitlow et al. | |
| 2010/0258101 | A1 | 10/2010 | Campo et al. | |
| 2010/0281725 | A1 | 11/2010 | Arbouw | |
| 2010/0299985 | A1 | 12/2010 | Delgado Acarreta | |
| 2011/0078936 | A1 | 4/2011 | Gates | |
| 2011/0252682 | A1* | 10/2011 | Delgado Acarreta | F41A 9/62 42/1.02 |
| 2011/0308125 | A1 | 12/2011 | Gabay et al. | |
| 2012/0131828 | A1 | 5/2012 | August et al. | |
| 2012/0152103 | A1 | 6/2012 | Testa et al. | |
| 2012/0167423 | A1 | 7/2012 | Kindt et al. | |
| 2013/0108991 | A1 | 5/2013 | Walls | |
| 2013/0125438 | A1 | 5/2013 | Delgado Acarreta | |
| 2013/0180143 | A1 | 7/2013 | Delgado Acarreta | |
| 2013/0219762 | A1 | 8/2013 | Delgado Acarreta | |
| 2014/0311003 | A1* | 10/2014 | Loreman | F41A 9/62 42/1.02 |
| 2015/0075047 | A1 | 3/2015 | August et al. | |
| 2015/0267981 | A1 | 9/2015 | Faughn | |
| 2015/0369553 | A1 | 12/2015 | Stussak | |
| 2015/0369559 | A1 | 12/2015 | Del Rosario | |
| 2015/0377572 | A1 | 12/2015 | Darragjati | |
| 2016/0069629 | A1 | 3/2016 | Seckman | |
| 2016/0169602 | A1 | 6/2016 | Demierre et al. | |
| 2016/0169608 | A1 | 6/2016 | Schulz et al. | |
| 2016/0172876 | A1 | 6/2016 | Stewart et al. | |
| 2016/0195351 | A1 | 7/2016 | Burden | |
| 2016/0305740 | A1 | 10/2016 | O'Donnell et al. | |
| 2016/0334177 | A1 | 11/2016 | Green | |
| 2017/0051993 | A1 | 2/2017 | Imbriano et al. | |
| 2017/0155269 | A1 | 6/2017 | Swift | |
| 2017/0176139 | A1 | 6/2017 | Zhang et al. | |
| 2017/0227310 | A1 | 8/2017 | Gorza et al. | |
| 2017/0336160 | A1* | 11/2017 | Walther | F41A 9/62 |
| 2018/0128563 | A1* | 5/2018 | Righi | F41A 9/62 |
| 2018/0172377 | A1 | 6/2018 | Keys | |
| 2018/0196628 | A1 | 7/2018 | Samo | |
| 2018/0299217 | A1* | 10/2018 | Hedeen | F41A 9/62 |
| 2019/0170463 | A1 | 6/2019 | Walther et al. | |
| 2020/0355450 | A1 | 11/2020 | Masarik et al. | |
| 2021/0010769 | A1 | 1/2021 | Czarnecki et al. | |
| 2021/0215446 | A1 | 7/2021 | Czarnecki et al. | |

FOREIGN PATENT DOCUMENTS

| | | | |
|---|---|---|---|
| DE | 3911804 | C2 | 7/1993 |
| DE | 4022038 | C2 | 3/1999 |
| DE | 102010054245 | A1 | 6/2012 |
| GB | 2182424 | A | 5/1997 |
| GB | 2397128 | A | 7/2004 |
| GB | 2528472 | A | 1/2016 |
| GB | 2560744 | A | 9/2018 |
| JP | H1089894 | A | 4/1998 |
| JP | 2002277193 | A | 9/2002 |
| JP | 2008064406 | A | 3/2008 |
| JP | 2008175526 | A | 7/2008 |
| JP | 4298615 | B2 | 7/2009 |
| JP | 4395357 | B2 | 1/2010 |
| JP | 4594334 | B2 | 12/2010 |
| JP | 4923749 | B2 | 4/2012 |
| JP | 4923750 | B2 | 4/2012 |
| JP | 4996963 | B2 | 8/2012 |
| JP | 2012215373 | A | 11/2012 |
| JP | 2013130373 | A | 7/2013 |
| KR | 100914270 | B1 | 8/2009 |
| KR | 20110035058 | A | 4/2011 |
| KR | 20140046853 | A | 4/2014 |
| RU | 2360208 | C2 | 6/2009 |
| TW | 201700945 | A | 1/2017 |
| WO | 2009151713 | A3 | 12/2009 |
| WO | 2013104807 | A1 | 7/2013 |
| WO | 2014184875 | A1 | 11/2014 |
| WO | 2016181234 | A1 | 11/2016 |
| WO | 2016181235 | A1 | 11/2016 |
| WO | 2016187713 | A1 | 12/2016 |
| WO | 2017/001054 | A1 | 1/2017 |
| WO | 2017031426 | A1 | 2/2017 |
| WO | 2019/173791 | A1 | 9/2019 |
| WO | 2020/086598 | A1 | 4/2020 |

OTHER PUBLICATIONS

Griffinmods, "Review: Aliens Ammo Counter! From Blasterparts—AKA the Most Awesome Accessory Ever!", Nov. 23, 2013, p. 2, Publisher: Retrieved from https://www.youtube.com/watch?v=N7U3xAo6obE on May 22, 2020.

Rade Technologias S.L., "Ammocontrol Digital Counter", "Known to exist as early as Dec. 29, 2020", p. 1, Publisher: Retrieved from https://web.archive.org/web/20141229064416/http://www.radetec.com:80/index.php?id=40 on May 25, 2020.

Rade Technologias S.L., "Ammocontrol Digital Counter For 1911", 2013, p. 1, Publisher: Retrieved from https://www.radetec.com/portfolio-item/20-video-ammocontrol-digital-counter-for-1911-assembly/downloaded on May 25, 2020.

Semiconductor Componens Industries, "AND9209/D Chameleon Technology Enables Low-Cost Battery Free Wireless Sensors", Apr. 2016, p. 4, No. Rev. 3, Publisher: Semiconductor Components Industries, LLC.

Zur et al., "Application of Mechanical Springs as Inductive Position Sensors", "AMA Conferences 2013", 2013, p. 3, Publisher: Retrieved from https://www.ama-science.org/proceedings/getFile/ZGH5AN==.

Garcia-Diego et al., "Array of Hall Effect Sensors for Linear Positioning of a Magnet Independently of Its Strength Variation. A Case Study: Monitoring Milk Yield During Milking in Goats", "Sensors", 2013, pp. 8000-8012, vol. 2013, No. 13, Publisher: Retrieved from http://www.mdpi.com:8080/1424-8220/13/6/8000/pdf.

Michael Ciuffo, "Bullet Counter 2.0", Mar. 24, 2011, p. 2, Publisher: retrieved from https://www.youtube.com/watch?v=cnx9yT5py8E on May 25, 2020.

Clevertec, "Introducing Clevertec", "Known to exist as early as May 20, 2020", p. 6, Publisher: Retrieved from https://www.cleverteckip.com.

Cobalt Kinetics, "Aliens Meets Cobalt Kinetics, Shot 2017, CK Smart Display—TFB", Known to exist as early as May 8, 2020, p. 4, Publisher: Retrieved from https://www.cobaltkinetics.com/tag/ammo-round-counter.

Farsens, "Battery Free RFID Sensors", Known to exist as early as May 8, 2020, p. 8, Publisher: Retrieved from www.farsens.com/en/products/battery-free-rfid-sensors/.

Browne, Jack, "Harvesting Energy From RF Sources", Dec. 30, 2016, p. 2, Publisher: Retrieved from https://www.mwrf.com/home/whitepaper/21847914/harvesting-energy-from-rf-sources-pdf-download.

Lage Manufacturing, LLC, "Lage Manufacturing Max 41A Real Aliens Pulse Rifle", Jan. 26, 2014, p. 2, Publisher: Retrieved from https://www.youtube.com/watch?v=XT90YzPlhVE on May 25, 2020.

Evanczuk, Stephen, "Low-Frequency RFIC Solutions for Tire-Pressure-Monitoring Systems", Mar. 29, 2012, p. 7, Publisher: Retrieved from https://www.digikey.com/en/articles/low-frequency-rfic-solutions-for-tire-pressure-monitoring-systems.

Magcount LLC, "Magcount Ammunition Counting Technology Demonstration", Oct. 13, 2010, p. 2, Publisher: Retrieved from https://www.youtube.com/watch?v=6YWYs0bvt6Q on May 25, 2020.

Meprolight USA, "Mepro Foresight", Known to exist as early as May 8, 2020, p. 3, Publisher: Retrieved from https://www.digikey.com/en/articles/low-frequency-rfic-solutions-for-tire-pressure-monitoring-systems.

Tactical Life, "Meprolight Foresight Optic Will Soon Feature On-Screen Shot Counter", Dec. 3, 2019, p. 3, Publisher: Retrieved from https://www.tactical-life.com/gear/optics/meprolight-foresight-app/.

D4RK354B3R, "Full-Auto Nerf Rayven", Apr. 22, 2013, p. 2, Publisher: Retrieved from https://www.youtube.com/watch?v=44IWL_NJOQ8 on May 25, 2020.

(56) References Cited

OTHER PUBLICATIONS

Alanson Sample, "NFC-WISP: A Wirelessly Powered Bistable Display Tag", Known to exist as early as May 8, 2020, p. 3, Publisher: Retrieved from www.alansonsample.com/research/NFC-WISP.html.
Sarah Clark, "NFC Goes Green: New ST Chips Use Energy Harvesting To", Nov. 8, 2011, p. 4, Publisher: Retrieved from https://www.nfcw.com/2011/11/08/311126/nfc-goes-green-new-st-chips-use-energy-harvesting-to-replace-the-need-for-batteries/.
Radetec, "Risc", Known to exist as early as May 8, 2020, p. 8, Publisher: Retrieved from https://www.radetecusa.com/risc/.
ShotPM, "Weapon Shot Counter (WSC) for Preventative Maintenance and Inventory Management Using Radio-Requency Identification (RFID) Active Technology", Known to exist as early as May 8, 2020, p. 4, Publisher: Retrieved from https://www.shotpm.com.
Radetec, "Smart Slide", Known to exist as early as May 8, 2020, p. 8, Publisher: Retrieved from https://www.radetecusa.com/smart-slide/.
www.st.com, "ST25DV-Discovery", Known to exist as early as May 8, 2020, p. 5, Publisher: Retrieved from https://www.st.com/content/st_com/en/products/evaluation-tools/product-evaluation-tools/st25-nfc-rfid-eval-tools/st25-nfc-rfid-eval-boa.
Lourens et al., "Tire Pressure Monitoring (TPM) System", 2009, p. 12, Publisher: Microchip Technology Inc, Published in: US.
Zhang et al., "A Review of Passive RFID TAG Antenna-Based Sensors and Systems for Structural Health Monitoring Applications", "Sensors", Jan. 29, 2017, p. 33, vol. 2017, No. 17.
Frenzel, Louis E. "A Dozen Top Applications For Mesh Networks", retrieved from Internet <https://www.electronicdesign.com/markets/energy/article/21750433/a-dozen-top-applications-for-mesh-networks>, 13 pages, Sep. 14, 2005.
International Preliminary Report on Patentability Chapter I received for International PCT Application Serial No. PCT/US2019/057460 dated May 6, 2021, 9 pages.
Kasemsadeh, Ben "Inductive Sensing: How to Sense Spring Compression", retrieved from Internet <https://e2e.ti.com/blogs_/b/analogwire/archive/2015/07/13/inductive-sensing-how-to-sense-spring-compression>, 2 pages, Jul. 13, 2015.
Notice of Allowance received for U.S. Appl. No. 16/635,692 dated Feb. 17, 2021, 70 pages.
Office Action received for Taiwanese Patent Application Serial No. 110102748 dated Jun. 20, 2022, 12 pages.
Requirement for Restriction received for U.S. Appl. No. 16/635,692 dated Nov. 19, 2020, 17 pages.

* cited by examiner

DETERMINATION OF ROUND COUNT BY HALL SWITCH ENCODING

CROSS REFERENCE TO RELATED APPLICATIONS

The present application for patent is a continuation-in-part of U.S. patent application Ser. No. 16/635,692 filed Jan. 31, 2020 and entitled DETERMINATION OF ROUND COUNT BY HALL SWITCH ENCODING, which is a 371 of international application PCT/US2019/057460 filed Oct. 22, 2019 and entitled DETERMINATION OF ROUND COUNT BY HALL SWITCH ENCODING, which claims priority to Provisional Application No. 62/748,602 entitled "DETERMINATION OF ROUND COUNT BY HALL SWITCH ENCODING" filed Oct. 22, 2018, and assigned to the assignee hereof and hereby expressly incorporated by reference herein.

FIELD OF THE DISCLOSURE

The present disclosure relates generally to firearms round/ammunition counting. In particular, but not by way of limitation, the present disclosure relates to systems, methods and apparatuses for wirelessly counting a number of rounds remaining in a magazine.

DESCRIPTION OF RELATED ART

U.S. Pat. No. 9,612,068 discloses a magnet (180) that can be coupled to the spring supporting a magazine follower along with a signaling element (145) coupled to the magazine or another portion of the firearm and configured to detect a proximity of the magnet (180). For instance, the signaling element (145) can include a reed switch or Hall effect sensor. The proximity of the magnet (180) is converted by the signaling element (145) to a signal indicative of the ammunition status of the firearm (105). The signaling element (145) can then send a wired or wireless signal to a reporting element (130, 135) to display a remaining round count to the firearm user. There are no sensors within the magazine.

U.S. Pat. No. 9,784,511 discloses a magnet (33) on the follower (38) or compression spring (34) that causes physical displacement of tactile indicators (44) on an outside of the magazine to thereby provide a tactile indication of the follower position within the magazine.

U.S. Pat. No. 8,215,044 discloses a gray encoded ferromagnetic strip arranged along the magazine to indicate a location of the follower and thus round count of a magazine.

Great Britain application No. WO2018172738 discloses a round-counting device for monitoring the number of ammunition rounds contained in a firearm magazine. The system includes a magnet mounted to the follower and a plurality of reed switches arranged in a spaced apart arrangement along a length of the magazine. When the follower is in a given position, adjacent reed switches are activated, and provide a signal indicative of the number of rounds in the magazine.

U.S. Pat. No. 5,303,495 discloses a handgun with a grip that fully-encloses a magazine. The firearm also includes a permanent magnet (92) mounted on a top rung of a magazine spring 93 and a series of Hall effect switches (94) that are surface mounted on a mylar substrate (95) in the hollow handle of the firearm. The number of Hall effect switches (94) is equal to the number of cartridges to be counted and the switches (94) are positioned one cartridge diameter apart at positions where the magnet (92) will be located directly adjacent to a switch 94 as each round is fired. Only one Hall effect switch (94) at a time is activated. There are no sensors in the magazine.

United States Publication No. 20110252682 discloses receptor means (41) (e.g., Hall effect sensors) in a pistol grip or magazine well of a long firearm that sense a magnetic field strength of a magnet (24) positioned on a cartridge lifter (22). In the case of the long firearm, this disclosure suggests that there is only a need to monitor the last cartridges in the magazine (21), and therefore receptor means (41) are only placed in an area adjacent to the upper part of the magazine (21) (i.e., only in the magazine well). There are no sensors in the magazine.

SUMMARY OF THE DISCLOSURE

The following presents a simplified summary relating to one or more aspects and/or embodiments disclosed herein. As such, the following summary should not be considered an extensive overview relating to all contemplated aspects and/or embodiments, nor should the following summary be regarded to identify key or critical elements relating to all contemplated aspects and/or embodiments or to delineate the scope associated with any particular aspect and/or embodiment. Accordingly, the following summary has the sole purpose to present certain concepts relating to one or more aspects and/or embodiments relating to the mechanisms disclosed herein in a simplified form to precede the detailed description presented below.

Some embodiments of the disclosure may be characterized as a round counting system for a firearm with a detachable magazine, the system comprising: a magazine comprising at least a follower, the follower comprising one or more magnets, and the magazine comprising: <N magnetic-field-sensing sensors arranged substantially along a path of the one or more magnets when the follower moves along a length of the magazine, where N is a maximum number of cartridges that can be loaded in the magazine, the sensors generating round count data based on a position of the one or more magnets relative to the <N magnetic-field-sensing sensors; and a first substantially flat antenna on an inside of the magazine arranged at in a region of the magazine that is configured to fit at least partially within a magazine well of the firearm, the wireless antenna configured to wirelessly transmit a round count indication from the magazine to a substantially flat second wireless antenna on the firearm; and the substantially flat second antenna configured to be affixed to an inside of a magazine well of the firearm and having an area that mostly overlaps with an area of the first substantially flat antenna.

Other embodiments of the disclosure may also be characterized as a round counting system for a firearm with a detachable magazine, the system comprising: a magazine comprising a follower, the follower comprising one or more magnets, and the magazine comprising: Hall effect switches arranged substantially along a path of the one or more magnets, where N is a maximum number of cartridges that can be loaded in the magazine, the Hall effect switches each generating a high or low signal based on a position of the one or more magnets relative to each of the Hall effect switches; and a magazine processor coupled to each of the Hall effect switches and configured to convert the high or low signal from each of the Hall effect switches into a single round count indication for the magazine; a magazine antenna on an inside of the magazine arranged in a region of the magazine that is configured to fit at least partially within a magazine well of the firearm, the magazine antenna configured to wirelessly transmit the round count indication from the magazine to a magazine well antenna on the firearm; and the magazine well antenna configured to be affixed to an inside of a magazine well of the firearm and having an area, a majority of which, overlaps with an area of the magazine antenna.

Other embodiments of the disclosure can be characterized as a method of manufacturing a magazine with a round counting system, the magazine comprising a follower, wherein the follower comprises one or more magnets, the method comprising arranging <N magnetic-field-sensing sensors substantially along a path of the one or more magnets when the follower moves along a length of the magazine, where N is a maximum number of cartridges that can be loaded in the magazine, the sensors generating round count data based on a position of the one or more magnets relative to the <N magnetic-field-sensing sensors; and arranging a first substantially flat antenna on an inside of the magazine in a region of the magazine that is configured to fit at least partially within a magazine well of the firearm, the first substantially flat antenna configured to wirelessly transmit a round count indication from the magazine to a substantially flat second wireless antenna on the firearm, the round count indication based on the round count data, wherein the first substantially flat antenna is arranged such that an area of the first substantially flat antenna, defined by a height and width, primarily aligns with an area of a second substantially flat antenna coupled to an inside of a magazine well of the firearm.

Other embodiments of the disclosure can be characterized as a method of installing a round counting system on a firearm, the method comprising installing a detachable magazine comprising a follower, the follower comprising one or more magnets, and the magazine comprising: <N magnetic-field-sensing sensors arranged substantially along a path of the one or more magnets when the follower moves along a length of the magazine, where N is a maximum number of cartridges that can be loaded in the magazine, the sensors generating round count data based on a position of the one or more magnets relative to the <N magnetic-field-sensing sensors; and a first substantially flat antenna on an inside of the magazine arranged in a region of the magazine that is configured to fit at least partially within a magazine well of the firearm; and installing a second substantially flat antenna on an inside of a magazine well of the firearm such that an area of the first substantially flat antenna and an area of the second substantially flat antenna are mostly aligned, the first and second substantially flat antennas configured to exchange a round count indication based on the round count data as well as power via a near-field-communication connection.

Other embodiments of the disclosure can be characterized as a non-transitory, tangible computer readable storage medium, encoded with processor readable instructions to perform a method for detecting and displaying a number of cartridges remaining in a firearm magazine, the firearm magazine comprising a follower, and the follower comprising one or more magnets, the method comprising: arranging <N magnetic-field-sensing sensors substantially along a path of the one or more magnets when the follower moves along a length of the firearm magazine, where N is a maximum number of cartridges that can be loaded in the firearm magazine, the sensors generating round count data based on a position of the one or more magnets relative to the <N magnetic-field-sensing sensors; arranging a first substantially flat antenna on an inside of the firearm magazine in a region of the magazine that is configured to fit at least partially within a magazine well of the firearm, the first substantially flat antenna configured to exchange a round count indication based on the round count data as well as power via a near-field communication connection with a second substantially flat antenna coupled to an inside of a magazine well of the firearm, wherein the first substantially flat antenna is arranged such that an area of the first substantially flat antenna, defined by a height and width, primarily aligns with an area of the second substantially flat antenna coupled to the inside of the magazine well of the firearm.

BRIEF DESCRIPTION OF THE DRAWINGS

Various objects and advantages and a more complete understanding of the present disclosure are apparent and more readily appreciated by referring to the following detailed description and to the appended claims when taken in conjunction with the accompanying drawings:

FIG. 10 also illustrates placement of the battery in the pistol grip of the firearm, according to an alternate embodiment of the disclosure.

DETAILED DESCRIPTION

Figure 1:
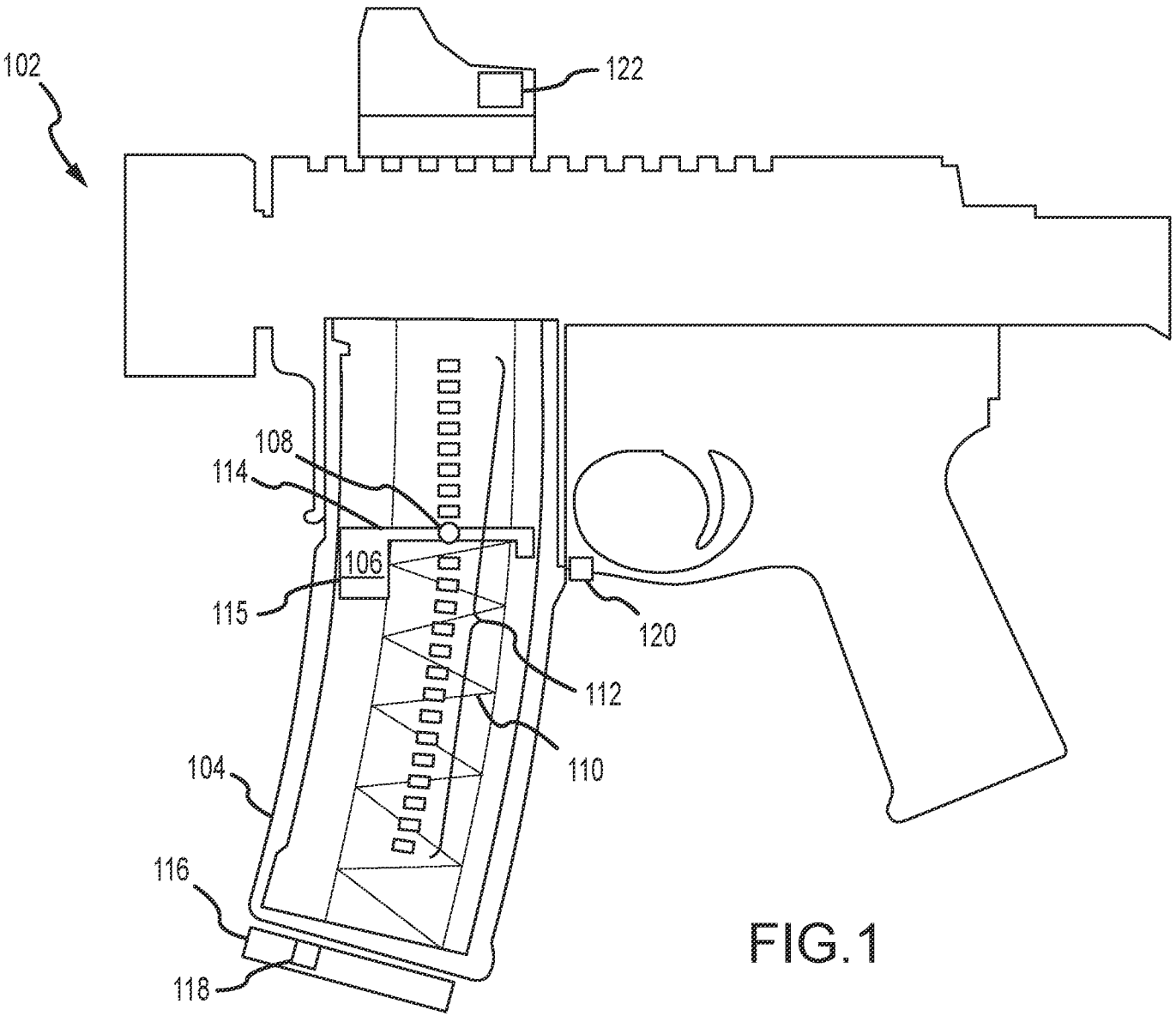
FIG. 1 is a side view of a firearm receiver and a detachable magazine, illustrating an embodiment of a magnetic sensor-based round counting system.

Despite the industry working to solve the round counting problem for decades (this application references early round counting systems dating to as early as 1992), no solution thus far has overcome all the challenges that the inventors identified. For instance, RADETEC (Rade Tecnologias) has developed two primary lines of round counters: one that is part of a pistol grip and uses a magnet on the follower and magnetic field sensors in the pistol grip to estimate distance of the magnet from those sensors and thereby estimate a position of the follower and hence a number of rounds in the magazine; the second is directed to long gun platforms, such as the AR-15, and this system again uses a magnet on the follower, but a magnetic field sensor in the magazine well or receiver to detect a distance between the magnet and the sensors. Both systems rely on analog magnetic field sensors that are prone to low signal to noise ratios and thus erroneous readings. They also both require "long distance" magnetic field sensing. Magnetic field strength drops off exponentially with distance (e.g., $r^2$) and thus even small increases in distance have a profound influence on field strength. By locating the magnet inside the magazine, and the sensors outside the magazine, either in the pistol grip or in the receiver, the magnetic field is greatly diminished by the time it reaches the sensors. Additionally, in the case of the long gun version, since sensors are only arranged on the magazine well or receiver, the magnet is even further away for fully-loaded and near-fully-loaded magazines. What is more, layers of material (e.g., metal) between the magnet and the sensors can further interfere with and degrade the magnetic field detected at the sensors, and often the thickness of this material is not consistent along a length of the magazine. For instance, in the long gun version, the magazine well does not extend down the entire length of the magazine, meaning that different materials and thicknesses of material are interposed between the magnet and the sensor(s) for different follower positions. All of these factors lead to a system that suffers from high and varying signal to noise ratios and ultimately to inaccurate round counts. From an ease-of-use standpoint, the Radetec technology also requires the user to calibrate the system before use, and such calibration is undesirable.

The inventors overcame the problems that have faced the industry unresolved for over thirty years via a combination of some or all of the following: (1) use of Hall effect switches rather than Hall effect sensors; (2) arranging Hall effect switches along a full length of the follower path so that there is consistent signal strength and consistently high signal-to-noise for each cartridge position; (3) arranging magnetic sensors within the magazine where they are close to the magnet on the follower thereby maximizing magnetic field strength at the sensors; (4) arranging a flat NFC antenna within the magazine well; (5) arranging a processor within the magazine to process sensor signals before transmission across the wireless connection; and (6) energy harvesting from a power source on the firearm through the NFC connection.

(1) Hall Effect Switches

Most systems rely on Hall effect sensors rather than Hall effect switches to detect a magnet in a follower since these more advanced sensors can better determine a position of a magnet when used singularly (e.g., a Hall effect sensor provides an analogue signal proportional to magnetic field strength and hence to distance, whereas a single Hall effect switch provides either a high or low signal as a function of a threshold magnetic field). For the purposes of this disclosure, a "Hall switch" is one providing a digital or at least pulsed or square wave output, as compared to a fluctuating or sinusoidal analogue output. However, Hall effect sensors are susceptible to many of the variables noted above relative to the Radetec platform, and because of these systems using Hall effect sensors often require user calibration. Hall effect sensors may also require an analogue to digital converter (ADC). The inventors unexpectedly found that the simpler Hall effect switch, when used in an array having <N switches (or N/2) (N=maximum number of cartridges in the magazine), avoids the need for an ADC and calibration and can provide more accurate follower position than an array of Hall effect sensors equal to the number of cartridge positions in the magazine.

To implement a Hall effect switch array where the number of switches is <N, a processor may be used to assess the signals from the array and looks for two scenarios: (1) where only a single Hall effect switch is active, the follower is likely closely aligned with that Hall effect switch; and (2) where two Hall effect switches are active, the follower is likely roughly between the two switches. Using these two scenarios, the processor can distinguish between each and every cartridge position, even though <N or N/2 or N/3 or N/4 Hall effect switches are used. Reducing the number of switches also decreases cost and complexity.

Another advantage of using Hall effect switches is that the processor can analyze the switch outputs and determine a number of cartridges without storing any state or other data in memory. Thus, a processor with less or no cache/memory can be implemented. Alternatively, this implementation may allow a processor with cache/memory to use less of the cache/memory for round count processing.

(2) Sensors Arranged Along a Full-Length of the Magazine

While Hall effect sensors can estimate distance to a moving magnet using a single sensor, such systems can also introduce errors since each cartridge position must be associated with a unique magnetic field strength. By positioning magnetic-field-sensing sensors along a full length of the magazine, the sensors can be arranged such that each cartridge position can be associated with a consistent magnetic field strength, thereby greatly reducing errors. This also helps to avoid the calibration challenges seen in the prior art.

(3) Sensors within the Magazine

Most existing systems use sensors outside of the magazine as this simplifies manufacturing and design. This also avoids the challenge of having to wirelessly convey data from the magazine to the firearm. However, the inventors found that these systems are not accurate enough for practical implementation. Therefore, the inventors chose the more complex route of locating sensors within the magazine. This introduced challenges associated with getting round count data from the magazine to the firearm that have not been addressed in detail in the art. For instance, U.S. Pat. No. 9,612,068 vaguely notes that round count information can be wireless transmitted to a display, but provides no enabling details surrounding this so-called wireless embodiment. WO2018172738 also vaguely suggests that a wireless chip can be implemented, but makes no further discussion regarding details needed to implement this wireless embodiment. By taking on this challenge, the inventors achieve more consistent magnetic field strength measurements since there is little to no material between the follower's magnet and the magnetic-field-strength sensors. Also, by locating the sensors closer to the follower than the prior art, the inventors could pick up on the strongest magnetic field possible, thereby further reducing errors.

(4) Antenna within the Magazine Well

In practice, wireless communication between the magazine and the firearm is fraught with a number of challenges neither recognized nor addressed by known systems. For one, most wireless technologies are power hungry. Power requires batteries, which are heavy, and thus power-hungry wireless systems lead toward heavy firearms—something that is not conducive to in-field usage. While there are known low-power wireless protocols, such as near field communication (NFC), these protocols only operate over very short distances and often have difficulty with signals that pass through anything but air (for instance passing through components of a firearm could lead to errors in data transmission). Also, since a firearm is a high tolerance device and designed to fit into the smallest space available, there is not extraneous space to insert or arrange antennas. However, the inventors discovered that there are two unused areas of a firearm that are in close proximity, such that they don't require any metal components between them, which turned out to be an ideal location for two interoperable flat NFC antennas. Namely, in the forward part of a magazine where the magazine tapers, there is room in a polymer magazine that can be carved out to fit a flat NFC antenna without compromising the magazine's structural integrity. There is also a depression in the left side of an AR-15 magazine well that does not contact the magazine and is just deep enough (e.g., Depth: 0.0175+/−0.0075 inches (0.44+/−0.19 mm), Width: 1.77 inches (45 mm), Height: 2 inches (50.8 mm)) to fit a thin (e.g., thickness: 0.010 inches (0.25 mm), Height: 1.6 inches (40.64 mm), W: 1.050 inches (26.67 mm)) flat NFC antenna without interfering with magazine insertion and removal. In some cases, the NFC antenna may be a microstrip patch antenna fabricated on a dielectric substrate (e.g., ROGERS RT/DUROID or RO3000 or DiClad series composite/laminate, Gallium Arsenide (GaAs), GaN, epoxy, or any other composite or substrate for use in high frequency applications).

Even after the inventors discovered a solution to getting a low power wireless system into the magazine well that avoided metal interference between the antennas, this solution generated a new problem—how to provide wiring access between the antenna inside the magazine well to a display that is on the outside of the receiver. Again, the high tolerances of a firearm do not leave much if any room to run wiring between these two components. Unexpectedly, the substrate of the flat NFC antenna is flexible, and the inventors recognized that a portion of the NFC circuit board could be flexed around a bottom of the magazine well and then stuck to an outside of the magazine well (e.g., see FIGS. 14, 16, and 17) where a connection to an RF cable could be made, in this way avoiding having to drill/machine any openings in the receiver to provide a wiring path for a traditional cable.

(5) Processor within Magazine

Another challenge of placing the sensors within the magazine is minimizing the bandwidth requirements of the wireless connection. The prior art always uses a processor within or on the firearm (e.g., receiver) to process raw data signals from the one or more sensors. If this same technique were applied to the inventor's Hall effect switch approach, then upwards of thirty separate data streams would need to be wirelessly passed through the NFC connection. To avoid this burden on the NFC connection, the inventors found that placing a processor on the magazine to process the Hall effect switch signals allowed a single indication of round count to be passed across the NFC connection, thereby greatly reducing the throughput needs of the NFC connection.

(6) Wireless Power Transmission to Magazine

Reducing cost and weight means minimizing the number of batteries needed for the round counting system. Prior art systems may utilize only a single battery, but also benefit from off-magazine systems and thus do not need to provide power to the magazine. Where a magazine does require power, the prior art uses a second on-magazine battery. The inventors have realized a system with a single battery, but also capable of providing power to the magazine. Specifically, the NFC connection can unexpectedly pass both data and power allowing the magazine to upload round count data to the firearm while passing power in the opposite direction, back to the magazine.

As seen, an effective round counting system for firearms with a magazine that is insertable into a magazine well, such as an AR-15 and most semi-automatic long guns, is a complex challenge that requires more than mere design choices. A holistic approach that overcomes a vast set of challenges, was needed. Each inventive discovery often led to a new challenge to be solved, and an inventive balancing of various interests had to be discovered to arrive at a system-level solution. The industry has searched for an effective, reliable, and accurate solution to round counting for over 30 years, with little progress over that time (e.g., U.S. Pat. No. 5,303,495 used a sensor for each cartridge in 1992). Despite this decades-old challenge, no one has yet conceived of a solution as elegant, low power, light weight, accurate, and reliable as the one herein disclosed.

Alternatives

In some cases, reed switches may be a viable alternative to Hall-effect switches. Like Hall-effect switches, reed switches may be examples of electrical switches operated using an applied magnetic field. Reed switches may primarily come in two variants: always on and always off switches. An always on reed switch may disconnect or turn off under the influence of a magnetic field, whereas always off (or closed) reed switches, such as those seen in flip phones or laptops may start flowing current in a magnetic field. In some cases, an always off reed switch may be implemented in a round counting system. For instance, an always off reed switch is activated when a magnet on a follower is adjacent to the reed switch. In such cases, a magnetic processing circuit connected to a plurality of reed switches (e.g., N/2+1) lining the inside of the magazine may identify which of the reed switches has been activated, and from this determine the position of the follower (and the round count). Such an embodiment would enable a lower-power application since reed switches don't need external power.

In some circumstances, capacitive strip encoders may be utilized in a round counting system. Capacitive strip encoders may measure a change in capacitance as a measure of displacement (i.e., linear or rotational) using a high-frequency reference signal. By analyzing the change in capacitance as the follower moves through the magazine, a round count may be determined.

In one example, capacitive sensors, such as those seen in digital calipers, may line the inside of the magazine. In some cases, the follower may comprise a circuit board, and a plurality of rectangular notches (or grates) may be engraved onto a metallic strip inside the magazine. In some cases, the circuit board and the grates on the metallic strip may form a grid of capacitors. Further, as the follower moves along the inside of the magazine, the rectangular notches may align and misalign with the circuit board, causing the capacitance to change. In some cases, a processor within the magazine, or the firearm may determine a position of the follower within the magazine (and a round count) based on analyzing this varying capacitance.

In some circumstances, RFID tags may be utilized in a round counting system. For instance, a RFID tag may be placed on the follower in order to accurately determine its location within the magazine. In some examples, a RFID reader may be placed on the weapon (e.g., on the magazine well, trigger guard, or elsewhere on the receiver), and the follower's location may be determined based on a time delay of signals received from the RFID tag. In some other cases, unique RFID tags may be embedded within each round of the magazine (e.g., attached to or within each cartridge), and the magazine round counting system may determine the number of rounds expended (or remaining) based on the RFID reader scanning the rounds remaining in the magazine. Thus, the RFID reader may also be used to identify an empty state of the magazine, if no RFID tags are identified.

The word "exemplary" is used herein to mean "serving as an example, instance, or illustration." Any embodiment described herein as "exemplary" is not necessarily to be construed as preferred or advantageous over other embodiments.

Preliminary note: the flowcharts and block diagrams in the following Figures illustrate the architecture, functionality, and operation of possible implementations of systems, methods and computer program products according to various embodiments of the present invention. In this regard, some blocks in these flowcharts or block diagrams may represent a module, segment, or portion of code, which comprises one or more executable instructions for implementing the specified logical function(s). It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustrations, and combinations of blocks in the block diagrams and/or flowchart illustrations, can be implemented by special purpose hardware-based systems that perform the specified functions or acts, or combinations of special purpose hardware and computer instructions.

The following illustrations and detailed descriptions of the various embodiments will help the reader to understand and appreciate the inventive concepts noted above.

FIG. 1 is a side view of a firearm receiver and a detachable magazine, illustrating an embodiment of a magnetic sensor-based round counting system. The firearm 102 can include a magazine 104 having a follower 106, and one or more magnets 108 attached to the follower 106 or a compression spring 110. The magazine 104 can also include an array of magnetic sensors 112 (e.g., Hall effect switches). The array 112 can span an entire height of the magazine 104 or some subset thereof. For instance, if the magnet(s) 108 is arranged at a platform 114 of the follower 106, the follower may have tines 115 that prevent the follower platform 114 from reaching a bottom of the magazine 104 when the magazine 104 is fully loaded. The bottom of the array 112 can be roughly aligned with a position of the magnet(s) 108, or roughly the follower platform 114 height above a bottom of the magazine 104. The array 112 can extend to a top of the magazine 104 or some position below a top of the magazine 104.

When the one or more magnets 108 are within a threshold detection range of one or more of the magnetic sensors 112, those sensors 112 can generate a detection signal and provide this to a magnetic sensor processing circuitry 116. The processing circuitry can compare signals from the sensors 112 to ascertain a position of the follower 106 and convert this position to a number of rounds remaining (or number of rounds expended). The round count can then be passed to transmitter 118, which wirelessly transmits the round count to a wireless receiver 120 and passes the round count to a display device 122. As illustrated, the display device 122 is a digital display affixed to an exterior of a red dot scope, but this is in no way limiting. For instance the display device 122 can be arranged on the firearm (e.g., a digital display integrated within or affixed to an outside of a scope; a digital display coupled to an outside of the firearm receiver, a digital display arranged on a visible portion of the magazine 104, etc.), but may also be arranged on a user (e.g., in a display of glasses/goggles). The display device 122 can be part of a scope or iron sight, but can also be a display separate from a sights/targeting means. Although the transmitter 118 and the receiver 120 are illustrated as being separated by a few inches, in other embodiments, these can be NFC interfaces and each can be arranged within a few millimeters, for instance with the transmitter just under the magazine well, and the receiver 120 on a portion of the trigger guard closest to a bottom of the magazine well. In particular, a small (e.g., 5 mm×5 mm) receiver or transceiver (e.g., TC0502HF from PREMO) can be mounted on or within an end of the horizontal portion of the trigger guard where it meets the magazine well. Electrical communication between this receiver or transceiver and a transmitter or transceiver in the grip could be made through of on the length of the trigger guard (e.g., an electrical trace along a bottom surface of the trigger guard). The transmitter or transceiver in the grip could wirelessly communicate data to a display thereby avoiding wiring or leads snaking along a side of the firearm. Alternatively, wired communication could also be made from the receiver or transceiver on or in the end of the trigger guard to a display device. A processor or reader may be arranged in the grip to analyze raw data from the round counter in the magazine and convert that data to a displayable form for transport to the display or other devices remote from the firearm.

A typical magnetic sensor 112 begins to detect the one or more magnets 108 at a distance, and the strength of this detection increases as the one or more magnets 108 get closer to the sensor 112. So, for instance, where each sensor 112 generates a voltage proportional to the magnetic field generated by the one or more magnets 108, this voltage will increase as the one or more magnets 108 approach the sensor 112. When the voltage exceeds a threshold, the processing circuitry 116 can determine that the follower 106 is proximal to the sensor 112 whose voltage exceeds the threshold.

Each sensor 112 can include an analogue to digital converter 202 followed by a digital comparator 204 that compares the digital signal from the digital converter 202 to a reference signal 206 or threshold. Where the digital comparator 204 finds that the signal from the digital converter 202 exceeds the reference signal 206, the detection signal can be generated and passed to the magnetic sensor processing circuitry 116.

Figure 2A:
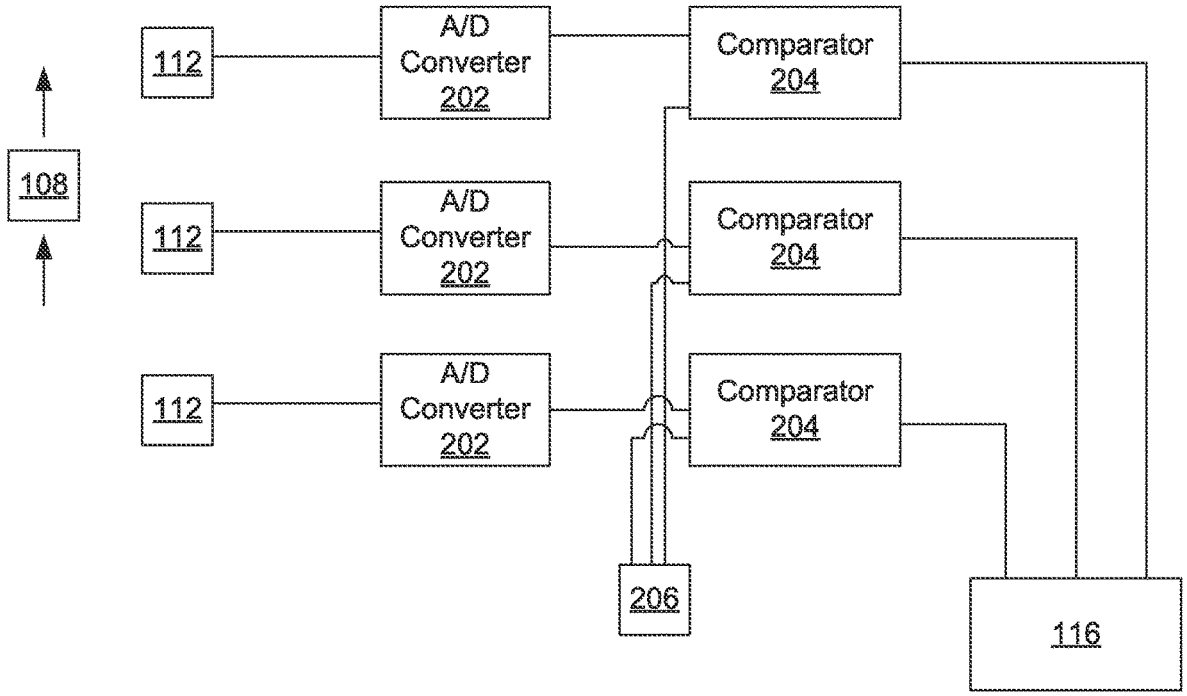
FIGS. 2A and 2B are high-level circuit diagrams of the magnetic sensor-based round counting system illustrating hall effect sensors, analog-digital-converters (ADC), comparators, and magnetic processing circuitry.
Figure 2B:
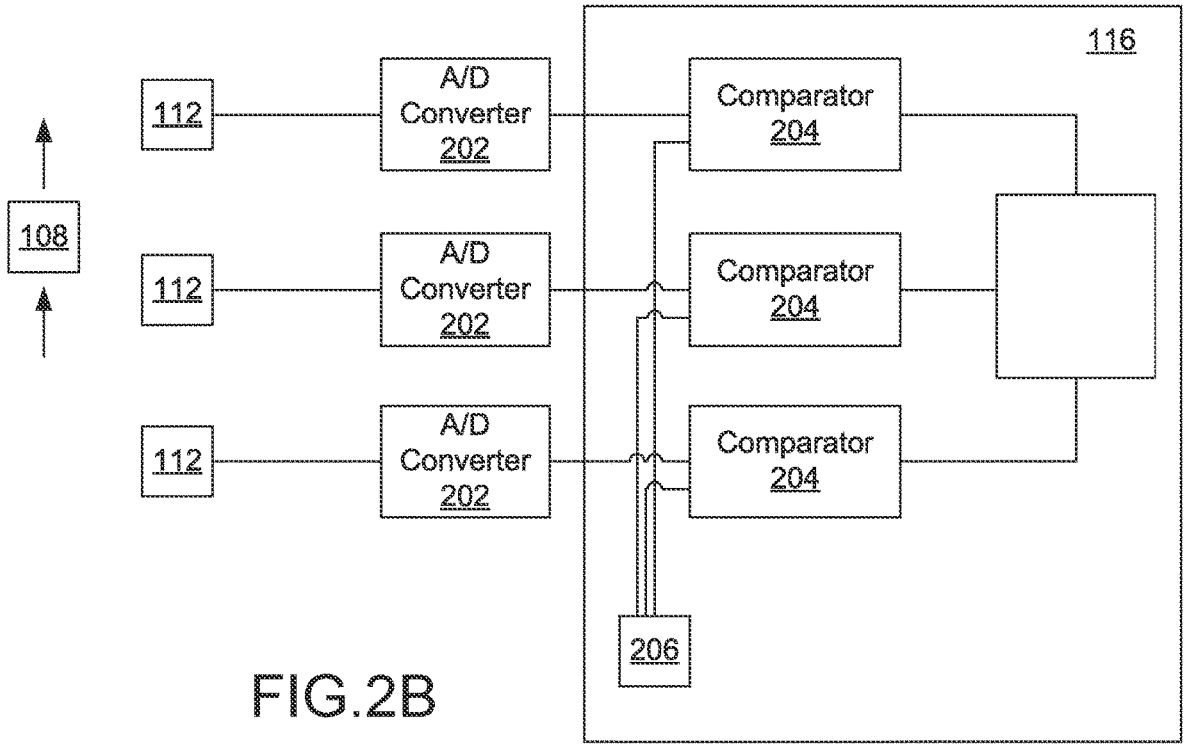

FIG. 2A shows a variation where each sensor 112 includes an analogue to digital converter 202, a reference signal 206, and a comparator 204, where the outputs of the comparators 204 are provided to the processing circuitry 116. FIG. 2B illustrates an embodiment where the outputs of each sensor 112 are converted to digital and then passed to the processing circuitry 116, and where comparators 204 of the processing circuitry 116 determine whether each signal exceeds the reference signal 206.

Figure 3A:
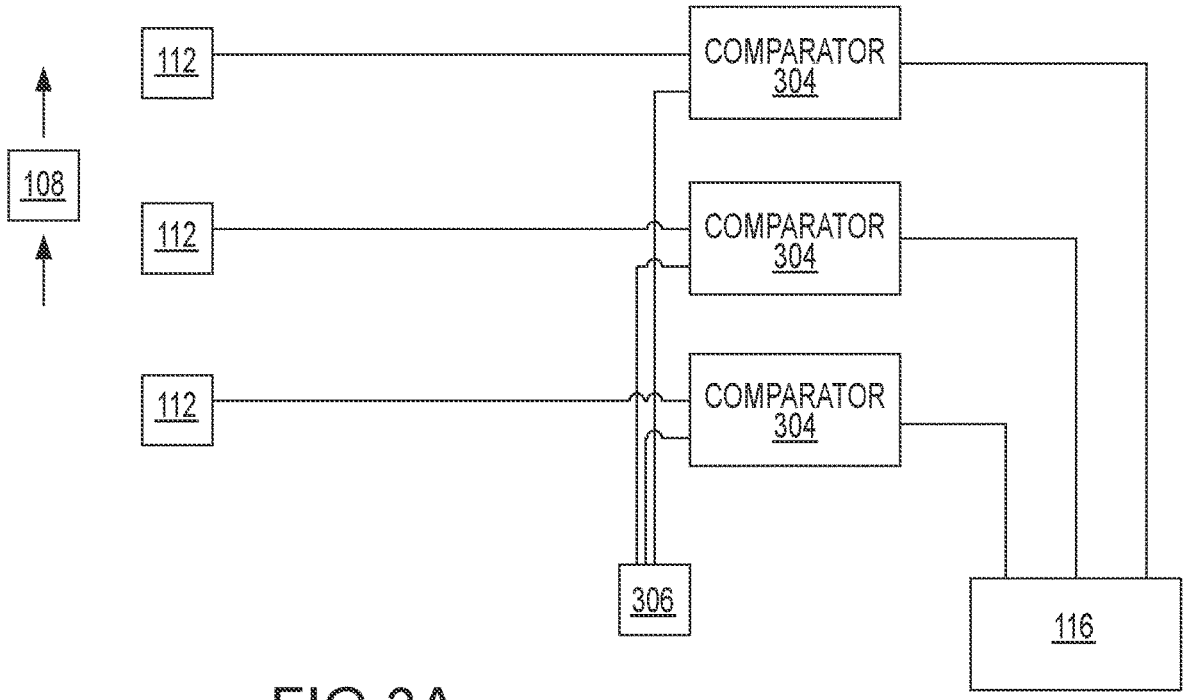
FIGS. 3A and 3B are high-level circuit diagrams of the magnetic sensor-based round counting system illustrating hall effect switches, comparators, and magnetic processing circuitry.
Figure 3B:
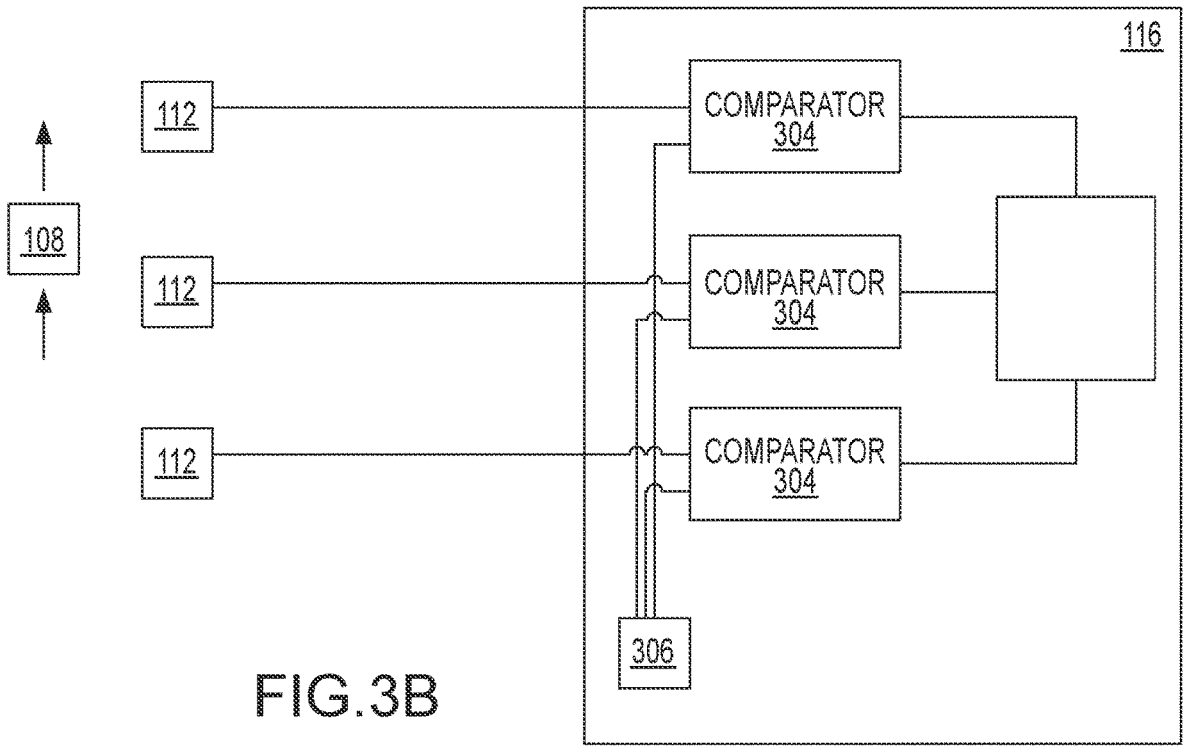

FIG. 3A shows a variation where each sensor 112 can include an analogue comparator 304 that compares the analogue output of the sensor 112 to a reference signal 306. Where the analogue comparator 304 finds that the signal from the sensor 112 exceeds the reference signal 306, the detection signal can be generated and passed to the magnetic sensor processing circuitry 116. FIG. 3B illustrates an embodiment where the outputs of each sensor 112 are passed to the processing circuitry 116, and where comparators 304 of the processing circuitry 116 determine whether each signal exceeds the reference signal 306.

In another embodiment, each sensor 112 can provide its signal in analogue or digital form (where an analogue to digital converter (ADC) is interspersed between the sensor and the magnetic sensor processing circuitry 116) to the magnetic sensor processing circuitry 116. The magnetic sensor processing circuitry 116 can then process these signals and ascertain a position of the follower 106. For instance, the magnetic sensor processing circuitry 116 may be programmed or wired to determine that a sensor 112 having the strongest signal is closest to the follower 106. The magnetic sensor processing circuitry 116 can be hardwired with data, or include data in memory, providing a position of each sensor 112.

In some examples, reference signal 206 may be a threshold with which the output value of the sensor 112 is compared to, prior to being passed to the magnetic sensor processing circuitry. In one embodiment, the threshold value may be slightly lower than an output value of the sensor(s) 112 when the magnet is roughly equidistant from two sensors. For instance, when a magnet is positioned between two adjacent sensors, and the output voltages from the sensors are 2 V and 2.1 V, respectively, the reference signal 206 may be set as <2 V (e.g., 1.95 V). In such cases, output readings from sensors that are further away may not be passed on to the processing circuitry (i.e., if <1.95 volts). In some embodiments, an operational amplifier (or op-amp) may be used as a voltage comparator. The polarity of an op-amp's output circuit depends on the polarity of the difference between the two input voltages (i.e., input voltage and reference voltage), and thus an op-amp may be used as a voltage comparator. In some examples, For instance, comparator 204 (or 304) may comprise an op-amp, where a first reference voltage (e.g., reference signal 206) is applied to an inverting input of the op-amp, and the voltage to be compared (i.e., output from sensor's 112) with the reference voltage is applied to the non-inverting input. In some examples, a resistive voltage divider (i.e., for constant reference), or a battery source, diode, or potentiometer (i.e., for variable reference) may be used to set the input reference voltage (i.e., reference signal 206 or 306) for the comparator. The output voltage of the op-amp may depend on the value of the input voltage relative to the reference voltage. For instance, if the input voltage is less than the reference voltage, the output voltage is negative; if equal to reference voltage, output voltage is zero; if greater than reference voltage, output voltage is positive. Thus, only signals exceeding the reference signal 206 (or 306) may be filtered and passed on to circuitry 116 for further processing, based on the polarity and/or magnitude of the output voltage from the comparator or op-amp.

The array 112 can include one sensor for each cartridge, where each sensor 112 is roughly arranged at a position where a cartridge will stop. However, in other embodiments, there may be one sensor 112 for every two cartridges: when a sensor 112 generates a strong signal and the two adjacent sensors 112 generate much weaker signals, then the magnetic sensor processing circuitry 116 may determine that the magnet(s) 108 is closest to the sensor 112 providing the strong signal; and when two adjacent sensors 112 provide roughly the same signal, then the magnetic sensor processing circuitry 116 may determine that the magnet(s) 108 is between those two sensors 112. This arrangement could decrease the number of sensors 112 and thus the complexity and cost of the array 112.

In an embodiment, rather than a distinct magnet(s) 108 being affixed to the follower 106, the follower 106 may be manufactured from a material that incorporates or is made from magnetic material. For instance, a polymer follower 106 having magnetic threads or particles incorporated into the polymer before molding and/or curing. In some other cases, sensors 112 may be positioned on the follower, and magnet(s) 108 may line the inside of the magazine.

Figure 4A:
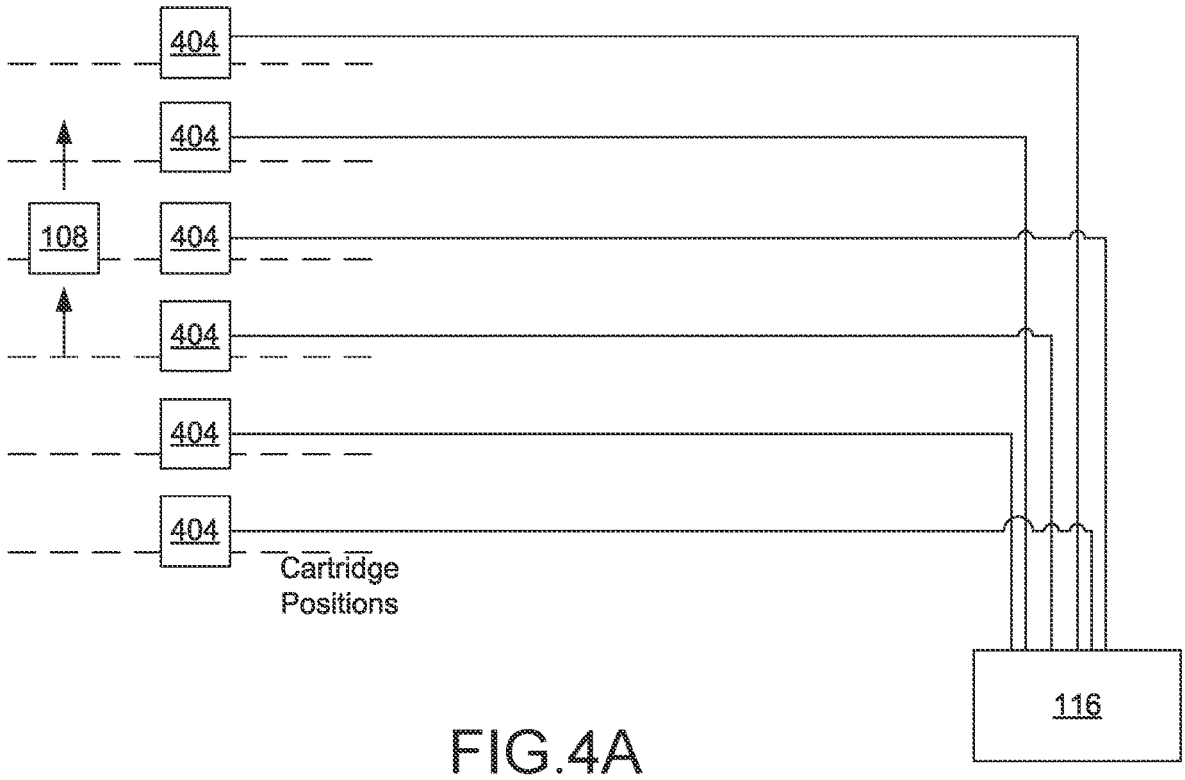
FIG. 4A illustrates a processor receiving signals from Hall effect switches, where there is one Hall effect switch for every cartridge position.

FIG. 4A illustrates a processor 116 receiving signals from Hall effect switches 404, where there is one Hall effect switch 404 for every cartridge position.

Figure 4B:
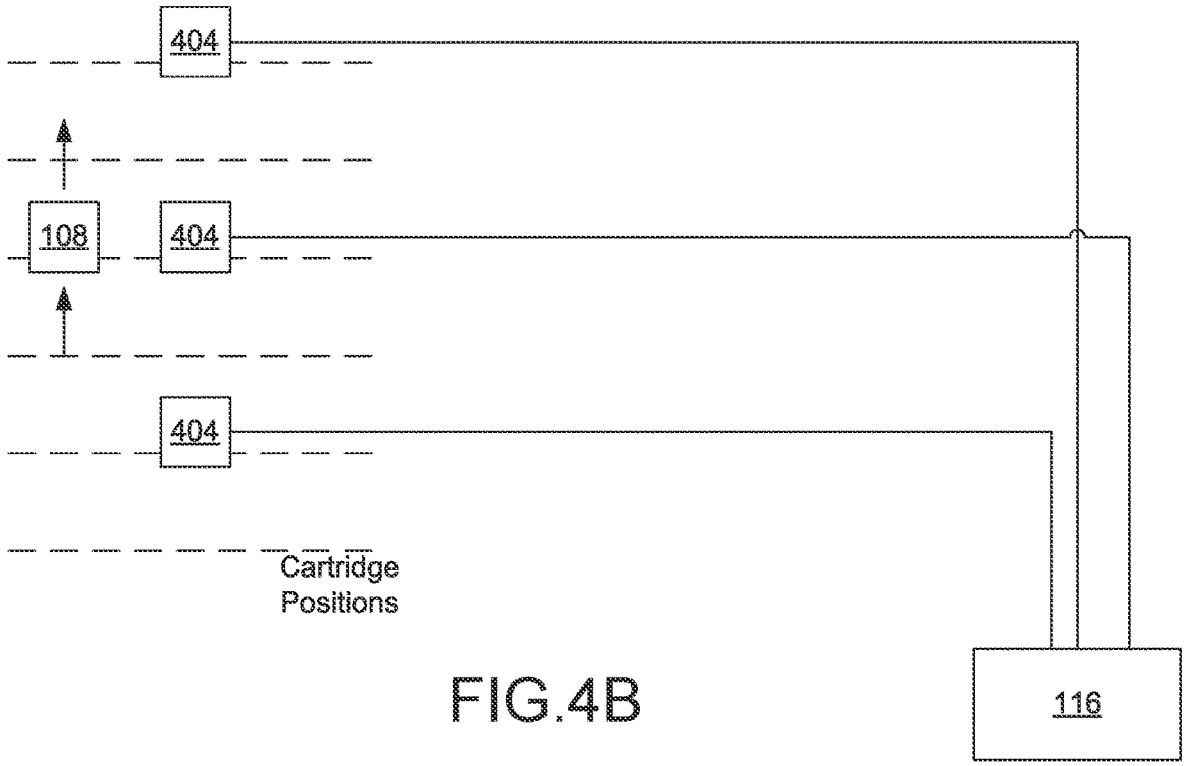
FIG. 4B illustrates a processor receiving signals from Hall effect switches, where there is one Hall effect switch for every two cartridge positions.

FIG. 4B illustrates a processor 116 receiving signals from Hall effect switches 404, where there is one Hall-effect switch 404 for every two cartridge positions and one extra Hall effect switch 404 (not shown), though the extra Hall effect switch 404 is not required. Typically, there is one more state to measure than a number of cartridges—namely the empty magazine state. For instance, for a seven-round magazine, there are seven cartridge positions, plus the empty magazine follower position. Thus, it may be desirable to have 'N+1' Hall effect switches 404, where 'N' is a number of rounds in the magazine. However, in some cases, merely using 'N' Hall effect switches 404 can also achieve the same result. For instance, where no Hall effect switch 404 is activated, the processor 116 may be encoded/programmed to determine that the follower is in the empty position. Thus, 'N' or 'N+1' Hall effect switches 404 can be implemented.

In both FIGS. 4A and 4B the dashed lines represent possible cartridge positions, although these are exemplary only, and in no way limiting. They are roughly aligned with a bottom half of each switch 404. However, in other embodiments, the cartridge positions could be aligned with a middle, top half, bottom, top, or even offset from the switches 404.

Although the magnet(s) 108 is illustrated as not quite aligned with the sensors 112 and Hall effect switches 404, in other embodiments, the magnets(s) 108 could be aligned with the sensors 112 and the Hall effect switches 404.

Figure 5:
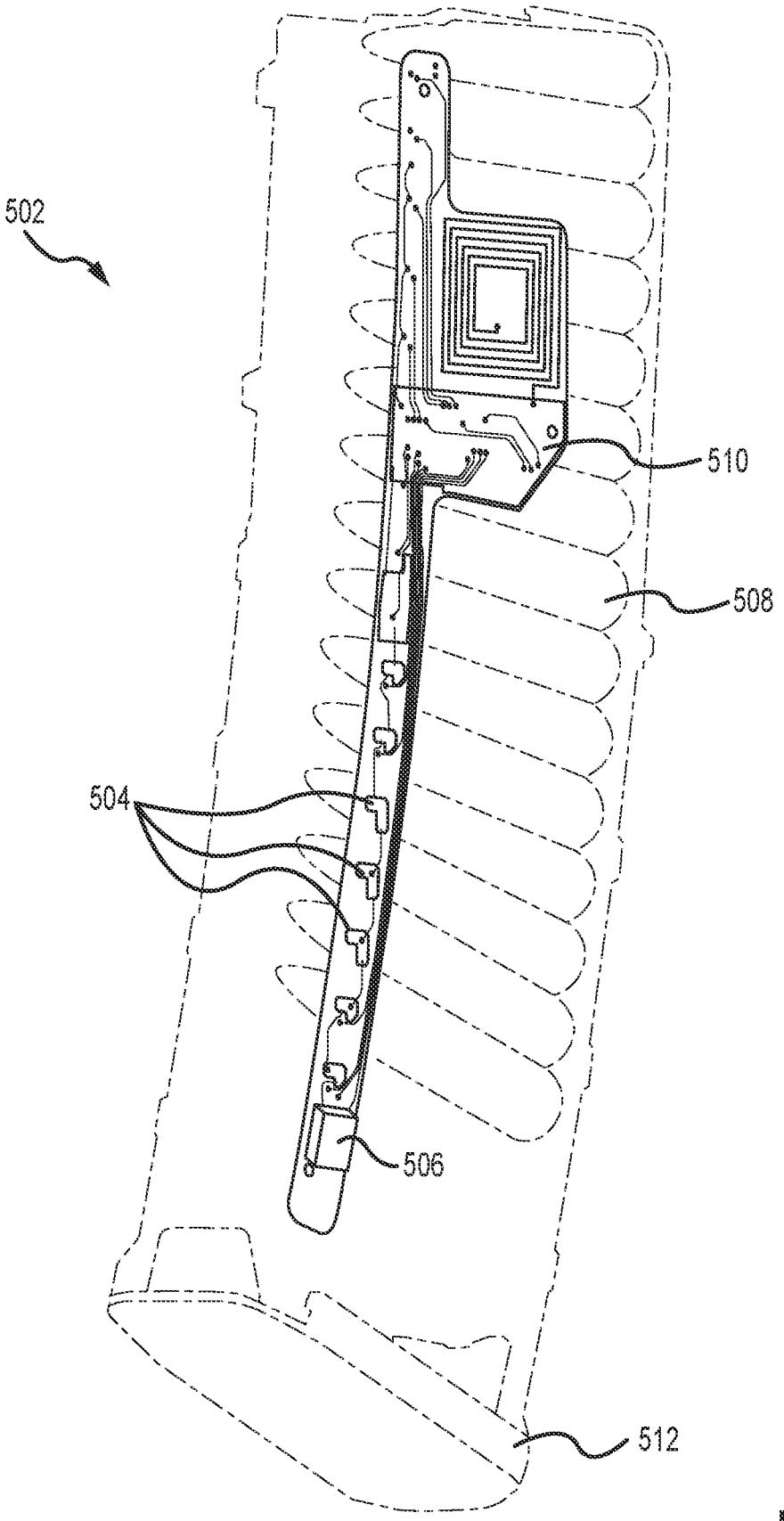
FIG. 5 is an isometric view of the detachable magazine in FIG. 1, illustrating an array of magnetic sensors, circuitry for processing signals from the sensors, cartridges, a follower, a magnet on the follower, and an NFC antenna.

FIG. 5 shows an isometric view of a magazine 502 implementing an array of magnetic sensors 504, circuitry (not visible in FIG. 5, but see e.g., 2702 in FIG. 27, such as a processor) for processing signals from the sensors 504, cartridges 508, a follower, and a magnet on the follower. The array 504 can be arranged on an inside or outside of the magazine 502 casing, or even integrated as a layer within the casing material. The circuitry can be arranged on a circuit board 510 (e.g., PCB) that can include electrical traces from the sensor array 504. In the illustrated embodiment, the sensor array 504 is arranged on the same circuit board as the circuitry, although in other embodiments the array 504 can be on one board and the circuitry can be on a second board. Alternatively, the circuitry can be on a circuit board and the array 504 may not be arranged on a board (e.g., the sensors and electrical traces can be integrated into or printed on the magazine 502 casing itself). In some other cases, the circuitry and the array 504 may be located exterior to the magazine, such as in a pistol grip of the firearm, or any other portion of the firearm. Although the circuitry is on a backside of the board in FIG. 5 (i.e., the side facing into the page), in other embodiments, the circuitry could be on the front side of the board (i.e., the side facing out of the page). The circuitry may provide a round count signal to a wireless transmitter (e.g., an NFC chip) that can wirelessly transmit the round count signal from the magazine 502 to a wireless receiver or transceiver, such as an antenna in a magazine well of the firearm, on the trigger guard, at a base of the magazine well, on an outside of the magazine well, or an another portion of the firearm. The circuitry 506 can be arranged next to the array 504, on a side of the magazine 502, or may be arranged proximal to or as part of a floorplate 512 of the magazine 502. In an embodiment, the wireless transmitter can be arranged in a top half or a top third or a top quarter of the magazine. In an embodiment, the wireless transmitter can be arranged in an upper region of the magazine that is configured to be arranged within a magazine well (e.g., see FIGS. 12 and 16A).

The array 504 may include one sensor for each cartridge (e.g., 30 in a 30-round magazine). The array 504 may include one sensor for each cartridge and then one additional sensor (e.g., 31 in a 30-round magazine). The array 504 may include one sensor for every two cartridges (e.g., 15 in a 30-round magazine) or one sensor for every two cartridges plus one (N/2+1) (e.g., 16 in a 30-round magazine). Whatever the configuration, an additional sensor (N+1) can be used to detect the empty state, or processing algorithms can be used to identify the empty state based on an N number of sensors, or N/2+1 number of sensors.

Figure 6:
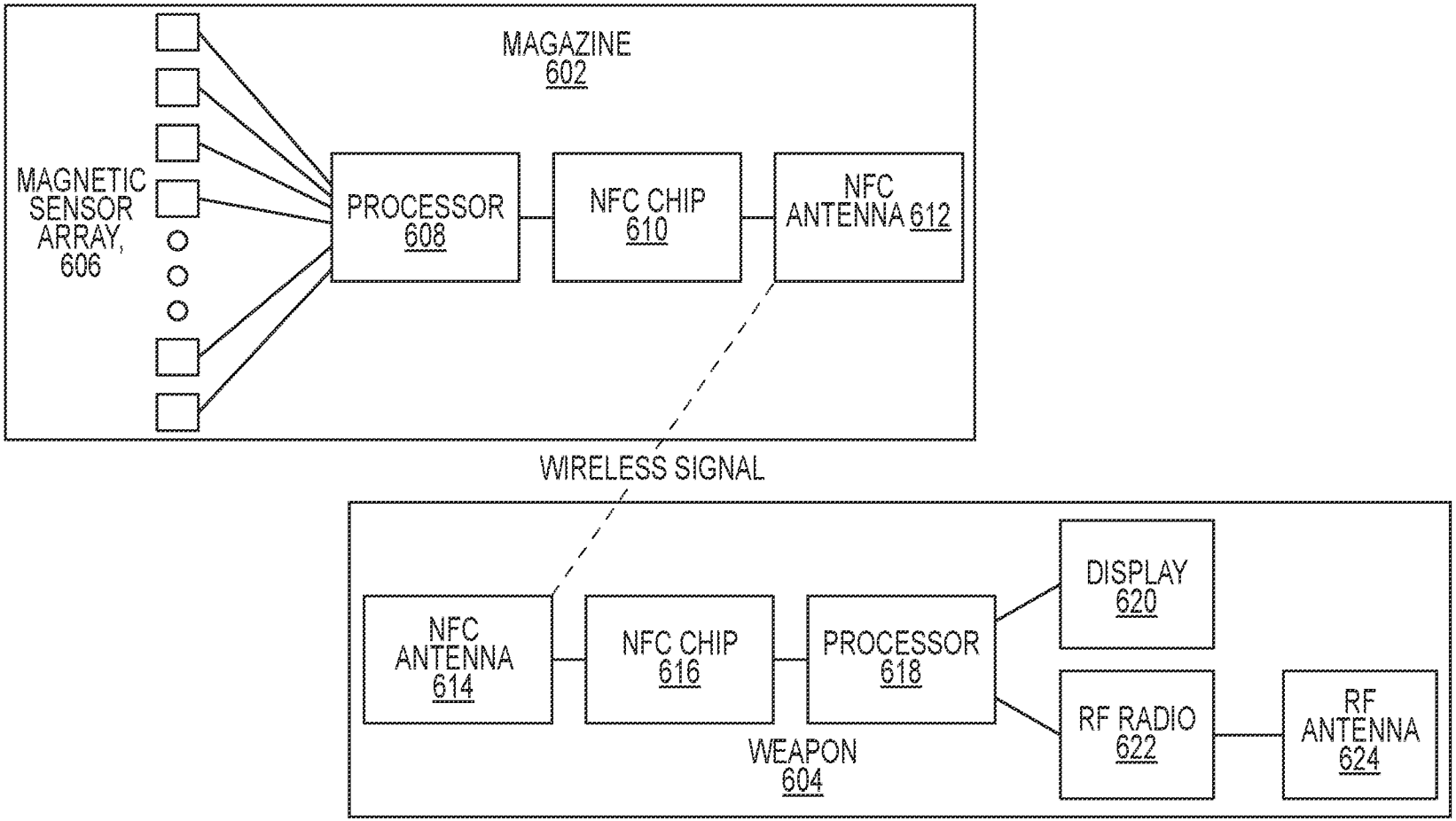
FIG. 6 is a circuit diagram for the magnetic sensor-based round counting system.

FIG. 6 illustrates an embodiment of a circuit diagram for a magnetic sensor-based round counting system. The system 600 includes a magazine 602 and a weapon system 604. The magazine can include a follower having one or more magnets, where the magnets travel along a straight or curved path as the number of rounds/cartridges in the magazine changes. An array of magnetic sensors 606 (e.g., Hall effect switches) can be arranged along the path of the one or more magnet's travel, such that the one or more switches 606 closest to the one or more magnets produce a strongest signal. Each switch 606 is in communication with a processor 608 (e.g., microprocessor or microcontroller) that receives the signals from the sensors 606 and determines a location of the follower based on these signals. In some cases, a microcontroller is a compact integrated circuit designed to govern a specific operation in an embedded system. A typical microcontroller includes a processor, memory and input/output (I/O) peripherals on a single chip.

The processor 608 then ascertains a number of rounds remaining in the magazine 602 based on the position of the follower and passes this data to a near field communications (NFC) chip 610. In some embodiments, the magnetic sensors 606 can have a binary output. The NFC chip 610 then communicates with an NFC chip 616 on the weapon 604 via NFC antennas 612 and 614. The NFC chip 616 then processes the wireless signal and passes the resulting output to a second processor 618 on the weapon 604. The processor 618 can then display the round count on a display 620 and/or optionally pass the round count to an optional RF radio 622 that passes the round count to other devices (e.g., a display on glasses of the user) via an optional RF antenna 624.

In an embodiment, the NFC chips 610, 616 can also pass power from the weapon 604 to the magazine 602. In other words, they can pass data and power simultaneously and in opposite directions. Various known protocols can be utilized to pass power and data via this wireless channel. For instance, a battery can store power in the handle of the weapon 604, and the NFC interface can pass power (e.g., wirelessly) from the battery to the magazine 602 to power the processor 608 and optionally the magnetic sensor array 606. It should be noted that, Hall effect switches typically use an external power source, while Reed switches do not need external power.

Figure 7:
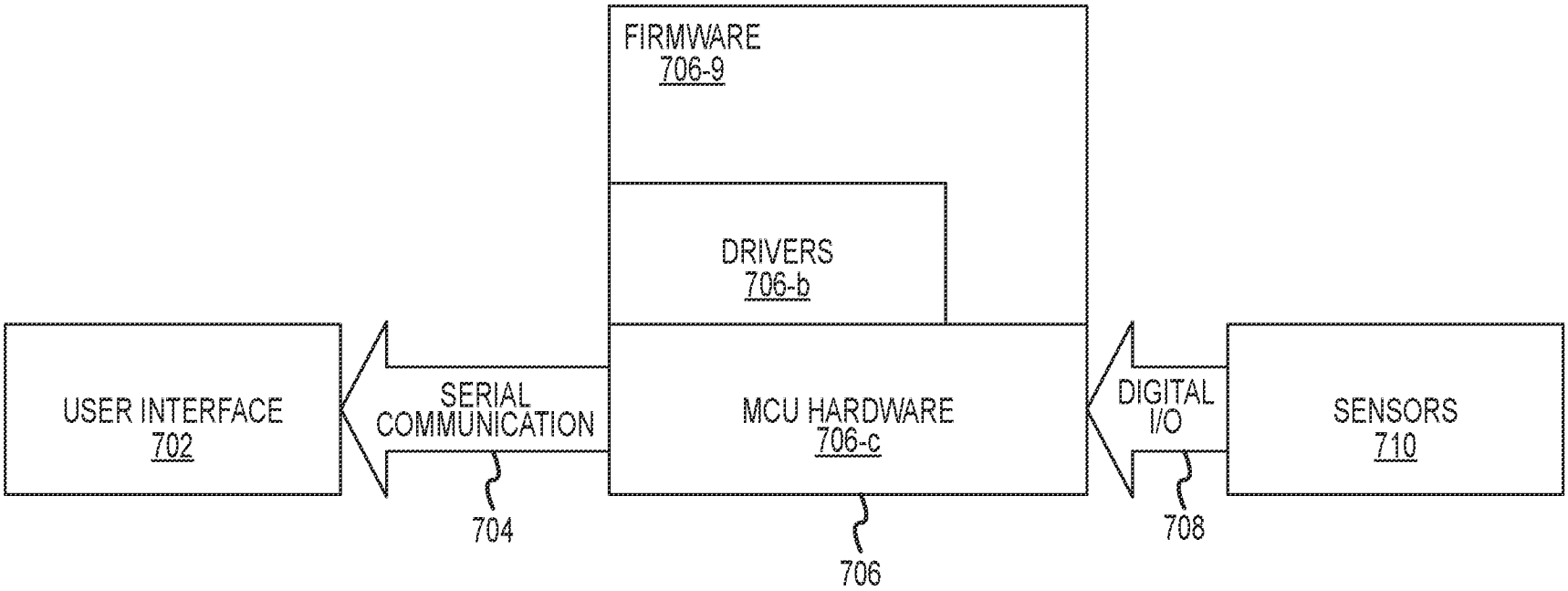
FIG. 7 is a block diagram of a media access controller (MAC) that controls the processor in FIG. 6, according to an embodiment of the disclosure.

FIG. 7 illustrates an embodiment of a block diagram for a media access controller (MAC) that controls microcontroller hardware responsible for interacting with the wired, optical, and/or wireless transmission mediums. A board 706 (e.g., a printed circuit board, embedded systems board, etc.) may comprise hardware for a microcontroller unit (MCU) 706-*c*, one or more drivers 706-*b*, and firmware (i.e., software/code providing low level control of device hardware). In some cases, the MCU hardware 706-*c* may be in serial communication 704 with user interface 702 of a firearm. The user interface 702 may be used to display a round count for a firearm magazine, the number of rounds expended, level of battery remaining, etc. In some cases, the user interface may be an example of the user interface and display housing, further described with reference to FIGS. 21 and 22.

The MCU hardware 706-*c* may also receive digital input/output (I/O) streams 708 from one or more sensors 710 located in the magazine of the firearm. In some cases, the sensors 710 may be Hall effect switches, Hall effect sensors, Reed switches, etc. As previously described, a Hall effect switch may provide a digital or at least pulsed or square wave output, whereas Hall effect sensors may provide an analogue output and therefore may require an analogue to digital converter (ADC) (not shown), as described in FIG. 2.

Figure 8:
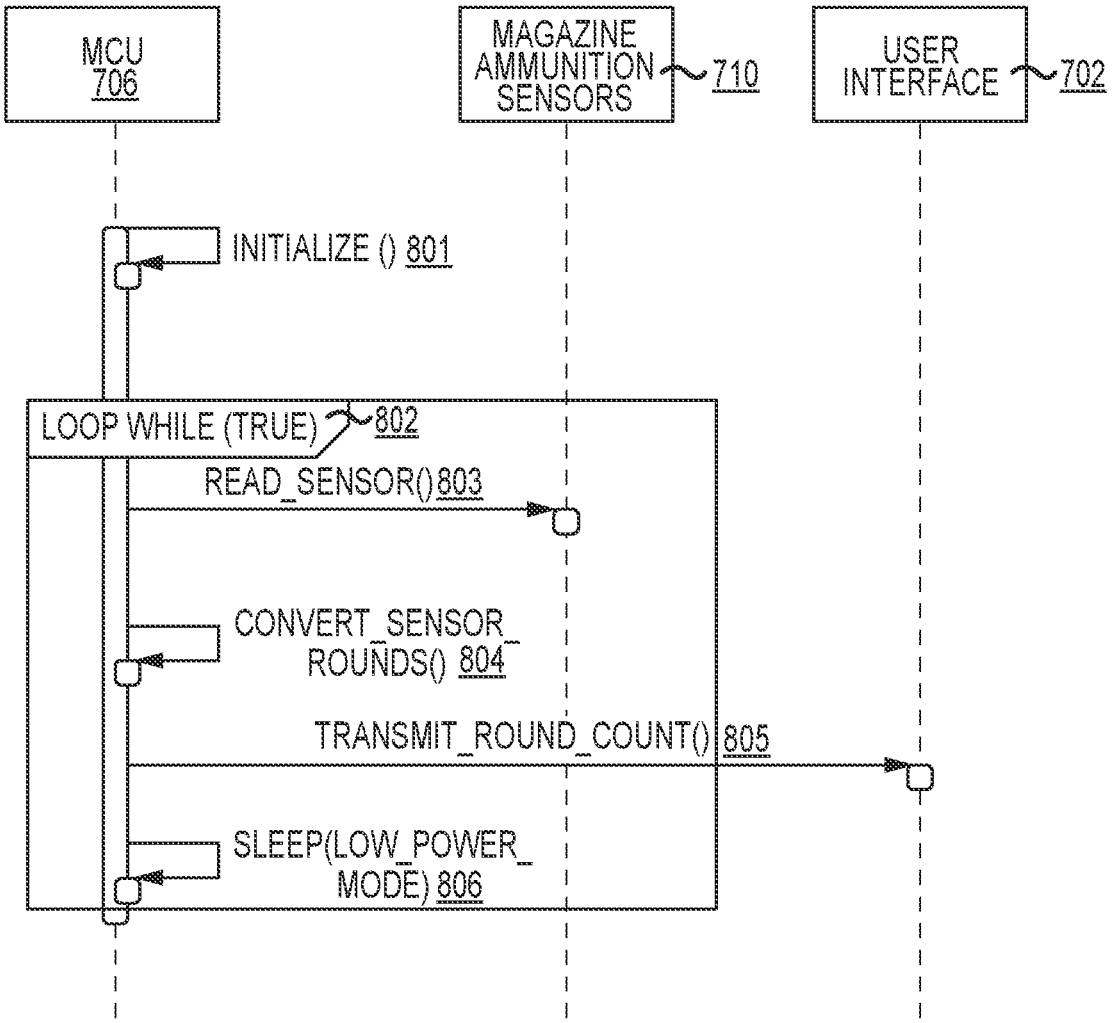
FIG. 8 is sequence diagram of the MAC in FIG. 7.

FIG. 8 is a sequence diagram illustrating an embodiment of communications between the MCU, magazine ammunition sensors (e.g., magnetic field-sensing sensors), and the user interface (e.g., screen/display for displaying round count) in FIG. 7. MCU 706 may be in serial communication with the user interface 702 and may receive digital I/O streams from one or more magazine sensors 710. In some cases, the one or more magazine sensors 710 may be substantially evenly spaced out from one another and line an inside of the magazine. The MCU 706 may be exemplified by the processor 608 in FIG. 6.

At 801, the MCU 706 may initialize. In some cases, the initialization may be in response to the round counting system being turned on, an accelerometer within the magazine (or firearm) being triggered due to motion of the firearm, or any other user action. If the MCU 706 or sensors 710 are not in sleep mode (i.e., while system is still initialized) at 802, the MCU 706 may start reading and processing the output (i.e., round count data) from the magazine sensors 710 at 803. At 804, the MCU 706 may convert the round count data to a round count indication. For instance, the round count data may include an indication of the number of active magnetic-field sensing sensors (e.g., Hall effect switches or sensors, reed switches, etc.), based on which the MCU 706 may be able to determine a position of the follower comprising a magnet within the magazine and the round count indication.

At 805, the MCU 706 may transmit the round count 805 to the user interface 702. In some cases, the MCU 706 may be coupled to a first flat antenna (e.g., microstrip patch antenna, or any other antenna fabricated on a PCB) and the first flat antenna may transmit the round count indication to a second flat antenna on the firearm (e.g., located inside a magazine well of the firearm). The user interface 702 may be in communication with the second flat antenna via one or more RF cables and connectors (e.g., see FIG. 15).

In some other cases, the MCU 706 may be located on the firearm side, as opposed to the magazine side. In such cases, the round count data may be transferred wirelessly between the two antennas prior to being processed. In some circumstances, the two antennas may also transfer power via an NFC connection, for instance, if the battery or power source for the round counting system is on the firearm. In one example, the battery may be located within the grip of the firearm.

After receiving the round count indication 805, the user interface 702 may display the round count for the user. At 806, if the MCU 706 is not receiving any further I/O from the magazine sensors 710 (e.g., firearm is not in use, or after a certain level of inactivity), the MCU 706 and/or sensors may switch to low power/sleep mode. Unlike Reed switches, Hall effect switches or sensors require external power to operate, thus, a sleep mode may serve to conserve power.

Figure 9:
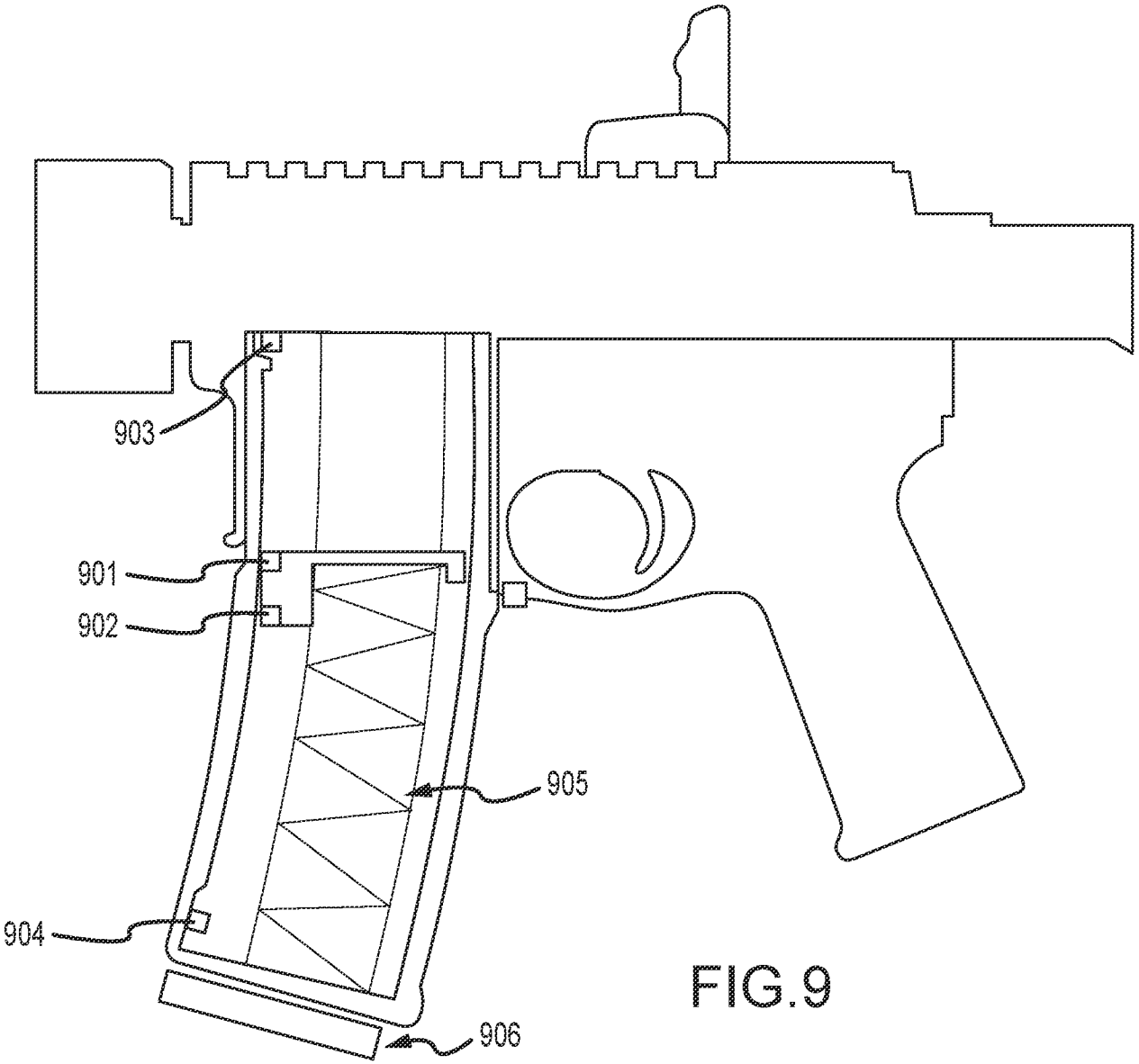
FIG. 9 is a side view of a firearm receiver and a detachable magazine where the compression spring is utilized as part of the counting system, according to an alternative embodiment of the disclosure.

FIG. 9 illustrates an alternative embodiment of a round counting system. Here, the compression spring 905 is used as part of the counting system. In particular, as the follower moves and compresses or relaxes the spring 905, the spring inductance changes. A coil inductance detector 906 in the base of the magazine or located elsewhere on the magazine, can detect this inductance and correlate this to a known follower position and hence a number of remaining rounds. The follower may also include a first and second reference contact 901, 902 and the magazine can include a third and fourth reference contact 903, 904. These contacts can be used to calibrate the sensing. For instance, when the first and third contacts 901, 903 come into contact, the system can know that the follower is at a full-height position, that is, no rounds being in the magazine. When the second and fourth contacts 902, 904 come into contact, the system can know that the follower is at a minimum-height position, that is, fully-loaded. In another embodiment, the first and second reference contacts 901, 902 can be a single contact or a portion or all of the follower can be conductive and thereby operate as a contact.

In one embodiment, the limits of inductance can be tracked to self-calibrate the unit when empty, the spring 905 will be longest and have the largest inductance. When fully loaded the spring 905 will be shortest and have the least inductance. In this way the detection circuitry may be able to "adapt" and learn the full/empty limits and deduce intermediate values between the full and empty extremes.

In an embodiment, a helical wire can be inserted inside the main magazine spring 905 or fabricated into the spring 905 or attached thereto. This helical wire can be coupled to a top of the main magazine spring 905 and thereby create a return loop to enhance inductance measurements. In an embodiment, the detection circuitry 906 can inject current into the spring 905 or the return wire to enhance the inductance that can be measured. The helical wire can be wound in the same direction as the main spring 905 so that it will also contribute inductance to the measurement, thereby making the measurement more sensitive.

In another embodiment, a multi-layered spring can be used (e.g., conductor-insulator-conductor), which integrates the return wire function within the main spring itself. The two conductor layers would be electrically connected at the top end near the follower, but electrically isolated during the journey from the top to the bottom of the magazine.

In some other cases, the spring 905 may be coated with an insulator (e.g., an oxide layer) to prevent the conductive portions of the spring from contacting each other when compressed. In some examples, such a system may need to be calibrated for different round sizes and weights, since the compression and inductance of the spring may vary.

Figure 10:
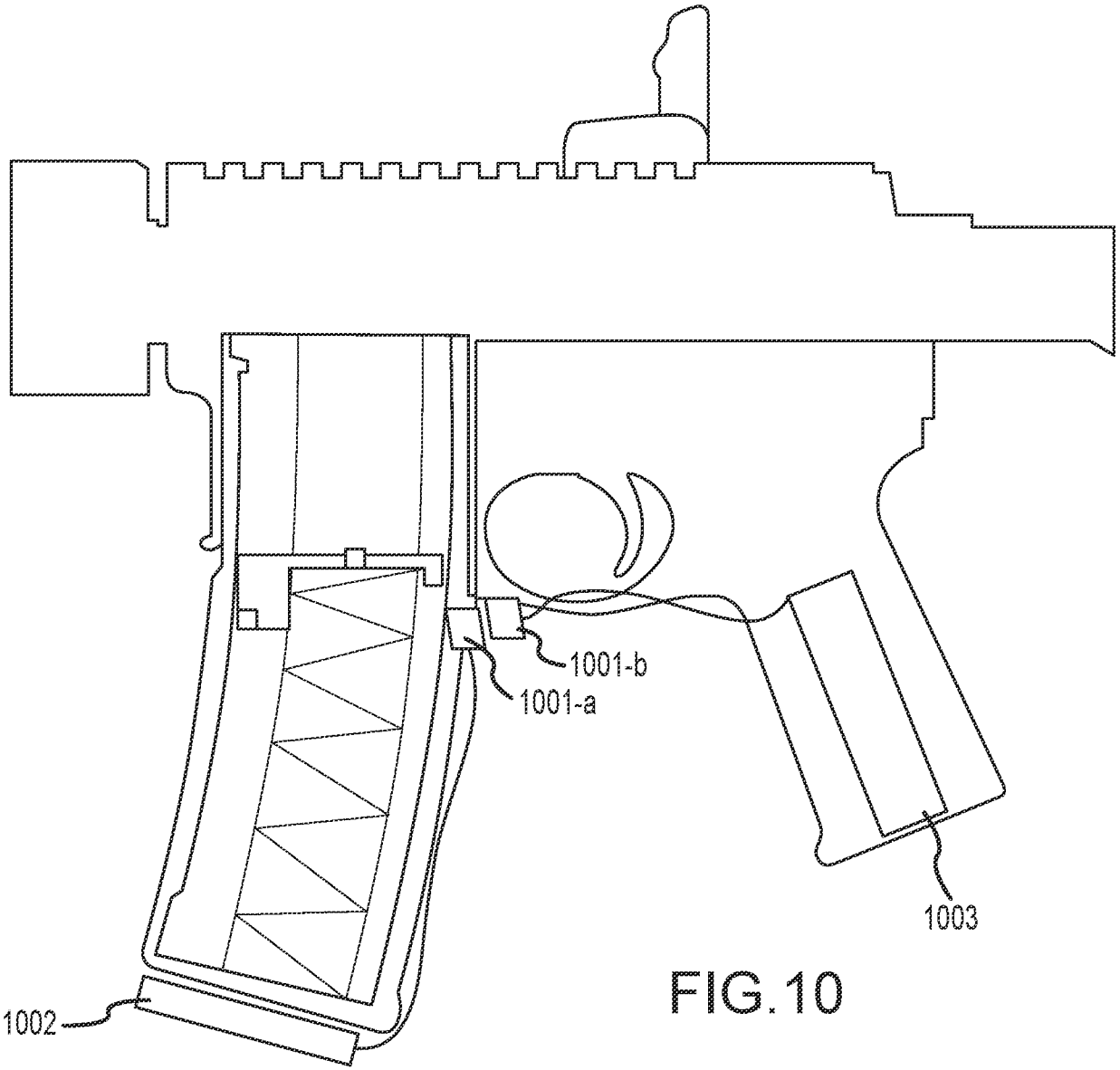
FIG. 10 is a side view of a firearm receiver and a detachable magazine where an NFC interface may be used to transmit round count information from the magazine to the weapon.

FIG. 10 illustrates a round counting system where an NFC interface is used to pass information from the magazine sensing circuitry to the weapon, for instance, a display on the weapon or to a more powerful wireless transmitter on the weapon that can pass the round count to a receiver/display on a user or other remote entity. In some cases, the NFC interface may comprise two NFC inductive coupling antennas 1001-*a* and 1001-*b*. As shown, the NFC interface can be arranged near a bottom of the magazine well and the trigger guard. One half of the interface can be affixed to the weapon and the other half can be integrated into each magazine to be used with the weapon. In this way, each magazine can convey round count information to the weapon. The NFC interface can also be coupled to a power source on the weapon (e.g., a battery or weapon system circuitry 1003), and this interface can wirelessly transmit power from the weapon to the magazine and its sensing circuitry 1002.

In an embodiment, an NFC chip can have a unique ID (e.g., a 64-bit ID or 128-bit ID). This ID gives each magazine a unique identification or serial number that can be used for tracking and inventory, among other purposes. Alternatively, a serial number can be coded or hardwired into the processor or microcontroller. Alternatively, a serial number can be distributed between the processor and the NFC chip.

In some embodiments, eddy currents may be induced within a conductor (e.g., the NFC antenna 1001-*a*) due to the motion of the magnet on the follower relative to the NFC antenna 1001-*a*. In this way, the eddy current may also be used to power the NFC connection and processing of these signals can occur on the weapon. Alternatively, the eddy current signals can be processed on the magazine and passed to the weapon via the NFC connection.

Figure 11:
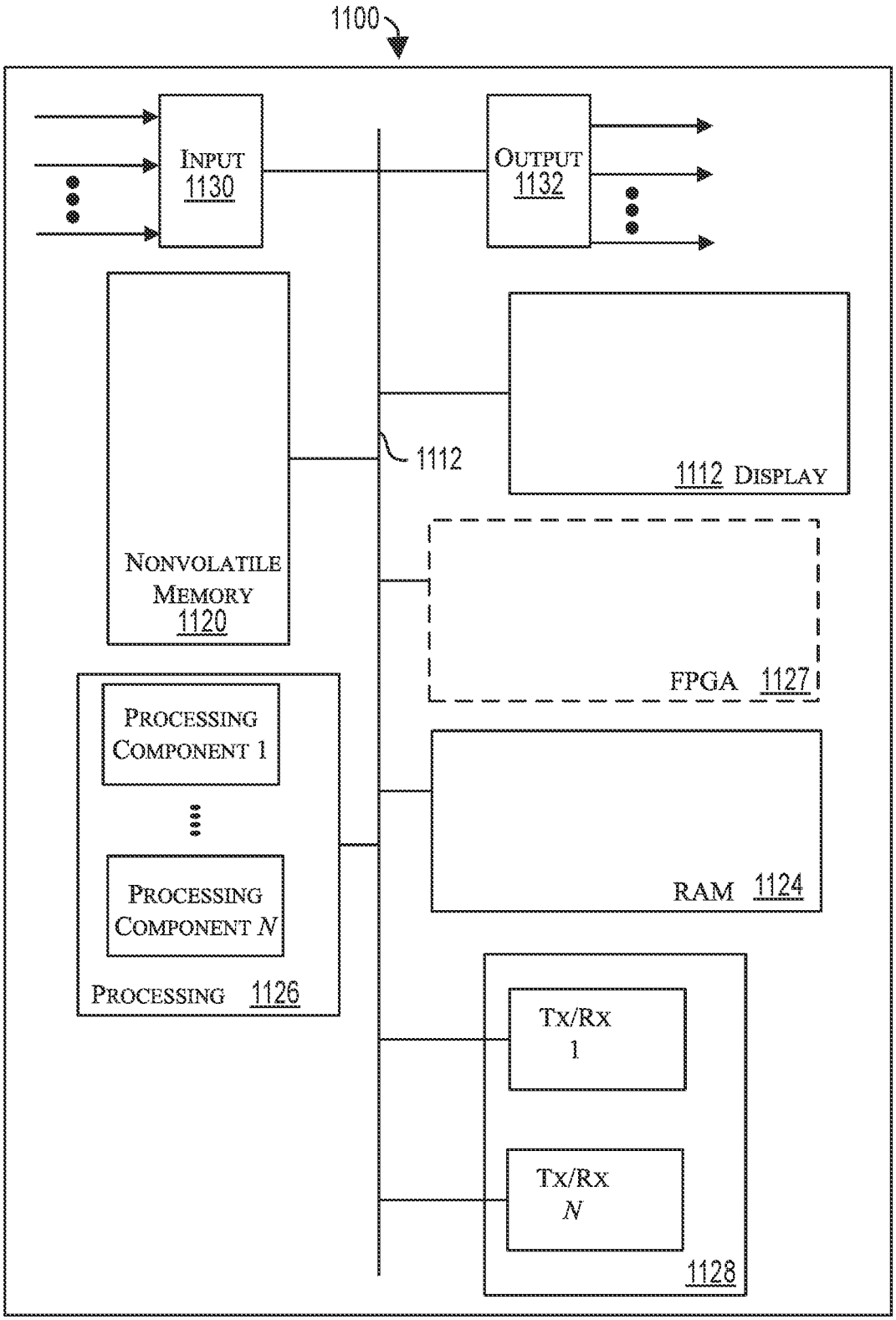
FIG. 11 is a block diagram illustrating a computer system according to various embodiments of the disclosure.

The methods described in connection with the embodiments disclosed herein may be embodied directly in hardware, in processor-executable code encoded in a non-transitory tangible processor readable storage medium, or in a combination of the two. Referring to FIG. 11 for example, shown is a block diagram depicting physical components that may be utilized to realize a round counter (and the processor 116 or Hall switch encoding circuitry 116 generally) according to an exemplary embodiment. As shown, in this embodiment a display portion 1112 and nonvolatile memory 1120 are coupled to a bus 1122 that is also coupled to random access memory ("RAM") 1124, a processing portion (which includes N processing components) 1126, an optional field programmable gate array (FPGA) 1127, and a transceiver component 1128 that includes N transceivers. Although the components depicted in FIG. 11 represent physical components, FIG. 11 is not intended to be a detailed hardware diagram; thus many of the components depicted in FIG. 11 may be realized by common constructs or distributed among additional physical components. Moreover, it is contemplated that other existing and yet-to-be developed physical components and architectures may be utilized to implement the functional components described with reference to FIG. 11.

This display portion 1112 generally operates to provide a user interface for a user, and in several implementations, the display is realized by a firearm's scope, an LCD/LED display mounted to a firearm, a set of goggles or spectacles worn by a user of the firearm, electronic paper (e.g., e-ink) affixed to a weapon or user, and a touchscreen display. In general, the nonvolatile memory 1120 is non-transitory memory that functions to store (e.g., persistently store) data and processor-executable code (including executable code that is associated with effectuating the methods described herein). In some embodiments for example, the nonvolatile memory 1120 includes bootloader code, operating system code, file system code, and non-transitory processor-executable code to facilitate the execution of processing of the signals from the magnetic sensors described further herein.

In many implementations, the nonvolatile memory 1120 is realized by flash memory (e.g., NAND or ONENAND memory), but it is contemplated that other memory types may be utilized as well. Although it may be possible to execute the code from the nonvolatile memory 1120, the executable code in the nonvolatile memory is typically loaded into RAM 1124 and executed by one or more of the N processing components in the processing portion 1126.

The N processing components in connection with RAM 1124 generally operate to execute the instructions stored in nonvolatile memory 1120 to enable processing of signals from the magnetic sensors. For example, non-transitory, processor-executable code to effectuate distinguishing between follower positions between Hall effect switches or aligned with one of the Hall effect switches, where on switch is used for every two positions (see FIG. 4B) may be persistently stored in nonvolatile memory 1120 and executed by the N processing components in connection with RAM 1124. As one of ordinarily skill in the art will appreciate, the processing portion 1126 may include a video processor, digital signal processor (DSP), micro-controller, graphics processing unit (GPU), or other hardware processing components or combinations of hardware and software processing components (e.g., an FPGA or an FPGA including digital logic processing portions).

In addition, or in the alternative, the processing portion 1126 may be configured to effectuate one or more aspects of the methodologies described herein (e.g., determining round count based on a position of one or more magnets on the follower as sensed by one or more of the magnetic sensors/switches 112, 404, 504, etc.). For example, non-transitory processor-readable instructions may be stored in the nonvolatile memory 1120 or in RAM 1124 and when executed on the processing portion 1126, cause the processing portion 1126 to identify a position of the follower within the magazine. Alternatively, non-transitory FPGA-configuration-instructions may be persistently stored in nonvolatile memory 1120 and accessed by the processing portion 1126 (e.g., during boot up) to configure the hardware-configurable portions of the processing portion 1126 to effectuate the functions of the Hall switch encoding circuitry 116 (or processor).

The input component 1130 operates to receive signals (e.g., the outputs from the magnetic sensors/switches 112, 404, 504, etc.) that are indicative of one or more aspects of the position of the follower and thus round count. The input component 1130 could also be receiving signals from the NFC interface sent from the circuitry/processor 116 of the magazine. The signals received at the input component may include, for example, analogue or digital signals from the magnetic sensors/switches 112, 405, 504, etc. The output component generally operates to provide one or more analog or digital signals to effectuate an operational aspect of the magazine passing round count information to the weapon. For example, the output portion 1132 may provide the round count described with reference to the figures above. The depicted transceiver component 1128 includes N transceiver chains, which may be used for communicating with external devices via wireless or wireline networks. Each of the N transceiver chains may represent a transceiver associated with a particular communication scheme (e.g., WiFi, Ethernet, Profibus, NFC, etc.). The transceiver component 1128 can be an NFC component and can be configured to both send and receive data as well as power simultaneously. The transceiver component 1128 may also be a more powerful second transceiver arranged on the weapon, such that NFC transfers data from the magazine to the second transceiver which then uses a more powerful radio to pass the round count to a receiver/display that is remote from the weapon (e.g., on a user or a user's goggles/spectacles).

Figure 12:
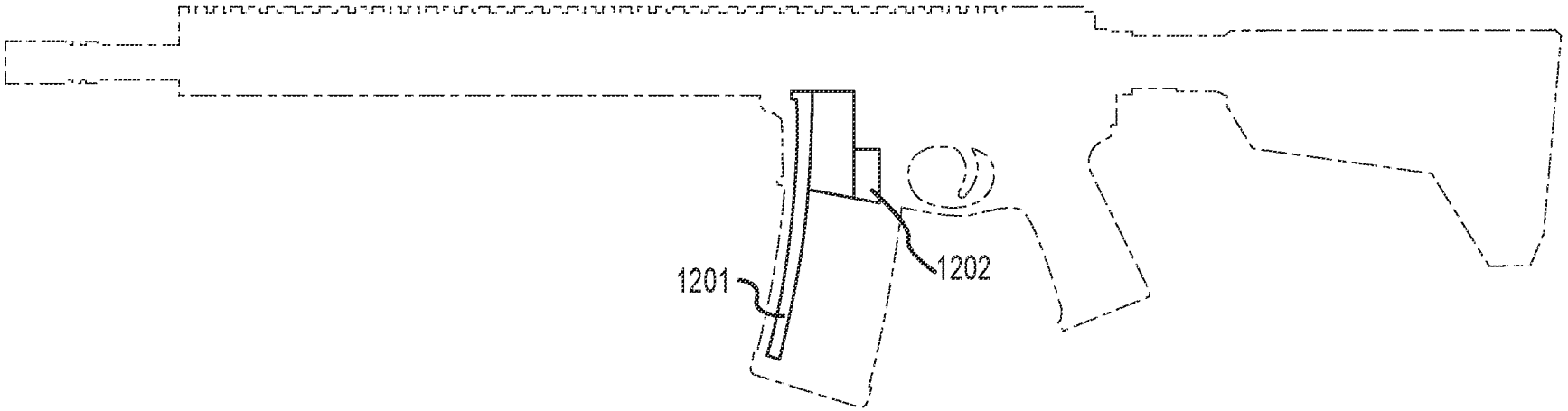
FIG. 12 is a side view of the firearm and the detachable magazine (in FIG. 5), illustrating areas for installing the magazine antenna and magnetic field-sensing sensors.
Figure 13:
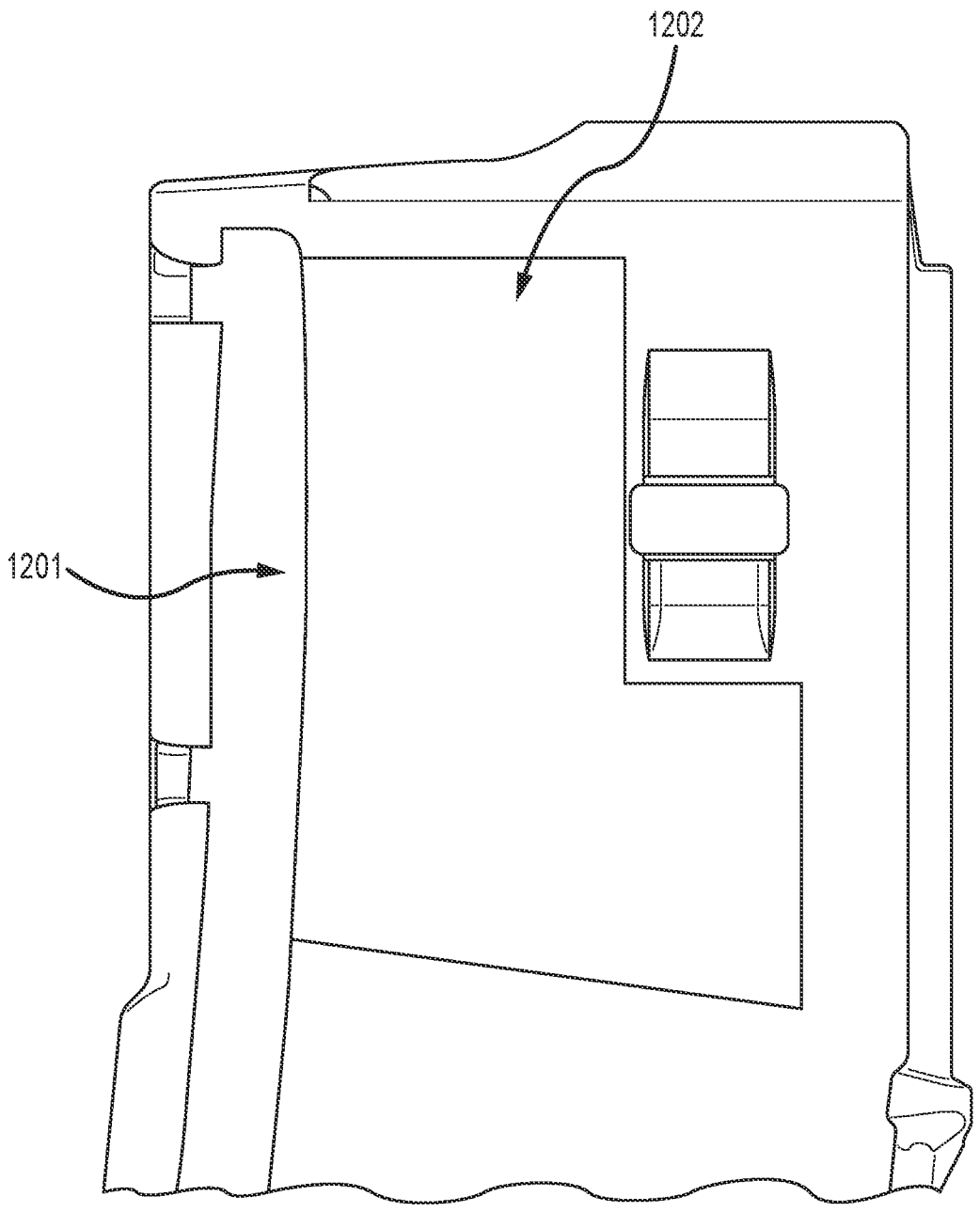
FIG. 13 is a detailed view of the detachable magazine in FIG. 12.

FIG. 12 illustrates a side view of a firearm with a sensor array 1201 and magazine antenna 1202 within or coupled to the magazine. The second antenna (not shown), on the firearm, could have an area that substantially aligns with and/or overlaps an area of the antenna 1202 (e.g., see FIG. 16). FIG. 12 also shows an alternative shape of the antenna 1202 as compared to that shown in FIG. 5. FIG. 13 illustrates a detailed view of the sensor array 1201 and magazine antenna 1202 in FIG. 12. Although the magazine antenna 1202 is shown having an L-shape, in other embodiments, other shapes for the magazine antenna 1202 could also be implemented. The magazine antenna 1202 also encompasses an area that may be said to have a height and a width. The antenna may be substantially flat, thereby enabling it to fit within the magazine without requiring modification to the functional dimensions of the inside or outside of the magazine.

Figure 14:
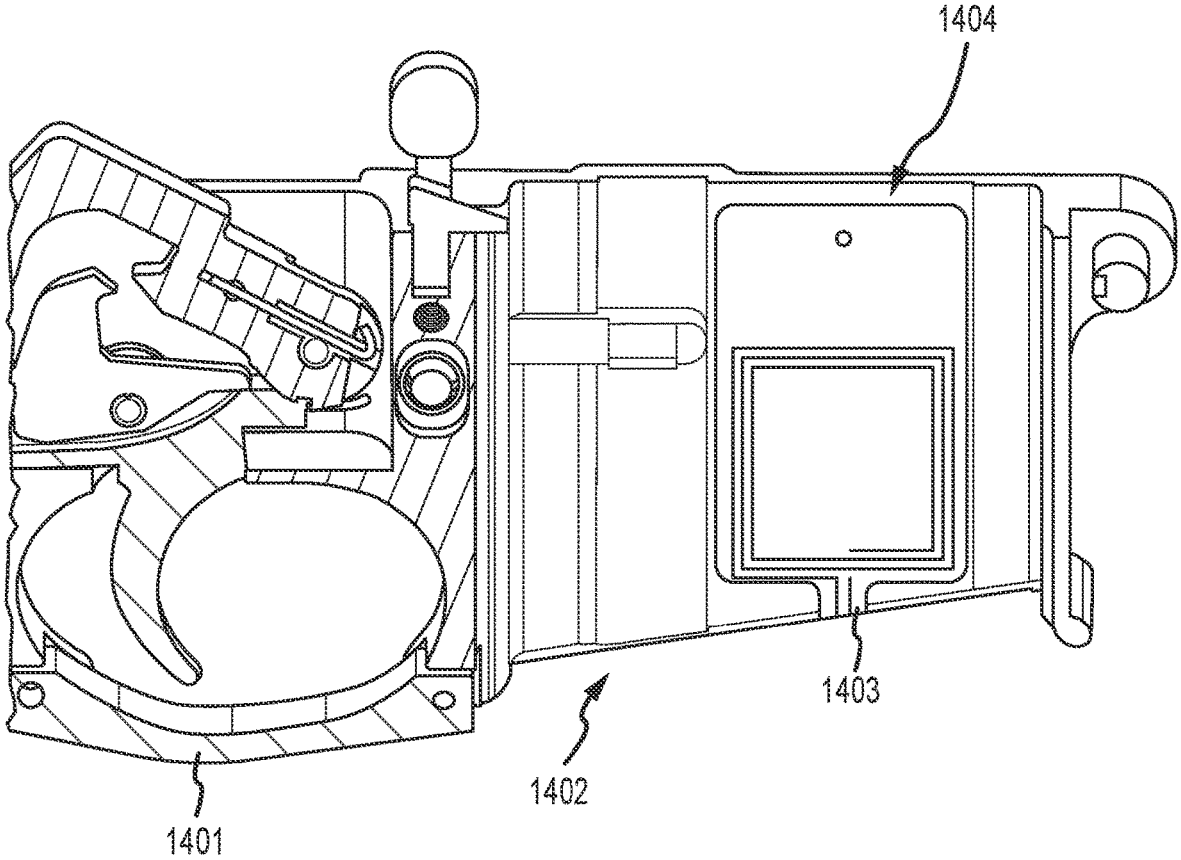
FIG. 14 illustrates an isometric view of the trigger assembly and magazine well, according to an embodiment of the disclosure.

FIG. 14 is an isometric cross sectional view of a trigger assembly 1401 and magazine well 1402, illustrating an embodiment of the disclosure. As shown, an NFC antenna 1403 (e.g., a flat NFC antenna) can be arranged in depression 1404 in the magazine well 1402. As described above with reference to FIG. 10, one half of the NFC interface (i.e., NFC antenna 1403) can be affixed to the weapon and the other half (i.e., a second NFC antenna, not shown) can be integrated into each magazine to be used with the weapon. In this way, each magazine can wirelessly convey round count information to the weapon. The NFC interface can also be coupled to a power source on the weapon (e.g., a battery or weapon system circuitry), and this interface can wirelessly transmit power from the weapon to the magazine and the magazine sensing circuitry.

Wiring access may be provided between the antenna 1403 inside the magazine well 1402 to a display that is on the outside of the receiver. In such cases, the NFC antenna 1403 and its circuit board may be fabricated on a flexible substrate, or a substrate having a flexible portion. In one example, a portion of the NFC circuit board may be flexed around a bottom of the magazine well 1402 and then affixed (e.g., stuck) to an outside of the magazine well, as further described with reference to FIG. 16, where a connection to an RF cable (see FIG. 15) could be made. Such a design may circumvent the need to make any modifications (e.g., drilling/machine openings) to the receiver in order to provide a wiring path for a traditional cable. In an alternative embodiment, a wiring connection could be made through the magazine release switch, for instance through a magazine release switch having a wiring aperture. It should be noted that FIG. 14 only shows one embodiment of the antenna 1403, and other shapes and locations of the antenna 1403 may also be implemented without departing from the scope or spirit of this disclosure.

Figure 15:
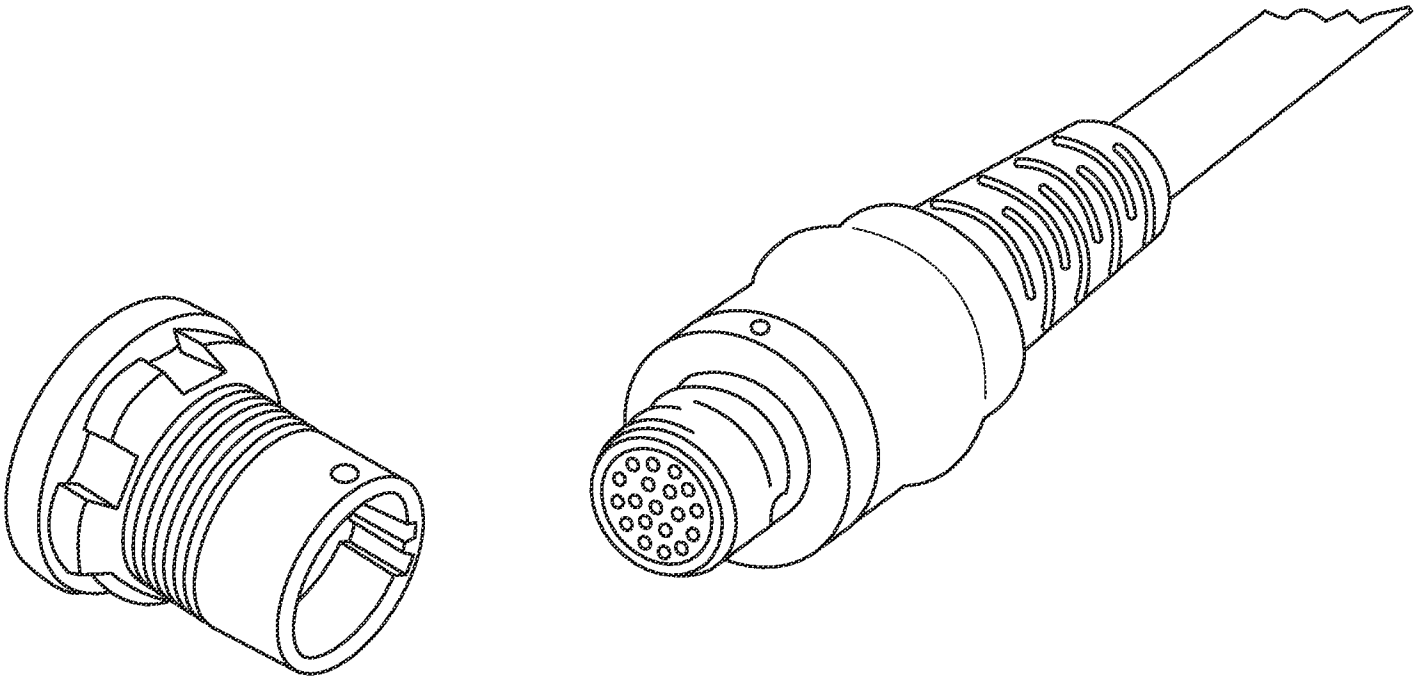
FIG. 15 illustrates a RF connector and cable for use with the NFC antenna and/or weapon system display.

FIG. 15 illustrates an example of a RF cable for connecting the antenna 1403 to a display mounted on the weapon. In some cases, the RF cable may be detachable, which may serve to provide strain relief on the antenna attachment. Additionally or alternatively, the detachable cable may also comprise a connector with strain relief for attaching to the display. In some examples, connectors may be attached to both the antenna and display and connected via a RF cable.

Figure 16C:
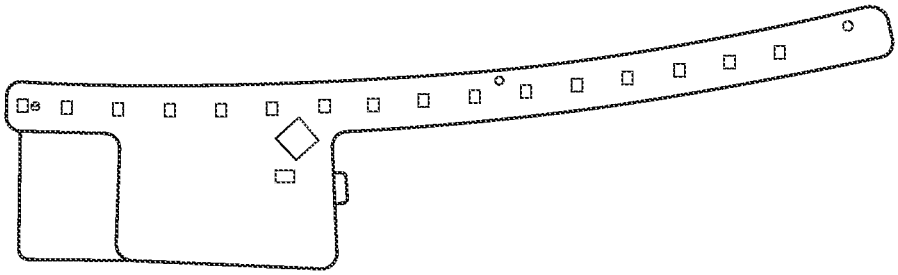
FIG. 16 illustrates different views of the NFC circuit board flexing around the bottom of the magazine well.
Figure 16B:
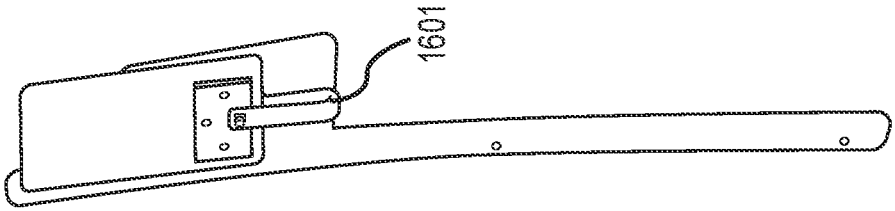
Figure 16A:
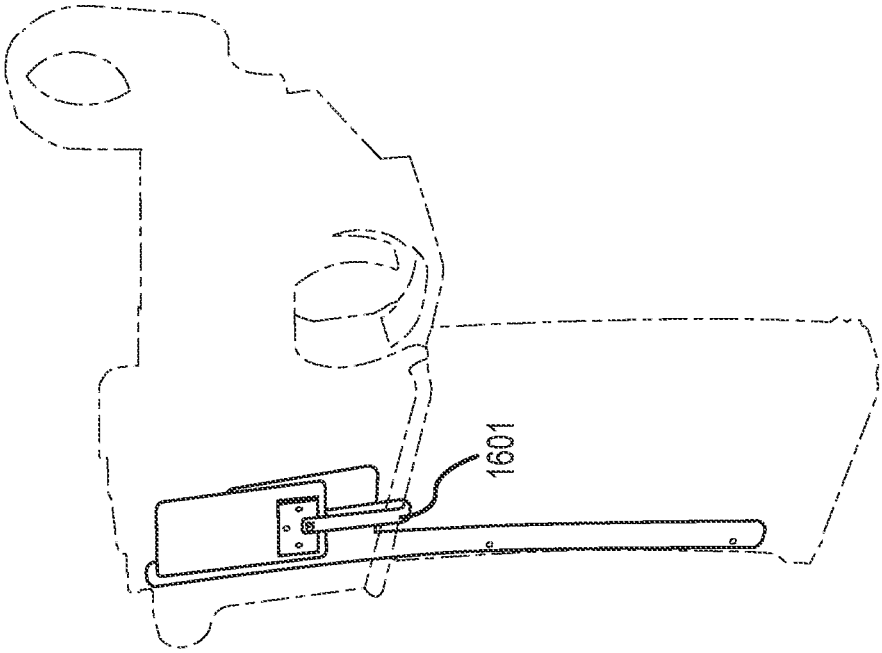
Figure 17:
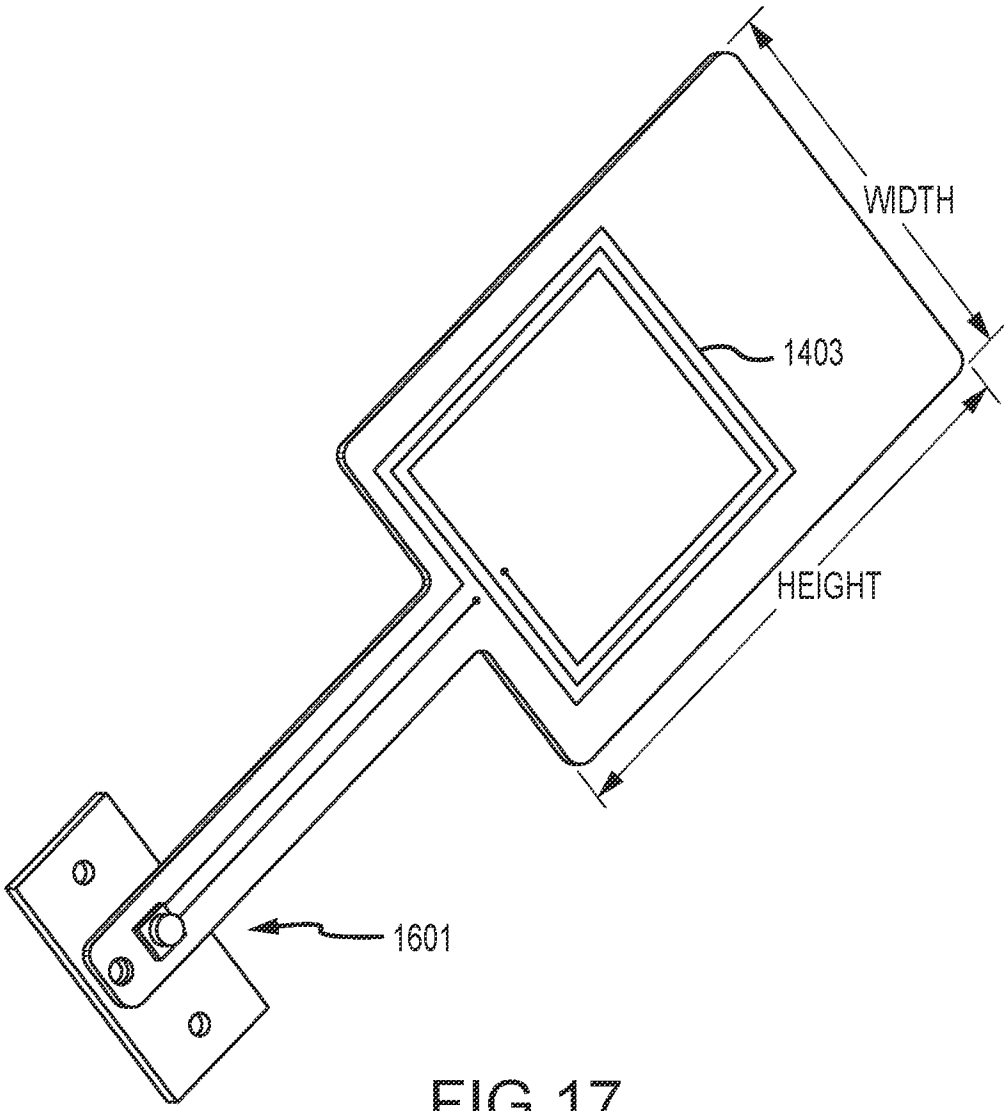
FIG. 17 is a detailed view of the NFC antenna and circuit board.

FIGS. 16A, 16B, and 16C illustrate different views of the NFC circuit board flexing around the bottom of the magazine well (e.g., flexible lower portion 1601), and then affixed (e.g., stuck) to an outside of the magazine well where a connection to an RF cable could be made. FIG. 17 illustrates a detailed view of the NFC antenna including the flexible lower portion 1601 of the circuit board that can be wrapped around the bottom of the magazine well. As described with reference to FIG. 14, the left side of an AR-15 magazine well may comprise a depression 1404 that does not contact the magazine and is just deep enough (e.g., Depth: 0.0175+/−0.0075 inches (0.44+/−0.19 mm), Width: 1.77 inches (45 mm), Height: 2 inches (50.8 mm)) to fit a thin substantially flat NFC antenna 1403 (e.g., Thickness: 0.010 inches (0.25 mm), Height: 1.6 inches (40.64 mm), W: 1.050 inches (26.67 mm)) without interfering with magazine insertion and removal. In some examples, the NFC antenna 1403 may be a microstrip patch antenna (e.g., copper, or another high conductivity material) fabricated on a dielectric substrate (e.g., ROGERS RT/DUROID or RO3000 or DiClad series composite/laminate, Gallium Arsenide (GaAs), GaN, epoxy, or any other composite or substrate for use in electromagnetic and high frequency applications). As shown, the antenna 1403 may encompass a smaller area than the main region of the circuit board. For instance, while the main portion of the circuit board in FIG. 17 has a height and a width, the antenna 1403 has a smaller width and a much smaller height (e.g., a height roughly half that of the main portion of the circuit board).

In some other cases, the flat NFC antenna may comprise a high conductivity trace (e.g., copper) fabricated on a substrate or a dielectric circuit board in the shape of a coil, a circle, an ellipse, or any other continuous shape. In some embodiments, a continuous metal layer (i.e., ground plane) may be bonded to the second side of the substrate (i.e., the one not comprising the antenna trace). At the minimum, the substrate thickness should be selected to ensure that the flat NFC antenna fits within the magazine well of the receiver. Furthermore, substrate material and thickness may also be selected based on one or more antenna performance parameters, such as resonant frequency, directivity, gain, return loss, bandwidth, etc. For instance, a high frequency (smaller wavelength) application may need a thinner substrate than a lower frequency application. In addition to the substrate material/thickness, the 2-D geometry of the NFC antenna may also influence its radiation pattern, beam width, etc., and different shapes may be selected for different scenarios.

Figure 18:
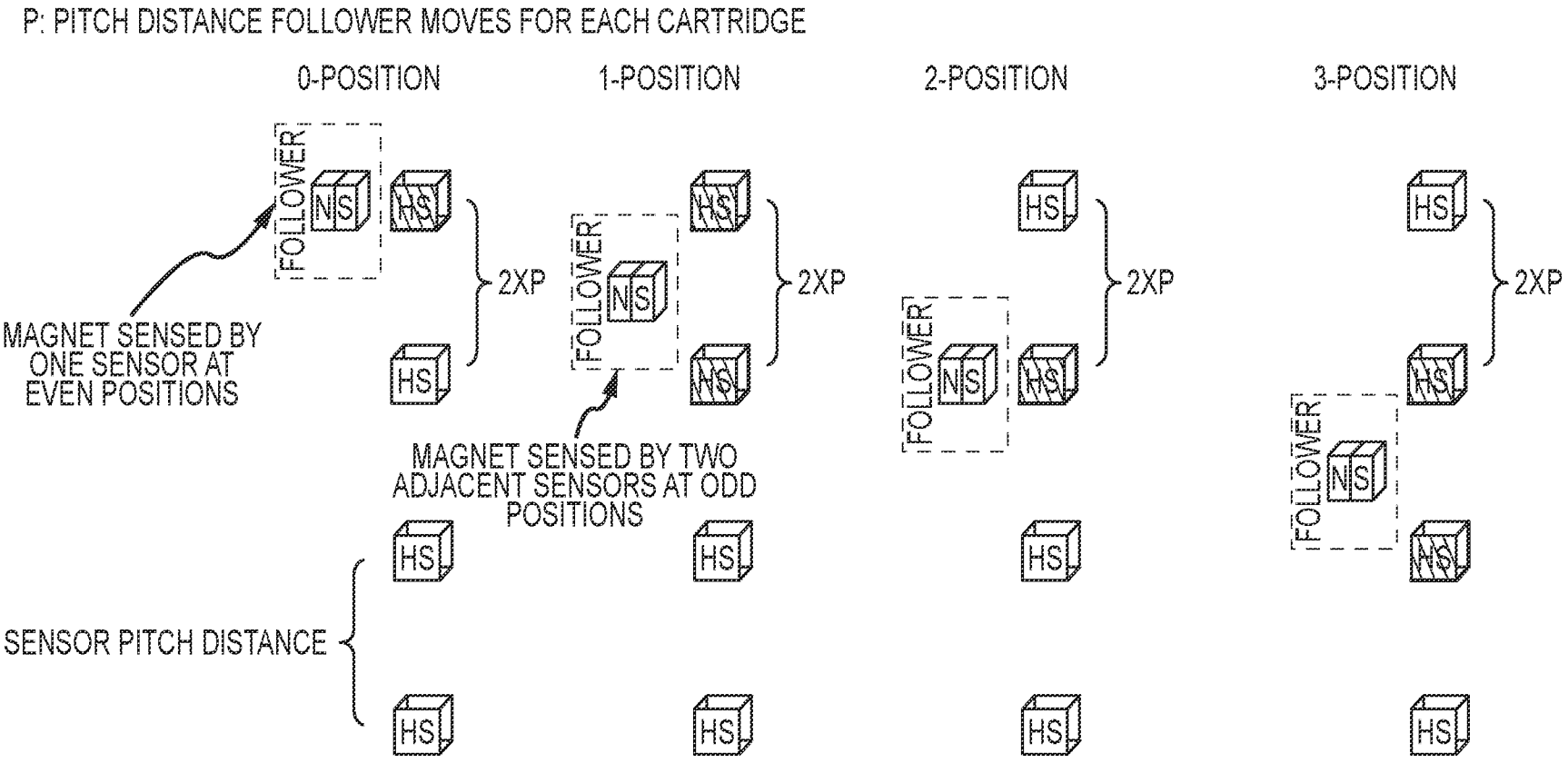
FIGS. 18, 19, and 20 illustrate magnetic position sensing using Hall effect sensors for one, two, and three magnets on the follower, respectively.
Figure 19:
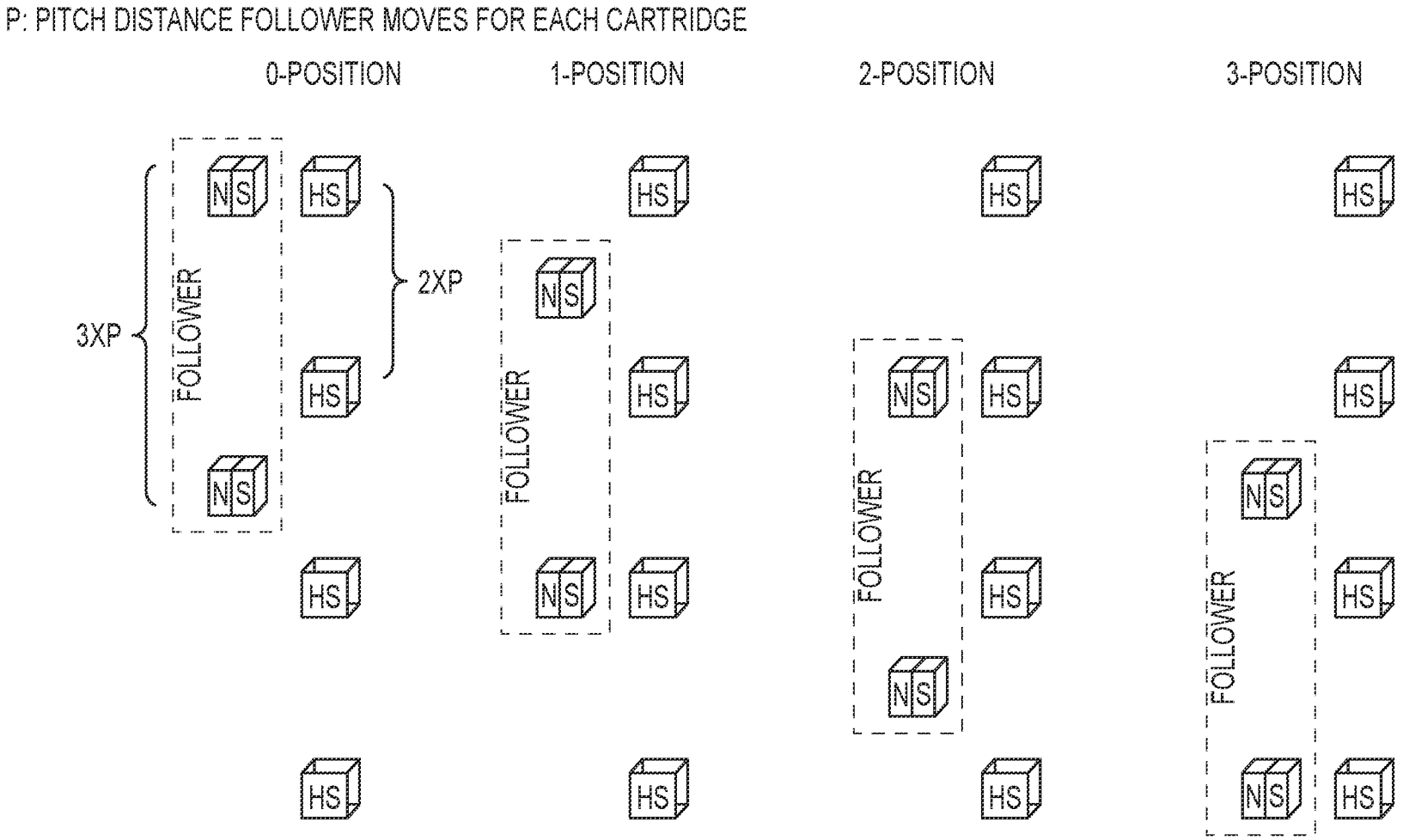
Figure 20:
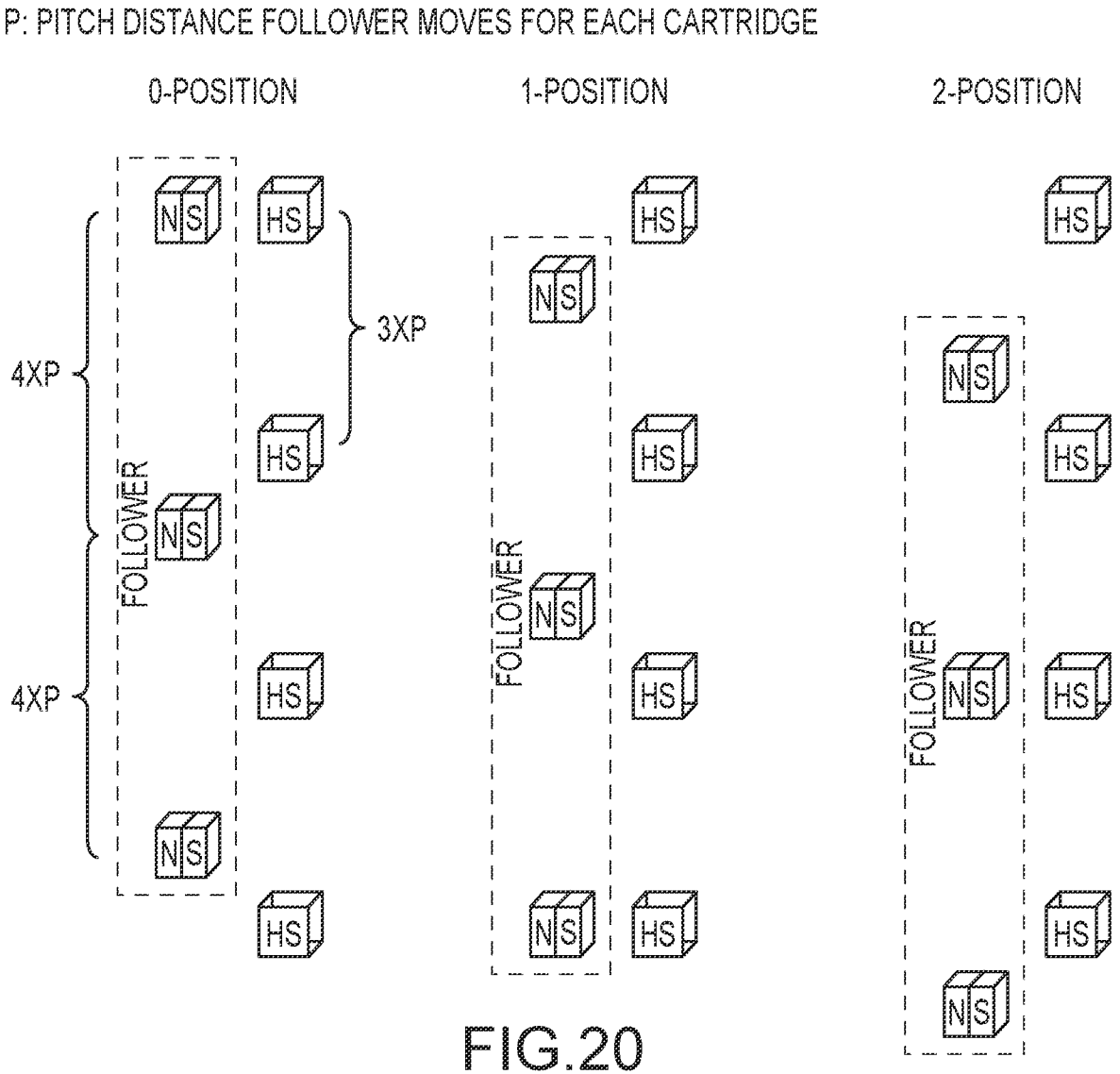

FIG. 18 illustrates magnet position sensing with Hall effect switches, according to an embodiment of the disclosure, where a single magnet is positioned on the follower and a number of hall effect switches is N/2 or N/2+1. In some cases, the magazine may be lined with magnets instead of hall effect switches. In such cases, one or more hall effect switches and associated electronics may be placed on the follower. As shown, at the 0-position (e.g., empty magazine), the magnet may be sensed by one sensor. Next, at 1-position, an odd position, the magnet may be sensed by two adjacent switches. It should be noted that P is the pitch distance the follower moves for each round, and the switches are spaced two (2) pitch distances apart. Thus, at the 1-position the magnet on the follower would be approximately equidistant from the first two switches. Similarly, at 2-position, an even position, the magnet may be in line with the second sensor, since it has moved two (2) pitch distances from the 0-position. Hence, it follows that for a single magnet on the follower, the magnet is sensed by a single sensor at even positions and sensed by two adjacent switches at odd positions. FIGS. 19 and 20 show different embodiments using two and three magnets on the follower, respectively. FIG. 19 could also be implemented using Hall effect sensors where outputs of each sensor was provided to a comparator such that only sensors seeing a certain signal strength would register as an active sensor.

As noted above, unlike Reed switches, hall effect switches may need a power supply in order to operate. For efficient power management of hall switches, only the switches that are actively sensing a magnet may need to be powered. When a magnet leaves the currently active sensor, the sensor generates a digital signal (e.g., an interrupt). In such cases, since the active switches for the next states may be known, only those switches may be activated until the location of the magnet on the follower has been determined. Thus, the amount of current drawn by the switches may be minimized, improving battery life. In some circumstances, an accelerometer may be installed to wake up the round counting system. For instance, the accelerometer may be configured to detect movement of the follower, allowing the hall effect switches to be shut off when the weapon is inactive or during storage. Additionally or alternatively, the hall switches may be shut off after some period of inactivity (e.g., 30, 60, 90 seconds, etc.), and the last active hall sensor may be polled periodically (e.g., every 10, 20, 30 seconds, etc.) to check for a change of state prior to resuming operation.

FIG. 19 illustrates magnet position sensing with Hall effect sensors, according to an embodiment of the disclosure where two magnets are positioned roughly three (3) pitch distances apart on the follower. As shown, in 0-position, the magnet may be sensed by the first three (3) sensors, where an output from the first sensor may have the highest magnitude and the outputs from the second and third sensors of equal but smaller magnitudes. Further, at 1-position, the first and third sensors may have an equal magnitude and the second sensor would have a larger magnitude. In this way, the processor or MCU hardware may be able to distinguish between 0-position and 1-position, even though the same number of sensors are active, for instance, by using a comparator. Similar to FIG. 18, N/2 or N/2+1 hall effect sensors may be needed in such a setup.

FIG. 20 illustrates magnet position sensing with Hall effect switches, according to an embodiment of the disclosure. In this example, three magnets are positioned four (4) pitch distances apart on the follower (or between three (3) and four (4) pitches apart). Further, N/3 hall effect switches may be needed in such a setup. Similar to FIG. 20, a processor may be able to determine the follower position and subsequent round count based on analyzing and comparing the outputs from the active switches. In the 0-position, switches 1, 2, and 4 are active. In the 1-position, switches 1, 3, and 4 are active. In the 2-position, switches 2, 3, and 4 are active. Hall effect sensors could also be implemented in this embodiment. Although more complicated than FIG. 19 from a magnet and processing standpoint, FIG. 20 could provide a less expensive solution since fewer Hall effect switches/sensors are needed (e.g., N/3 v. N/2).

Figure 21:
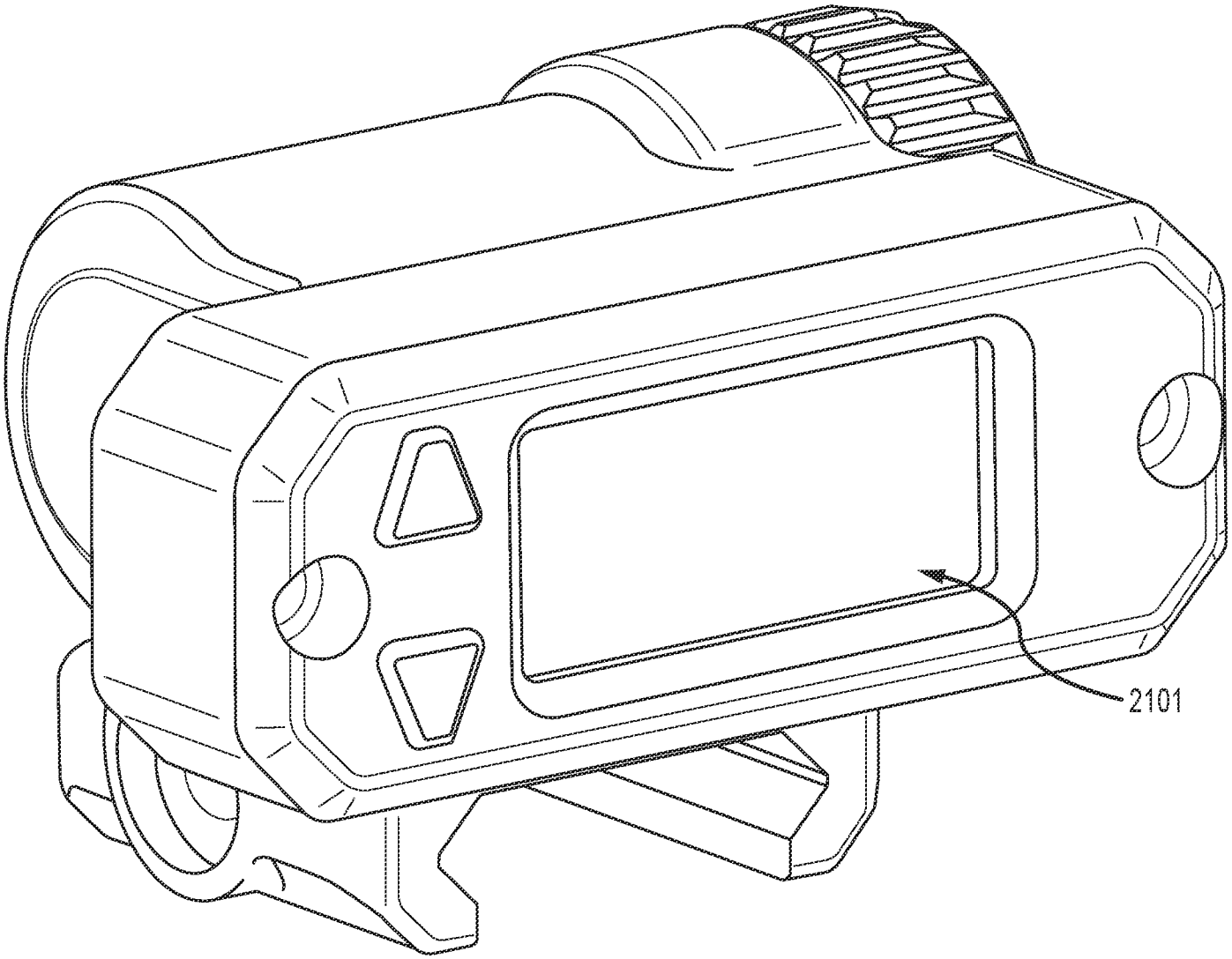
FIG. 21 illustrates a display housing for mounting on the weapon, according to an embodiment of the disclosure.
Figure 22:
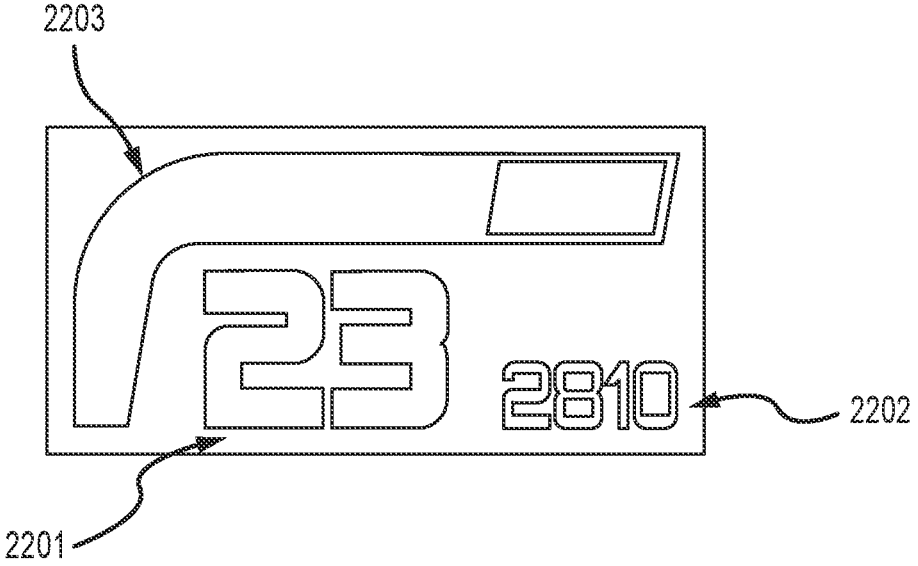
FIG. 22 illustrates an example of a user interface in the display housing of FIG. 21, for displaying the round count.

FIG. 21 illustrates an example of a display housing 2101 mounted on the weapon, according to an embodiment of the disclosure. As shown, the housing 2101 may comprise a screen or a display (see FIG. 22) with a user interface including display graphics and control buttons. In some examples, the display 2101 may be used to indicate the round count 2201, round fired since last reset 2202, a fuel gauge round count indicator 2203 for quick reference along the side and/or top of the display, etc. The user interface/display may also implement features such as a flashing indicator when the round count falls below a threshold (e.g., 9 rounds or less), or the ability to change the brightness (i.e., set by the user, or auto set based on ambient light). In some cases, a user may make changes to the display type using one or more buttons. The user interface may also be capable of communicating wirelessly (e.g., Bluetooth) with other devices, for instance a device on another soldier's weapon/body or a commanding unit. The display housing 2101 may be powered via an internal battery and this same battery may provide power through the NFC connection to the magazine. The display housing 2101 may alternatively receive power from a battery stored in the stock or in the pistol grip of the firearm. In some embodiments, power can be provided via an electrified accessory rail.

Figure 23:
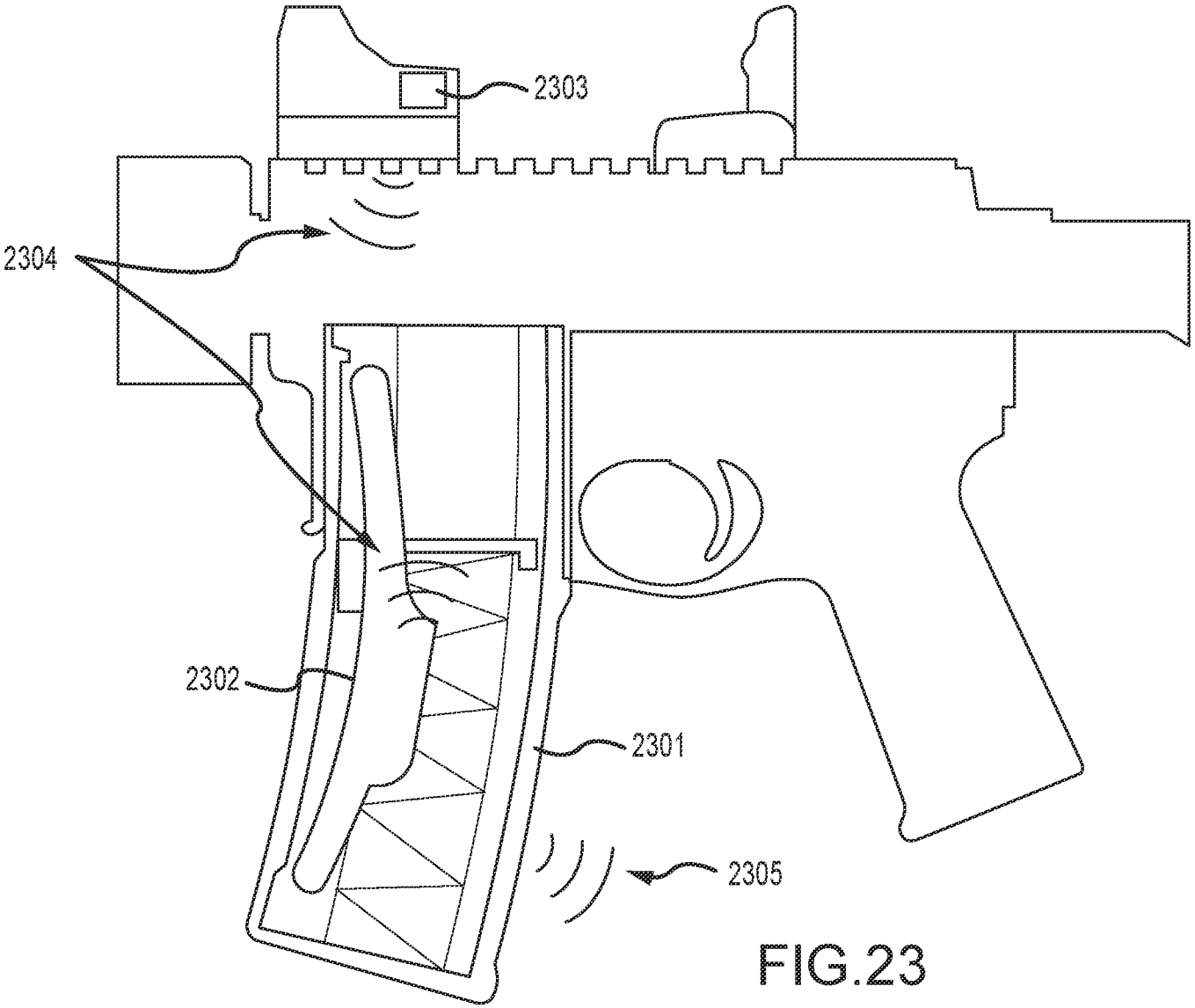
FIG. 23 illustrates a round counting system utilizing a wireless mesh network communication system for transmitting information from the magazine sensing circuitry to a display on the weapon or to/from other magazines.

FIG. 23 illustrates a wireless mesh network communication system for communication from a magazine 2301 to a weapon system 2303 (e.g., to the weapon system circuitry and display), or for communicating between the magazine 2301 and other devices or even other magazines (not shown). Magazine sensing circuitry 2302 may establish a wireless mesh network 2304 for magazine to weapon communication, such as, for transmitting and displaying a magazine round count on the weapon system 2303. Additionally or alternatively, magazine sensing circuitry 2302 may establish wireless mesh network 2305 for communication with other magazines. In some cases, magazine sensing circuitry 2302 may be an example of the round counting systems or magazine processing circuits described with reference to the FIGs. above.

Wireless mesh networks 2304 and/or 2305 may operate using the Thread protocol, BLE protocol, or Zigbee protocol, to name a few non-limiting examples. In some circumstances, the magazine may normally be in a sleep state (i.e., to conserve power). Further, if the number of rounds in the magazines changes (increases or decreases), the magazine may wake up, send out a new round count to the weapon system 2303, as well as a unique magazine ID, and then return to a sleep state. In some cases, the waking up procedure may be based in part on an accelerometer in the weapon or magazine being triggered. In some cases, the magazine 2301 may also report a round count and ID to any other nearby magazines on mesh network 2305. The magazine sensing circuitry 2302 may be embedded on a side of the magazine along with the battery source, or the battery source may be in the grip of the firearm or in the display 2303. It should be noted that the battery may be rechargeable or chargeable (i.e., primary or secondary type).

Figure 24:
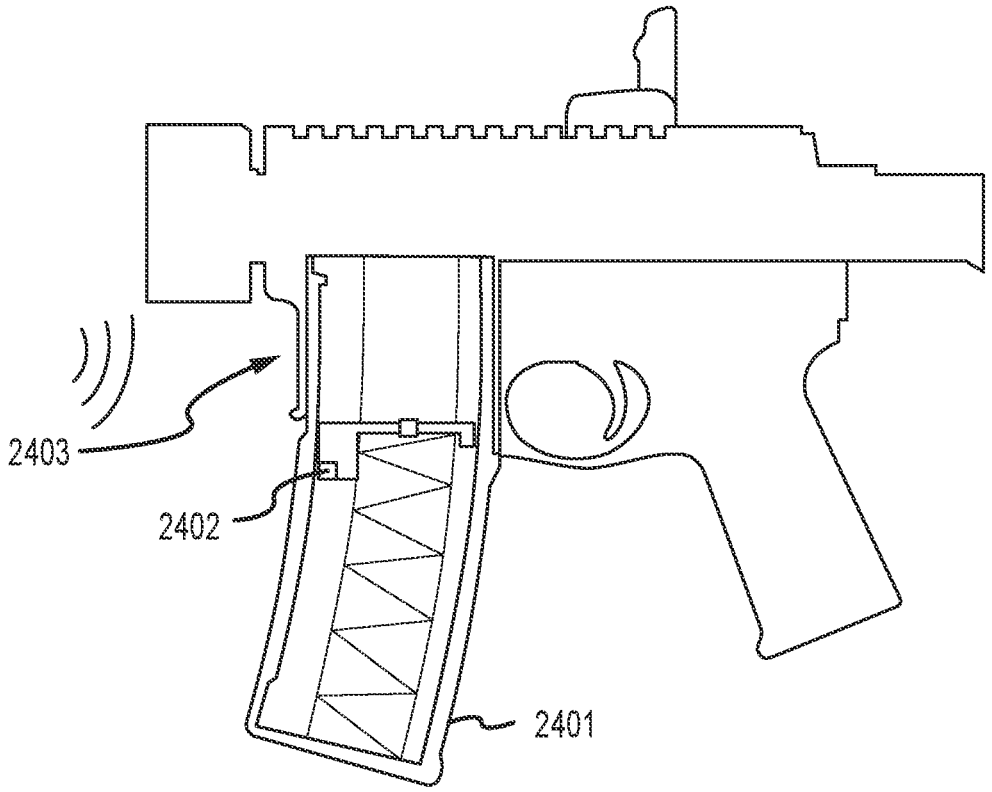
FIG. 24 is a side view of a firearm receiver and a detachable magazine, illustrating a round counting system utilizing an ultra-high frequency or millimeter-wave (mmW) transceiver, according to an alternate embodiment of the disclosure.

FIG. 24 illustrates a round counting system utilizing an ultra-high frequency (UHF) radar or mmW transceiver (e.g., operating around 60 GHz), according to an embodiment of the disclosure. In some circumstances, a mmW transceiver may transmit electromagnetic waves and analyze their reflection from objects, which may be referred to as active scanning. In some other cases, a mmW transceiver may create images or detect objects using only ambient radiation and/or radiation emitted from human body or objects, which may be referred to as passive scanning.

As shown in FIG. 24, a firearm may comprise a magazine 2401, an object 2402 with a high radar profile installed on the follower of the magazine 2401, as well as a slot opening 2403 in the front of the magazine well. A mmW transceiver may be used to detect the position of the follower within the magazine by emitting UHF waves (the slot opening 2403 can allow the UHF waves to pass through the magazine well) and subsequently detecting the reflected waves. In some cases, the follower position (and round count) may be determined based on the time required for the reflections (i.e., time delay), phase of reflected waves, any frequency changes, etc. In other words, by analyzing subtle changes in the reflected signal over time, the mmW transceiver and its processing circuitry may be used to accurately locate the position of the follower within the magazine, and hence the round count.

Figure 25:
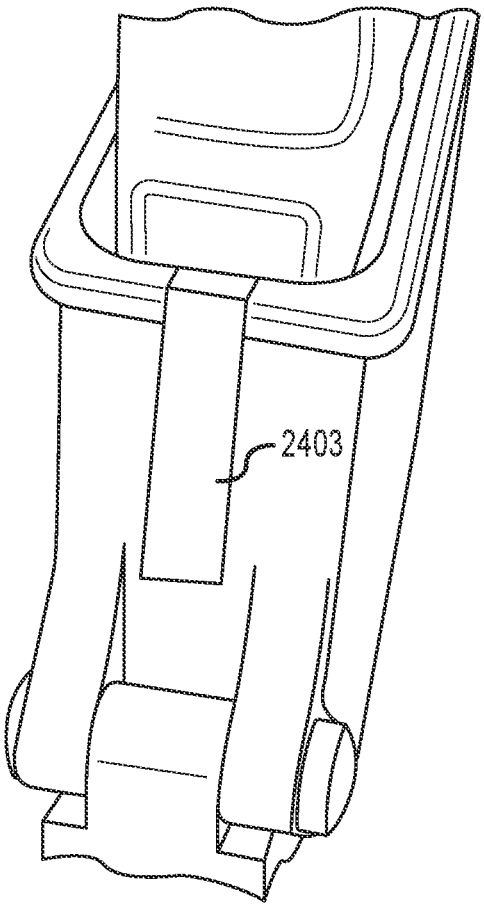
FIG. 25 is a detailed view of the magazine well in FIG. 24, illustrating the slot opening.

In some cases, a mmW based round counting system may need limited modifications to the magazine 2401, besides the addition of the high radar profile object 2402 on the follower. Further, since the mmW transceiver is placed on the weapon and all the processing is done on the reflected waves received at the transceiver, no battery may be needed in the magazine. However, such a system may require minor modifications to the magazine well (i.e., slot opening 2403, also seen in FIG. 25), and overall power requirements may be comparable to or greater than using hall effect switches in the magazine, albeit less than RFID tags.

Figure 26A:
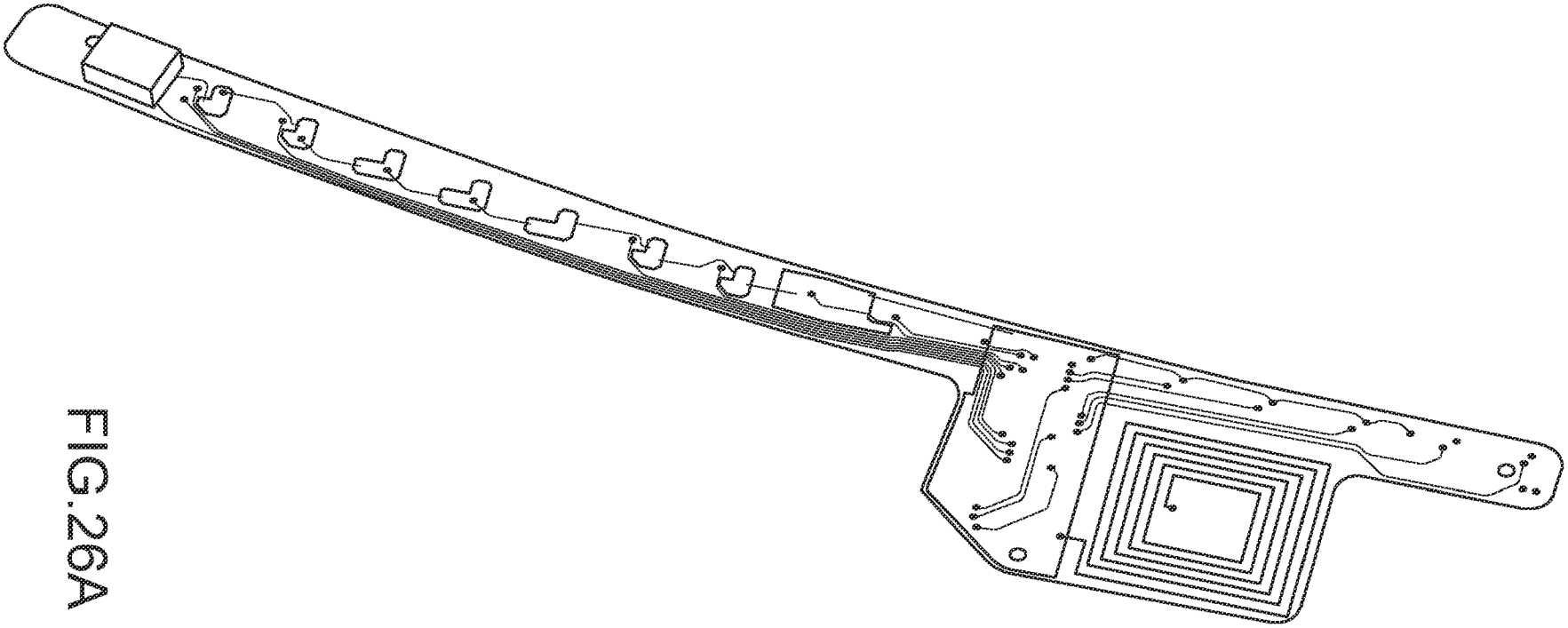
FIG. 26A is a front view of the magazine board in FIG. 5, illustrating the PCB layout.
Figure 26B:
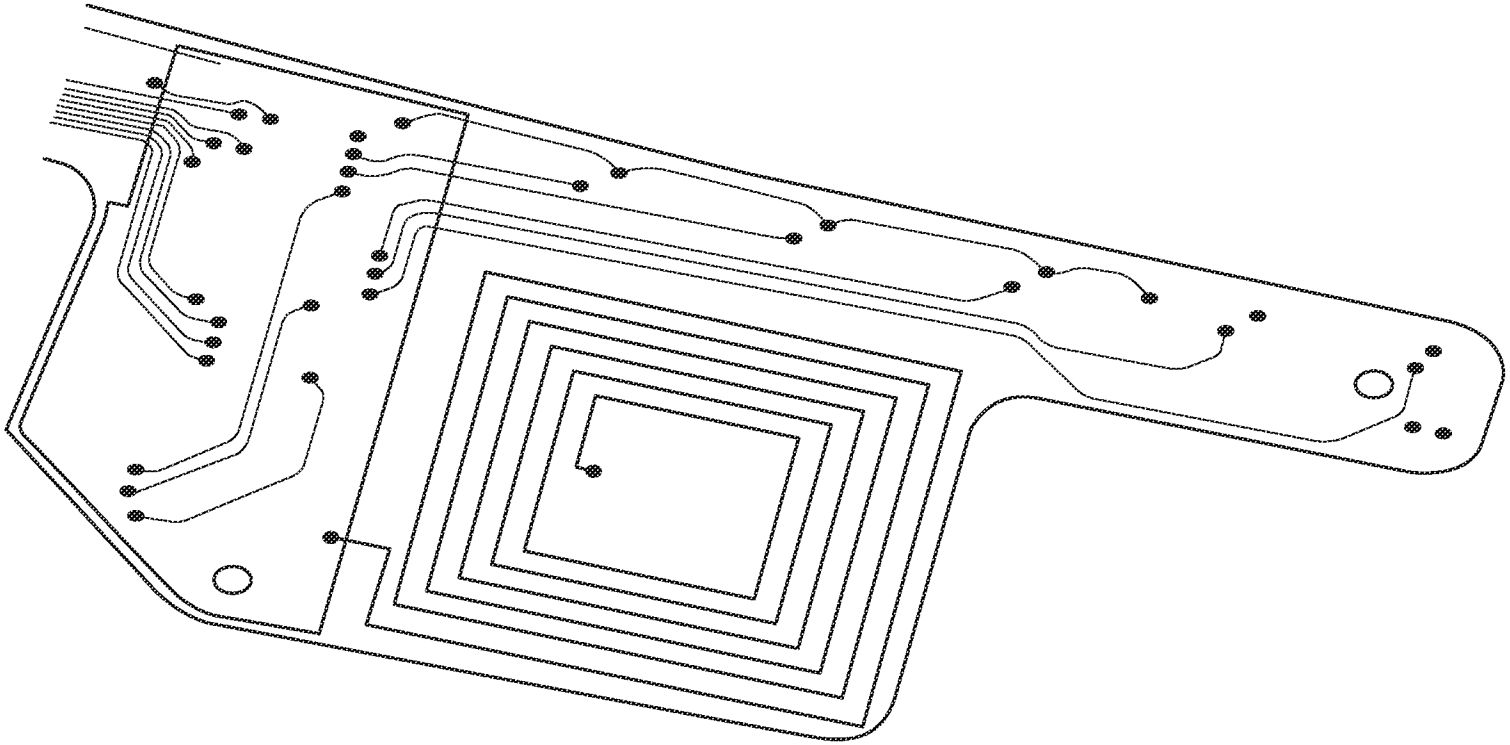
FIG. 26B is a detailed view of the magazine board in FIG. 26A.

FIG. 26A is a front view of the magazine board in FIG. 5, illustrating the PCB layout. FIG. 26B is a detailed view of the NFC antenna of the magazine board in FIG. 26A.

Figure 27A:
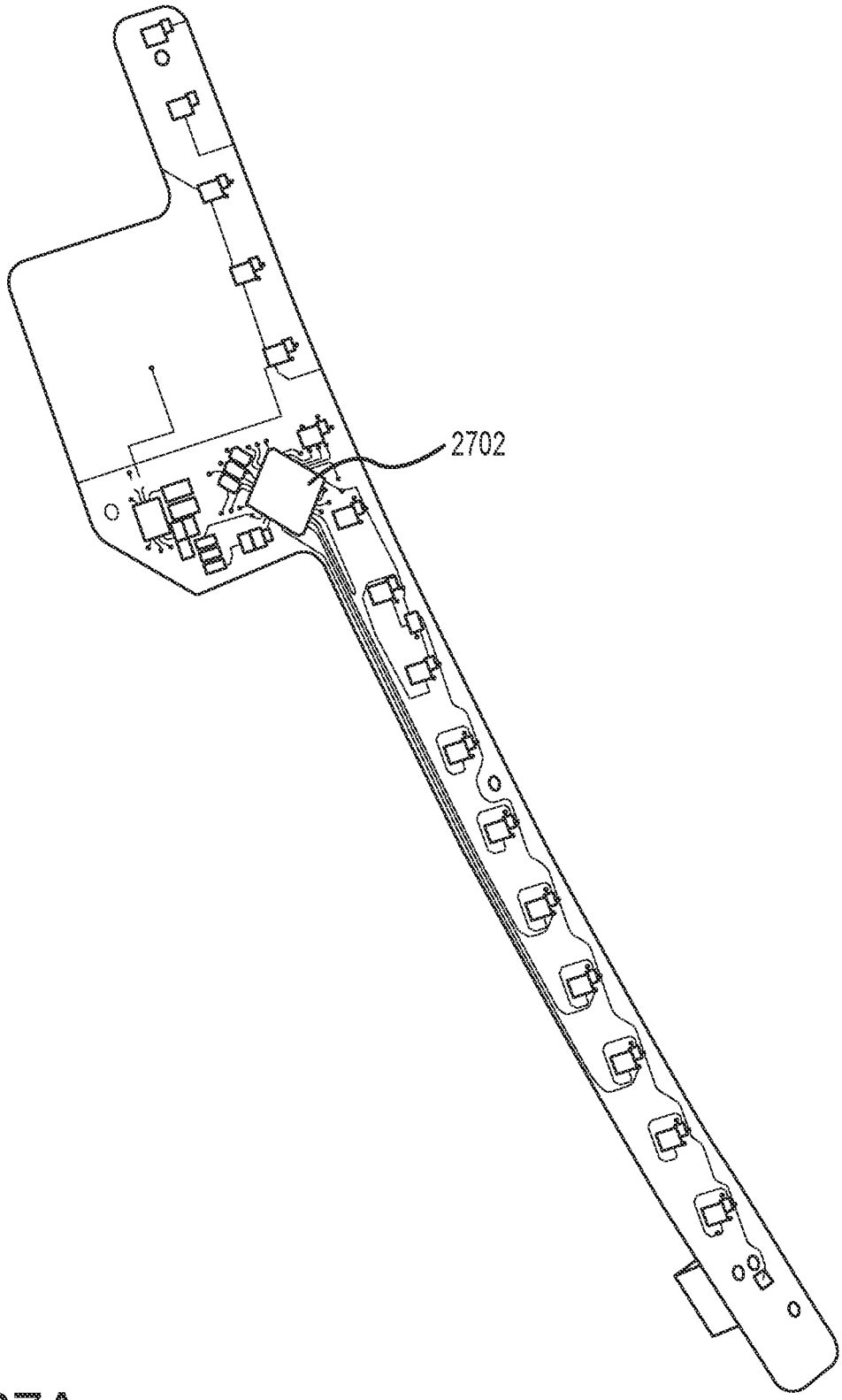
FIG. 27A is a rear view of the magazine board in FIG. 26A, illustrating the PCB layout.
Figure 27B:
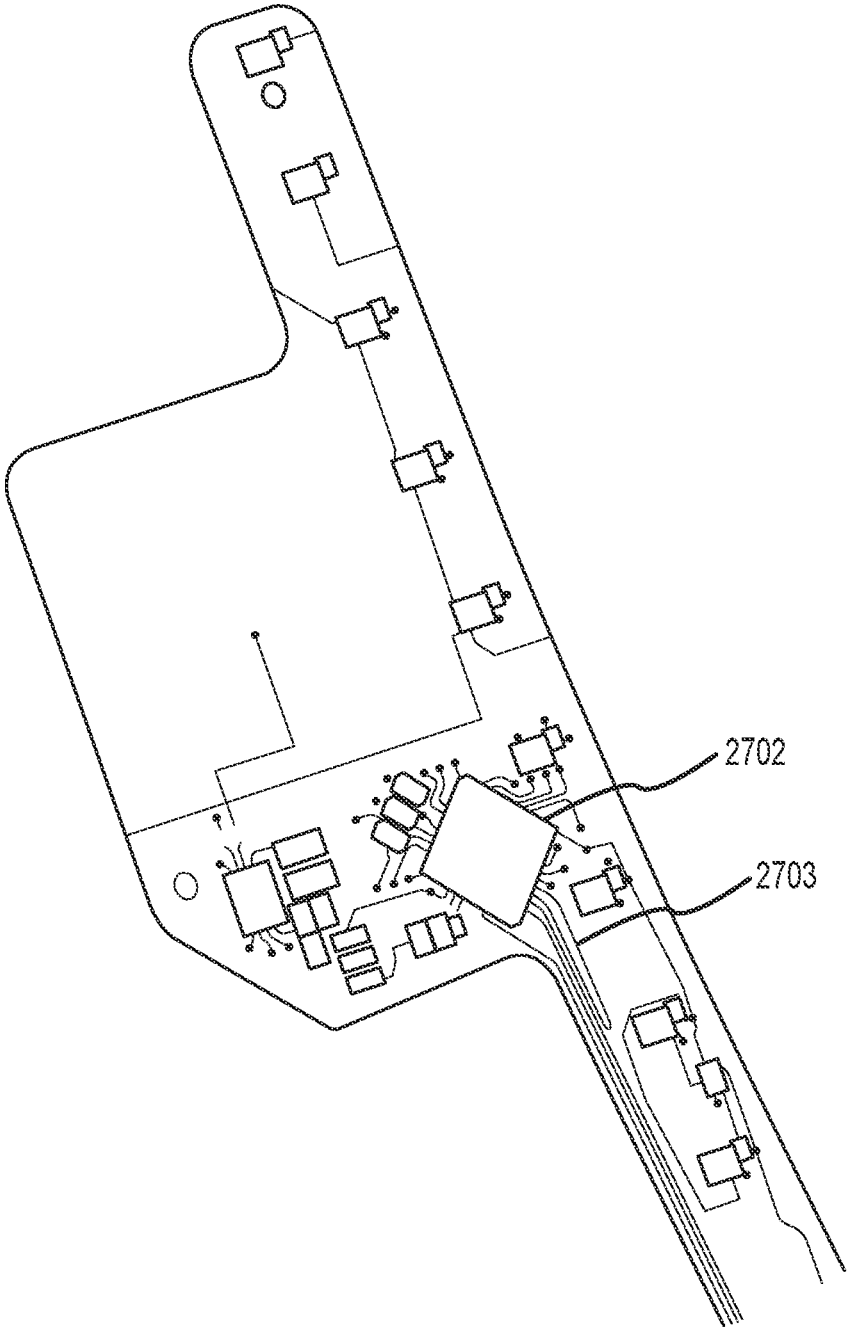
FIG. 27B is a detailed rear view of the processing circuit of the magazine board in FIG. 27A.

FIG. 27A is a rear view of the magazine board in FIG. 26A, illustrating a magnetic processing circuit 2702 of the magazine board. FIG. 27B is a detailed view of the magnetic processing circuit 2702 in FIG. 27A. An example of the magnetic processing circuit 2702 is the processor 6108 in FIG. 6. The magazine board in FIGS. 26 and 27 may be the circuit board 510 seen in FIG. 5 or the circuit board seen in FIGS. 12 and 13 or as seen in FIG. 16.

Some jurisdictions impose regulations limiting the number of rounds a magazine can have (e.g., 10 rounds or less, 30 rounds or less, etc.). In such cases, separate round counting systems may need to be produced for the 10-round and 30-round magazines (i.e., with different number of hall effect switches or sensors, or reed switches). While the number of switches or sensors may need to vary for different magazine sizes, a single PCB may be able to accommodate the two sizes. In some cases, the magnetic processing circuit 2702 may comprise an extra loop 2703 which may be severed (e.g., for a smaller magazine), and retained for a larger magazine. In some other cases, the extra loop 2703 may be formed when connecting two pins on the magnetic processing circuit 2702. In such cases, the extra loop 2703 may be initially left as 'open' for a smaller magazine (i.e., the two pins are left unconnected or open) and 'shorted' prior to installation in a larger magazine (or vice versa). In some embodiments, the two pins may be shorted via soldering (i.e., soldering two ends of a wire to the first and second pins), or the two pins may be connected to each other using the same bus on the PCB. In this way, only a single PCB may need to be designed and produced, and the extra loop may serve to optimize production of different versions of the magazine and round counting system.

Figure 28A:
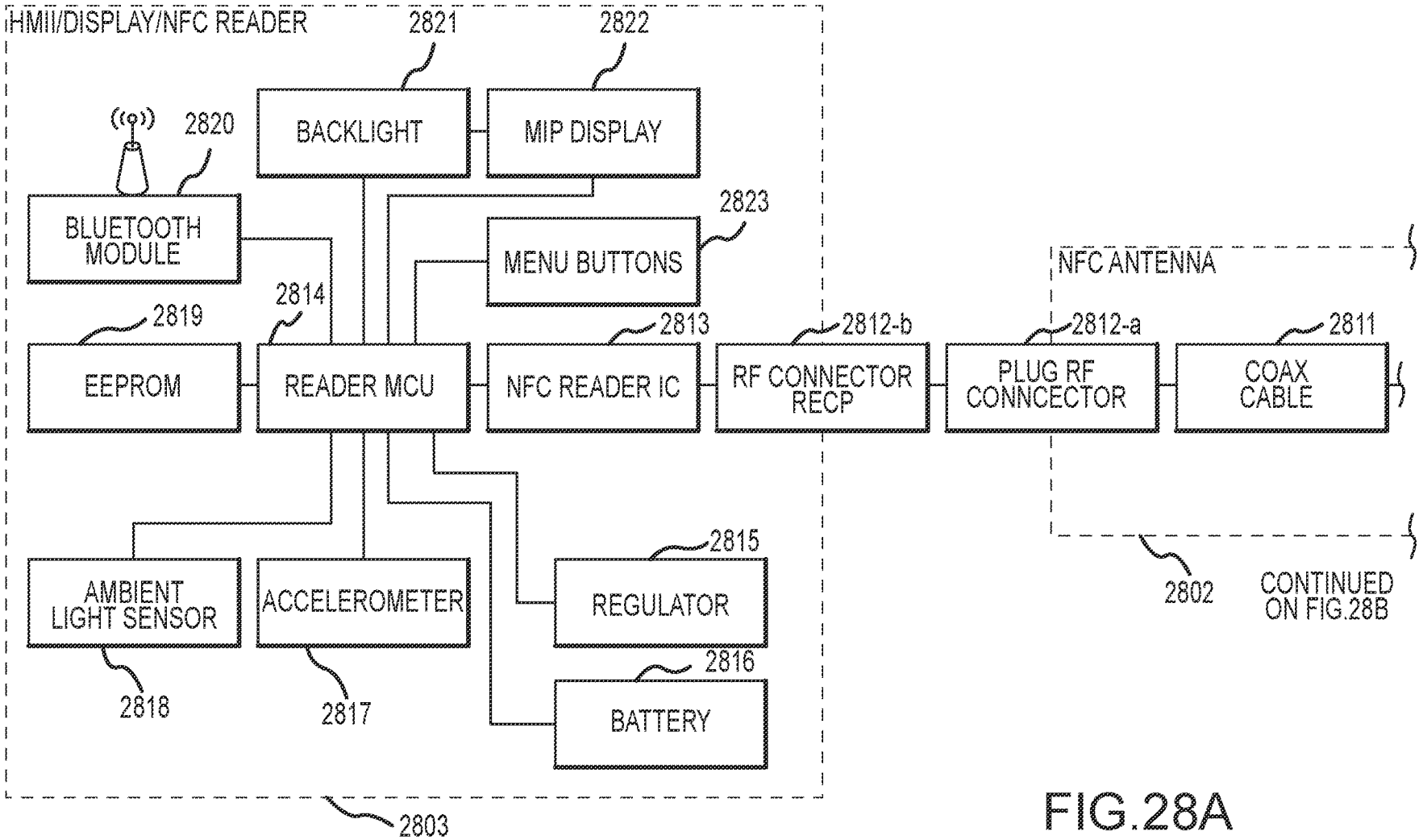
FIG. 28 is a high-level system block diagram, according to an embodiment of the disclosure.
Figure 28B:
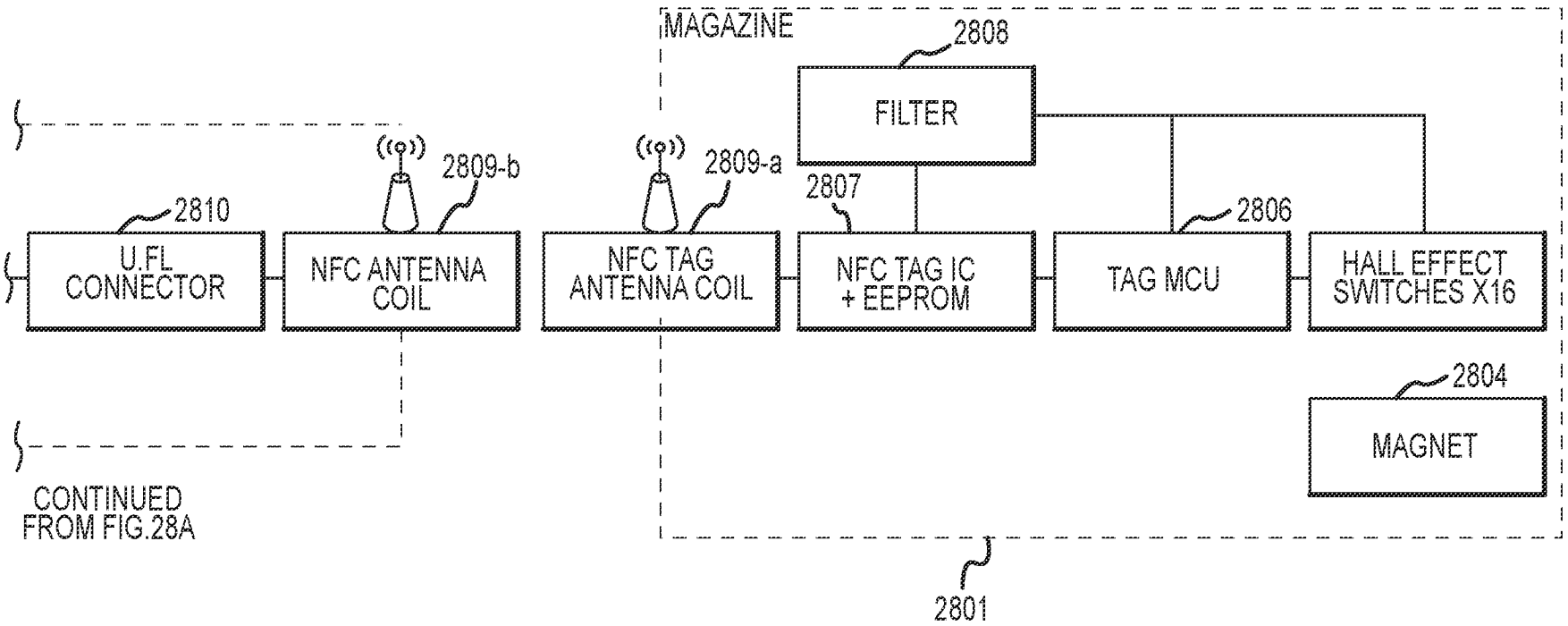

FIG. 28 illustrates a block diagram 2800 of an embodiment of the round counting system including a magazine 2801 with a magazine circuit board, an NFC antenna 2802 on the firearm, and a display assembly 2803.

The magazine 2801 may comprise one or more magnets 2804. Further, the magazine circuit or circuit board can include <N Hall effect switches 2805 (e.g., N/2, N/3, N/4, (N/2+1, (N/3+1, or (N/4+1), a processor comprising MCU 2806 and an EEPROM 2807, and an NFC antenna coil 2809-*a*. The NFC antenna coil may be fabricated on a printed circuit board. In some examples, the EEPROM 2807 may be an integrated circuit (IC). Optionally, the circuit may also include a filter 2808 and an NFC controller (e.g., NFC tag 2807).

The NFC antenna system 2802 on the firearm can include an NFC antenna coil 2809-*b*, whose area may substantially overlap with an area of the NFC antenna coil 2809-*a*. The NFC antenna system 2802 may also include a connector 2810, a coax (or RF) cable 2811, and a plug RF connector 2812-*a*. The one or more subcomponents of the NFC antenna system 2802 may be interconnected to each other via one or more buses. In some cases, both power and data may be exchanged using the one or more buses.

The display assembly 2803 can include a RF connector for reception from the NFC antenna, as described with reference to FIGS. 14 and 15. The display assembly 2803 may also include an NFC reader 2813, a MCU reader 2816, a regulator 2815, a battery 2816, an accelerometer 2817 (optional), an ambient light sensor 2818 (optional), an EEPROM 2819, a Bluetooth module 2820, a backlight 2821, a display (e.g., Memory In Pixel (MIP)) 2822, and one or more menu buttons 2823. As illustrated, the one or more subcomponents of the display assembly 2803 may be connected via one or more buses to the MCU reader 2816.

Figure 29:
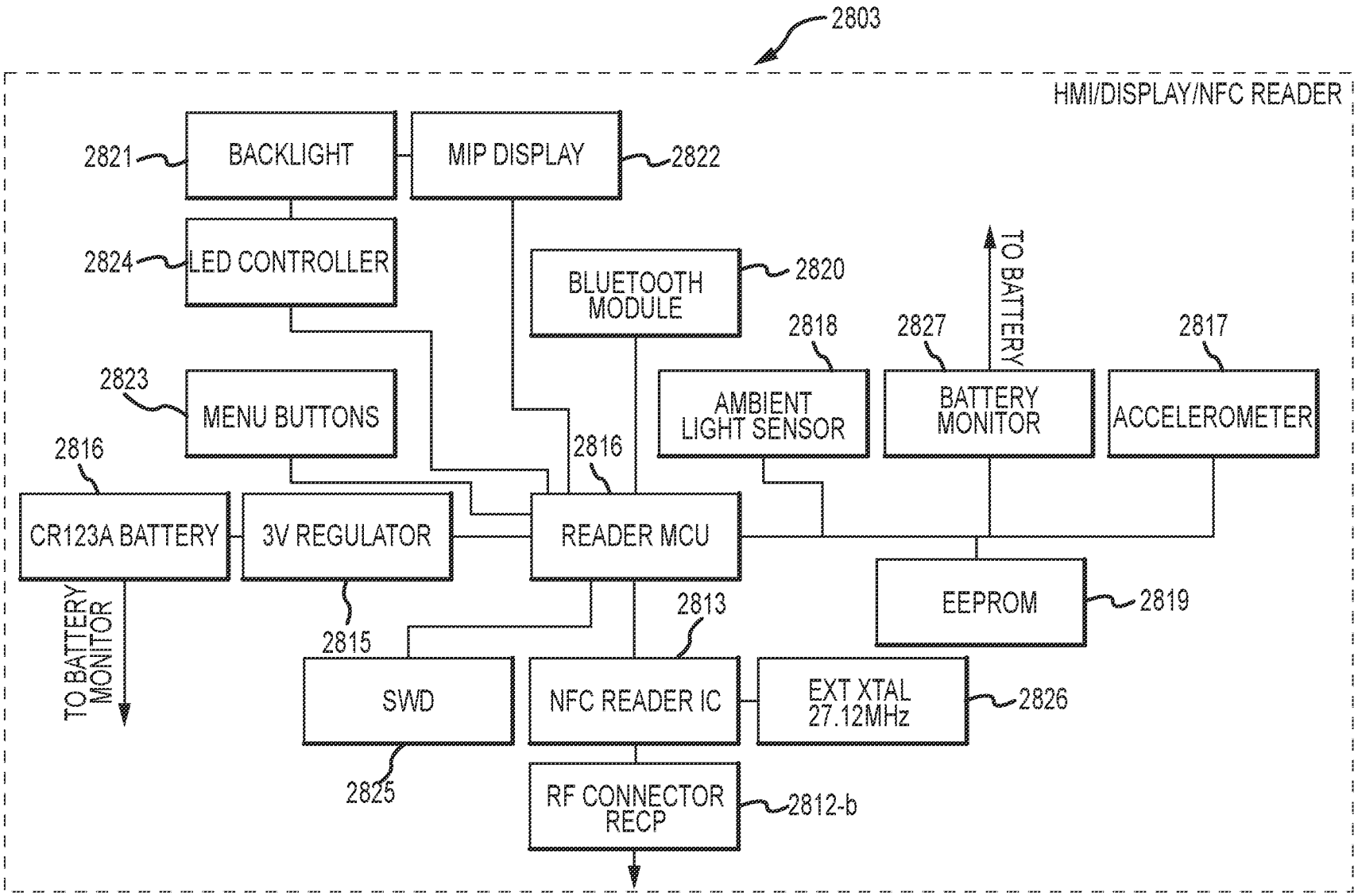
FIG. 29 is a low-level system block diagram of the display in FIG. 28.

FIG. 29 illustrates a lower level block diagram of an embodiment of the display assembly 2803. As illustrated, the one or more subcomponents of the display assembly 2803 may be connected via one or more buses to the MCU reader 2816.

The display assembly 2803 can include a RF connector 2812-*b* for reception from the NFC antenna system 2802 (not shown), further described with reference to FIGS. 14 and 15. The display assembly 2803 may also include a MCU reader 2816 in connection with NFC reader 2813, a regulator 2815, one or more menu buttons 2823, LED controller 2824, an accelerometer 2817 (optional), an ambient light sensor 2818 (optional), battery monitor 2827, an EEPROM 2819, a Bluetooth module 2820, and a display (e.g., Memory In Pixel (MIP)) 2822.

Further, the regulator 2815 (e.g., 3V regulator) may be connected to the battery 2816, which may be in connection with the battery monitor 2827. In some examples, the LED controller 2824 may be connected to the backlight 2821, where the backlight brightness may be adjusted based on an output from the ambient light sensor 2818. In some examples, the MCU reader 2816 may also communicate with a Serial Wire Debug (SWD) interface to enable a tester to gain access to system memory, peripheral, and/or debug registers. In some circumstances, the NFC reader 2813 may connect to an external crystal oscillator or clock 2826 (e.g., operating at 27.12 MHz), which may be used in lieu of a built-in internal oscillator of the MCU Reader 2816 or the NFC reader 2813. In some cases, built-in oscillators may be susceptible to errors when serial communication is being used, or when a fast clock or exact timing is needed, and the external clock 2826 may be used to improve accuracy.

Figure 30:
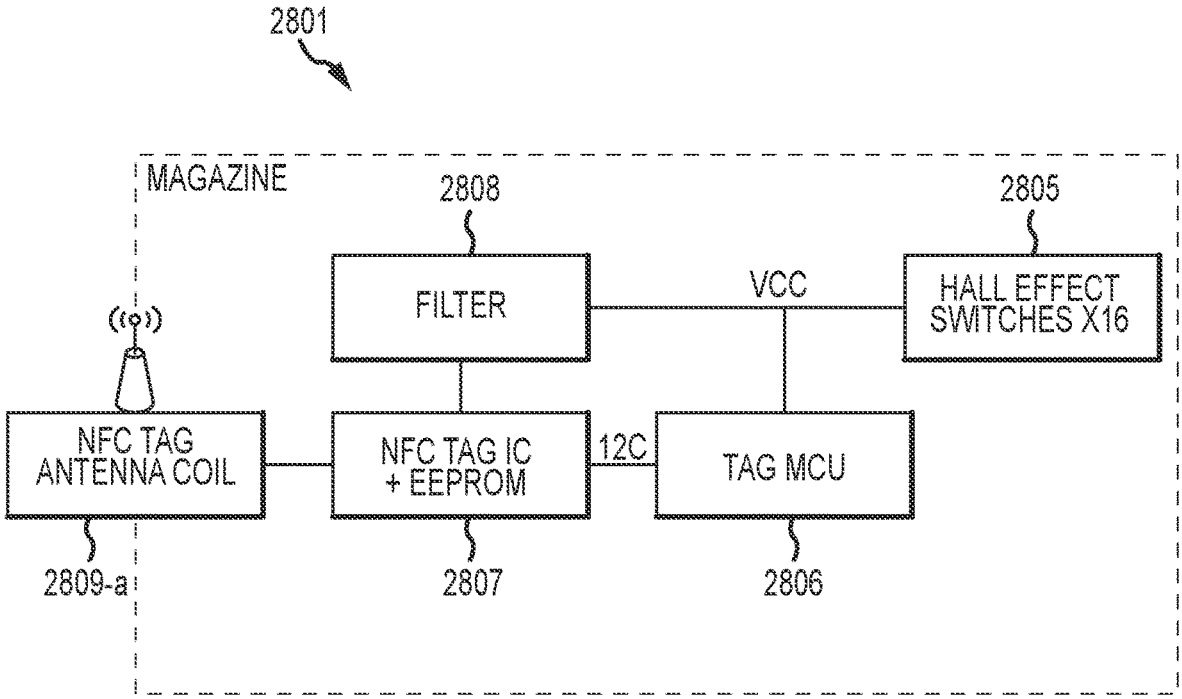
FIG. 30 is a low-level system block diagram of the magazine in FIG. 28.

FIG. 30 illustrates a lower level block diagram of an embodiment of the magazine 2801.

Figure 31:
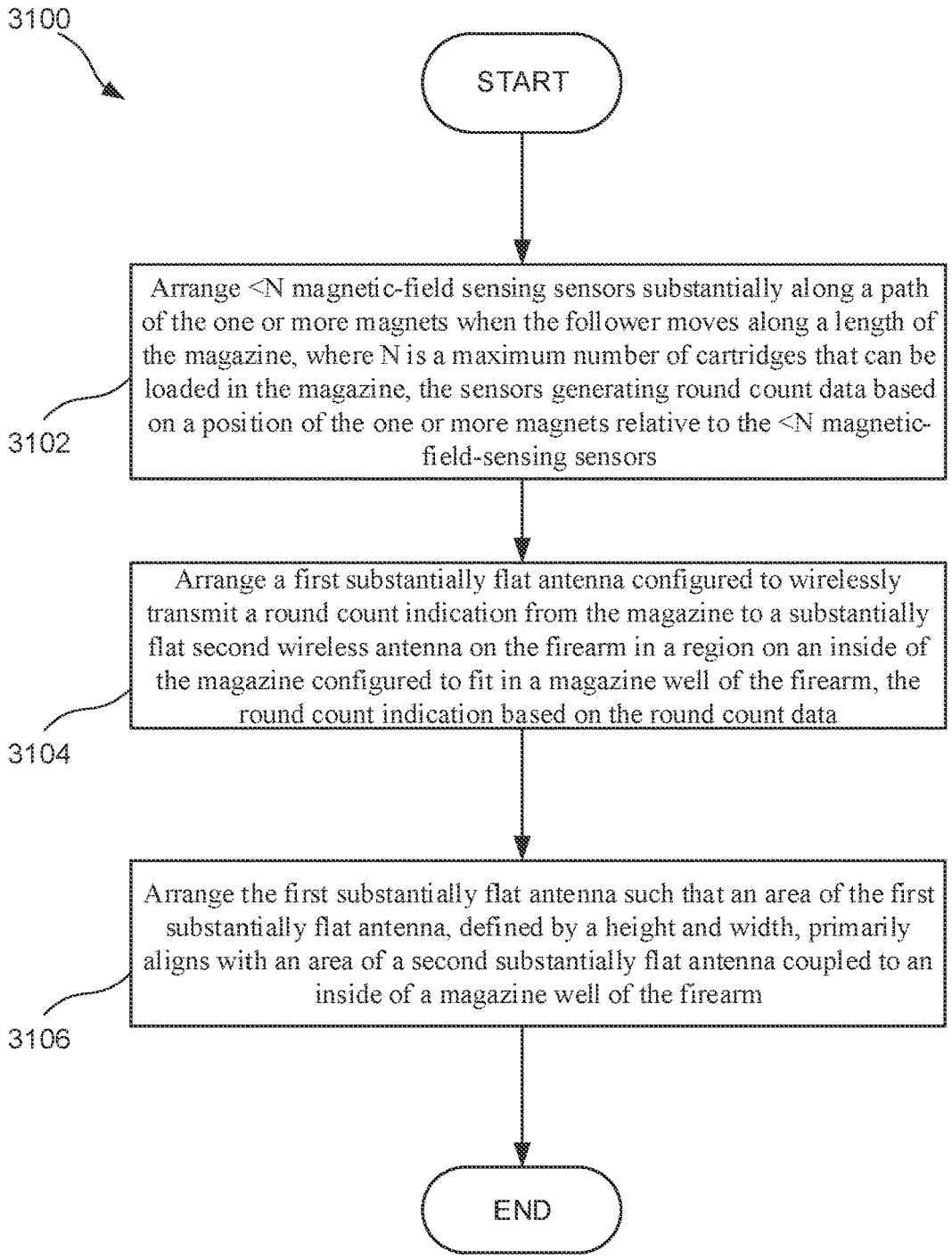
FIG. 31 is a flowchart of a method of manufacturing a magazine with a round counting system.

Turning now to FIG. 31, a method 3100 of manufacturing a magazine with a round counting system is now described. In some cases, the magazine may comprise at least an overtravel stop and a follower, where the follower comprises one or more magnets.

The method may include arranging 3102<N magnetic-field-sensing sensors substantially along a path of the one or more magnets when the follower moves along a length of the magazine, where N is a maximum number of cartridges that can be loaded in the magazine, the sensors generating round count data based on a position of the one or more magnets relative to the <N magnetic-field-sensing sensors.

The method may also include arranging 3104 a first substantially flat antenna on an inside of the magazine at or above the overtravel stop (or in a region of the magazine that is configured to fit at least partially within a magazine well of the firearm), the first substantially flat antenna configured to wirelessly transmit a round count indication from the magazine to a second substantially flat antenna on the firearm, the round count indication based on the round count data. In some examples, the second substantially flat antenna may transmit power in the reverse direction to the data flow to the first substantially flat antenna, for instance, from a power source located on the firearm (e.g., firearm grip). In this way, the magnetic processing circuitry and sensors in the magazine may receive power without needing a power source in the magazine.

Further, the method may include arranging 3106 the first substantially flat antenna such that an area of the first substantially flat antenna, defined by a height and width, primarily aligns with an area of a second substantially flat antenna coupled to an inside of a magazine well of the firearm.

Figure 32:
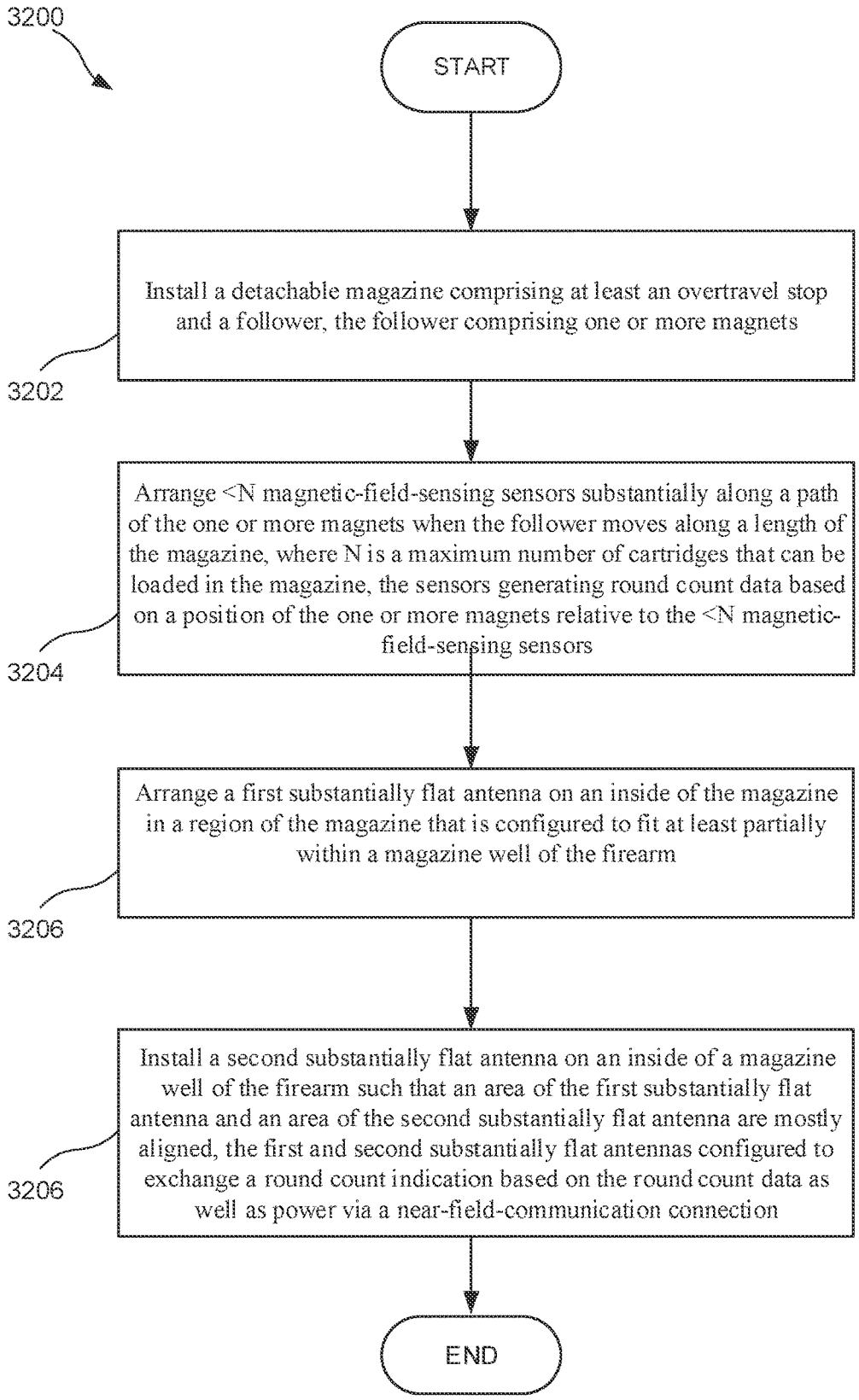
FIG. 32 is a flowchart of a method of installing a round counting system on a firearm.

FIG. 32 illustrates a method 3200 of installing a round counting system on a firearm. The method may comprise installing 3202 a detachable magazine comprising at least an overtravel stop and a follower, the follower comprising one or more magnets.

The method may further comprise arranging 3204<N magnetic-field-sensing sensors substantially along a path of the one or more magnets when the follower moves along a length of the magazine, where N is a maximum number of cartridges that can be loaded in the magazine, the sensors generating round count data based on a position of the one or more magnets relative to the <N magnetic-field-sensing sensors.

In some cases, the method may comprise arranging 3206, at or above the overtravel stop (or in a region of the magazine that is configured to fit at least partially within a magazine well of the firearm), a first substantially flat antenna on an inside of the magazine. The method may also comprise installing 3208 a second substantially flat antenna on an inside of a magazine well of the firearm such that an area of the first substantially flat antenna and an area of the second substantially flat antenna are mostly aligned, where the first and second substantially flat antennas are configured to exchange a round count indication based on the round count data as well as power via a near-field-communication (NFC) connection.

Figure 33:
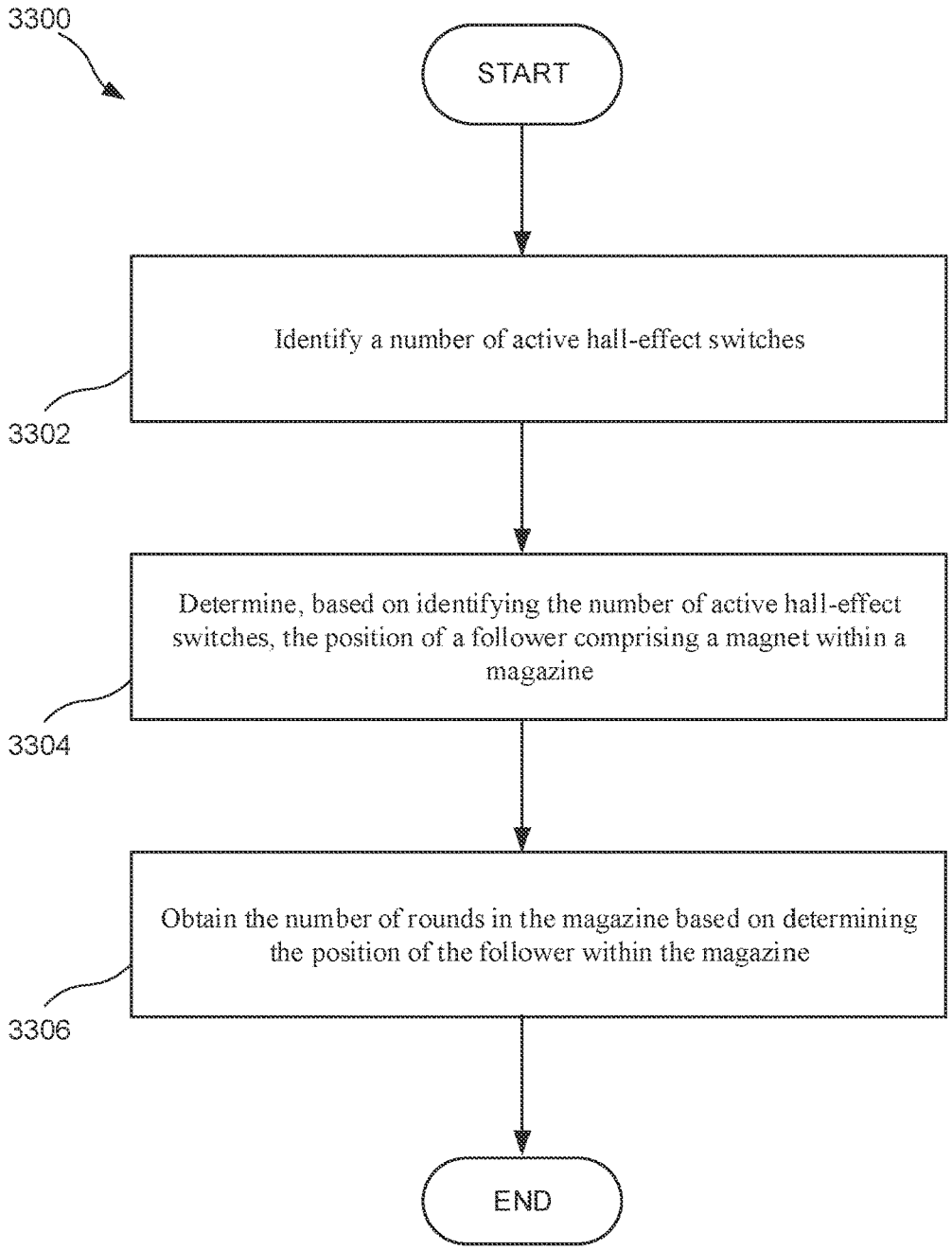
FIG. 33 is a flowchart of a method of obtaining the number of rounds in a magazine utilizing a round counting system with a Hall effect switch array.

FIG. 33 illustrates a method 3300 for obtaining the number of rounds in a magazine utilizing a round counting system with a Hall effect switch array, where the number of switches is <N. It should be noted that N represents the round capacity of the magazine. In some cases, the method may comprise identifying 3302 a number of active Hall effect switches. In some circumstances, a processor may be used to assess the signals from the array of Hall effect switches.

The method may further comprise determining 3304 the position of a follower comprising a magnet within the magazine based on identifying the number of active Hall effect switches. If a single Hall effect switch is active, the follower may be aligned with that Hall effect switch. In some other cases, if two Hall effect switches are active, the follower may be roughly between the two switches, as illustrated in FIG. 18.

In some cases, the method may also comprise obtaining 3306 the number of rounds in the magazine based on determining the position of the follower within the magazine. For instance, using the two scenarios described in 3304, a processor may be able to distinguish between each and every cartridge position, even though <N Hall effect switches are used.

Some portions are presented in terms of algorithms or symbolic representations of operations on data bits or binary digital signals stored within a computing system memory, such as a computer memory. These algorithmic descriptions or representations are examples of techniques used by those of ordinary skill in the data processing arts to convey the substance of their work to others skilled in the art. An algorithm is a self-consistent sequence of operations or similar processing leading to a desired result. In this context, operations or processing involves physical manipulation of physical quantities. Typically, although not necessarily, such quantities may take the form of electrical or magnetic signals capable of being stored, transferred, combined, compared or otherwise manipulated. It has proven convenient at times, principally for reasons of common usage, to refer to such signals as bits, data, values, elements, symbols, characters, terms, numbers, numerals or the like. It should be understood, however, that all of these and similar terms are to be associated with appropriate physical quantities and are merely convenient labels. Unless specifically stated otherwise, it is appreciated that throughout this specification discussions utilizing terms such as "processing," "computing," "calculating," "determining," and "identifying" or the like refer to actions or processes of a computing device, such as one or more computers or a similar electronic computing device or devices, that manipulate or transform data represented as physical electronic or magnetic quantities within memories, registers, or other information storage devices, transmission devices, or display devices of the computing platform.

As will be appreciated by one skilled in the art, aspects of the present invention may be embodied as a system, method or computer program product. Accordingly, aspects of the present invention may take the form of an entirely hardware embodiment, an entirely software embodiment (including firmware, resident software, micro-code, etc.) or an embodiment combining software and hardware aspects that may all generally be referred to herein as a "circuit," "module" or "system." Furthermore, aspects of the present invention may take the form of a computer program product embodied in one or more computer readable medium(s) having computer readable program code embodied thereon.

As used herein, the recitation of "at least one of A, B and C" is intended to mean "either A, B, C or any combination of A, B and C." The previous description of the disclosed embodiments is provided to enable any person skilled in the art to make or use the present disclosure. Various modifications to these embodiments will be readily apparent to those skilled in the art, and the generic principles defined herein may be applied to other embodiments without departing from the spirit or scope of the disclosure. Thus, the present disclosure is not intended to be limited to the embodiments shown herein but is to be accorded the widest scope consistent with the principles and novel features disclosed herein.

What is claimed is:

1. A round counting system for a firearm, the system comprising:

a detachable magazine comprising a follower, the follower comprising one or more magnets, and the magazine comprising:

<N magnetic-field-sensing sensors arranged substantially along a path of the one or more magnets when the follower moves along a length of the magazine, where N is a maximum number of cartridges that can be loaded in the magazine, the sensors generating round count data based on a position of the one or more magnets relative to the <N magnetic-field-sensing sensors; and a first antenna on the magazine arranged in a region of the magazine that is configured to fit at least partially within a magazine well of the firearm, the first antenna configured to wirelessly transmit a round count indication from the magazine to the firearm via a second antenna on the magazine well or a trigger guard of the firearm, the round count indication based on the round count data.

2. The system of claim 1, further comprising a magazine processor configured to convert the round count data to the round count indication for wireless transmission to the firearm via the first antenna, wherein the round count indication represents a number of cartridges remaining in the magazine.

3. The system of claim 2, wherein the processor correlates positive signals from two adjacent magnetic-field-sensing sensors as a follower position between those two sensors.

4. The system of claim 1, further comprising a reader processor configured for coupling to the firearm and in electrical communication with the second antenna, the reader processor is configured to receive the round count indication from the second antenna, the round count indication comprising the round count data from a plurality of the <N magnetic-field-sensing sensors, wherein the reader processor is configured to determine a number of cartridges remaining in the magazine from the round count indication.

5. The system of claim 1, wherein the first antenna receives power from the firearm.

6. The system of claim 5, wherein the power from the firearm is used to power a magazine processor of the magazine and the <N magnetic-field-sensing sensors.

7. The system of claim 1, wherein the magnetic-field-sensing sensors are Hall effect switches.

8. The system of claim 7, wherein the magazine comprises N/2, N/3, N/4, (N+1)/2, (N+1)/3, or (N+1)/4 of the magnetic-field-sensing sensors.

9. The system of claim 1, further comprising a reader processor configured for coupling to the firearm and in electrical communication with the second antenna, the reader processor including a tangible computer readable medium encoded with computer readable instructions for:

reading a radio frequency signal from the second antenna; and controlling a user interface to indicate a number of cartridges remaining in the magazine to a user.

10. The system of claim 9, wherein the user interface is selected from the group consisting of a frequency of a blinking light, a color of one or more lights, a number displayed on a multi-pixel display, a number of LED lights lit up on an LED display, an audible signal, a fuel gauge indicator, and a bar graph indicator.

11. The system of claim 1, wherein the first antenna is on a rear of the magazine.

12. A firearm with a round counting system, the firearm comprising:

a barrel;

a receiver;

a trigger guard coupled to the receiver;

a magazine well coupled to the trigger guard and the receiver and configured to releasably receive a magazine;

the magazine configured to carry up to N cartridges and comprising:

a follower comprising one or more magnets;

<N magnetic-field-sensing sensors arranged substantially along a path of the one or more magnets when the follower moves through the magazine, the magnetic-field-sensing sensors generating round count data based on a position of the one or more magnets relative to the <N magnetic-field-sensing sensors; and a first antenna on the magazine located so as to align with a second antenna on the magazine well or trigger guard of the firearm when the magazine is fully inserted into the magazine well, the first antenna configured to pass the round count data, or a round count generated from the round count data, to the second antenna.

13. The firearm of claim 12, further comprising a display configured to display the round count.

14. The firearm of claim 12, further comprising a processor configured to correlate positive signals from two adjacent ones of the <N magnetic-field-sensing sensors as a position of the follower between the two adjacent sensors.

15. The firearm of claim 12, wherein the <N magnetic-field-sensing sensors are Hall effect switches.

16. The firearm of claim 12, wherein there are N/2, N/3, N/4, (N+1)/2, (N+1)/3, or (N+1)/4 of the magnetic-field-sensing sensors.

17. A method of determining a number of remaining rounds in a magazine in a firearm, the method comprising:

providing a magazine configured to carry up to N cartridges;

providing a follower of the magazine having one or more magnets;

providing <N magnetic-field-sensing sensors in a line or arc within the magazine;

generating a voltage sufficient to exceed a threshold at two of the <N magnetic-field-sensing sensors when the one or more magnets of the follower are substantially equidistant from at least one of the two of the <N magnetic-field-sensing sensors;

passing the voltage, or a signal derived from the voltage, across a wireless interface between the magazine and the firearm; and displaying an indication of the remaining number of rounds in the magazine based on the voltage or the signal derived from the voltage.

18. The method of claim 17, wherein the display is remote from the firearm.

19. The method of claim 17, further comprising wirelessly passing power from the firearm to the magazine.

20. The method of claim 17, further comprising generating a voltage sufficient to exceed the threshold at only one of the <N magnetic-field-sensing sensors when the one or more magnets of the follower are substantially aligned with the only one of the <N magnetic-field-sensing sensors.

* * * * *